US012156626B2

(12) United States Patent
Conrad et al.

(10) Patent No.: US 12,156,626 B2
(45) Date of Patent: Dec. 3, 2024

(54) SURFACE CLEANING APPARATUS

(71) Applicant: Omachron Intellectual Property Inc., Hampton (CA)

(72) Inventors: Wayne Ernest Conrad, Hampton (CA); Daniel Innes, West Roxbury, MA (US)

(73) Assignee: Omachron Intellectual Property Inc., Hampton (CA)

( * ) Notice: Subject to any disclaimer, the term of this patent is extended or adjusted under 35 U.S.C. 154(b) by 349 days.

(21) Appl. No.: 17/531,062

(22) Filed: Nov. 19, 2021

(65) Prior Publication Data

US 2022/0151446 A1 May 19, 2022

Related U.S. Application Data

(63) Continuation-in-part of application No. 17/342,299, filed on Jun. 8, 2021, now Pat. No. 11,737,621, and (Continued)

(30) Foreign Application Priority Data

Mar. 13, 2009 (CA) ..... CA 2658372

(51) Int. Cl.
*A47L 5/24* (2006.01)
*A47L 5/22* (2006.01)
(Continued)

(52) U.S. Cl.
CPC ..... *A47L 5/24* (2013.01); *A47L 5/225* (2013.01); *A47L 5/28* (2013.01); *A47L 5/32* (2013.01);
(Continued)

(58) Field of Classification Search
CPC ..... A47L 5/225; A47L 5/24
See application file for complete search history.

(56) References Cited

U.S. PATENT DOCUMENTS 6,231,649 B1 5/2001 Dyson et al.
6,482,252 B1 11/2002 Conrad et al.
(Continued)

FOREIGN PATENT DOCUMENTS

CN 108567374 A 9/2018
EP 2389849 A2 11/2011
(Continued)

OTHER PUBLICATIONS

WO2020108492A1 (machine translation) (Year: 2020).*
(Continued)

*Primary Examiner* — Andrew A Horton
(74) *Attorney, Agent, or Firm* — Philip C. Mendes da Costa; SMART & BIGGAR LP

(57) ABSTRACT

A hand vacuum cleaner has a cyclone provided in the air flow path and a dirt collection chamber external to the cyclone. The cyclone air inlet and the cyclone air outlet are located at the cyclone chamber rear end and the dirt outlet is located at the cyclone chamber front end. When the upper end of the hand vacuum cleaner is positioned above the lower end of the hand vacuum cleaner, the central longitudinally extending axis of the cyclone is oriented generally horizontally, the cyclone air inlet is located at a lower end of the cyclone and the dirt outlet is located at an upper end of the cyclone.

20 Claims, 27 Drawing Sheets

Related U.S. Application Data a continuation-in-part of application No. 17/196,380, filed on Mar. 9, 2021, now Pat. No. 11,622,659, said application No. 17/342,299 is a continuation of application No. 16/900,465, filed on Jun. 12, 2020, now Pat. No. 11,445,875, said application No. 17/196,380 is a continuation of application No. 15/931,973, filed on May 14, 2020, now Pat. No. 11,529,031, which is a continuation of application No. 16/022,902, filed on Jun. 29, 2018, now Pat. No. 11,330,944, said application No. 16/900,465 is a continuation of application No. 15/642,781, filed on Jul. 6, 2017, now Pat. No. 10,722,086, said application No. 16/022,902 is a continuation of application No. 15/012,783, filed on Feb. 1, 2016, now Pat. No. 10,548,442, which is a continuation of application No. 14/874,544, filed on Oct. 5, 2015, now Pat. No. 9,826,868, which is a continuation of application No. 13/255,875, filed as application No. PCT/CA2010/000342 on Mar. 6, 2010, now Pat. No. 9,204,769.

(51) Int. Cl.

| | |
|---|---|
| ***A47L 5/28*** | (2006.01) |
| ***A47L 5/32*** | (2006.01) |
| ***A47L 9/02*** | (2006.01) |
| ***A47L 9/10*** | (2006.01) |
| ***A47L 9/16*** | (2006.01) |
| ***A47L 9/32*** | (2006.01) |

(52) U.S. Cl.

CPC ..... *A47L 9/02* (2013.01); *A47L 9/106* (2013.01); *A47L 9/1608* (2013.01); *A47L 9/1666* (2013.01); *A47L 9/1683* (2013.01); *A47L 9/1691* (2013.01); *A47L 9/322* (2013.01)

(56) References Cited

U.S. PATENT DOCUMENTS

| | | | |
|---|---|---|---|
| 6,782,585 | B1 | 8/2004 | Conrad et al. |
| 9,226,633 | B2 | 1/2016 | Conrad et al. |
| 10,478,034 | B2 | 11/2019 | Han et al. |
| 10,765,276 | B2 | 9/2020 | Shinagawa |
| 2003/0037403 | A1 | 2/2003 | Lang |
| 2004/0163201 | A1 | 8/2004 | Murphy et al. |
| 2004/0216264 | A1 | 11/2004 | Shaver et al. |
| 2005/0081321 | A1 | 4/2005 | Milligan et al. |
| 2007/0271724 | A1 | 11/2007 | Hakan et al. |
| 2008/0052872 | A1 | 3/2008 | Cho |
| 2010/0083459 | A1 | 4/2010 | Beskow et al. |
| 2010/0154367 | A1 | 6/2010 | Luo et al. |
| 2016/0113455 | A1 | 4/2016 | Horvath et al. |
| 2019/0174984 | A1 | 6/2019 | Machida et al. |
| 2019/0343356 | A1 | 11/2019 | Kim et al. |
| 2020/0245833 | A1 | 8/2020 | Lee et al. |

FOREIGN PATENT DOCUMENTS

| | | | |
|---|---|---|---|
| WO | 2020108492 | A1 | 6/2020 |
| WO | 2021047263 | A1 | 3/2021 |

OTHER PUBLICATIONS

English machine translation of WO2020108492A1, published on Jun. 4, 2020.

English machine translation of CN108567374A, published on Sep. 25, 2018.

* cited by examiner

SURFACE CLEANING APPARATUS

CROSS-REFERENCE TO RELATED APPLICATION

This application is:

(a) a continuation-in-part of U.S. patent application Ser. No. 17/196,380, filed on Mar. 9, 2021, which is currently pending; which itself is a continuation of co-pending U.S. patent application Ser. No. 15/931,973, filed on May 14, 2020, which is currently pending; which itself is a continuation of U.S. patent application Ser. No. 16/022,902, filed on Jun. 29, 2018, which is currently pending; which itself is a continuation of U.S. patent application Ser. No. 15/012,783, filed on Feb. 1, 2016, issued as U.S. Pat. No. 10,548,442 on Feb. 4, 2020; which itself is a continuation of U.S. patent application Ser. No. 14/874,544, filed on Oct. 5, 2015, issued as U.S. Pat. No. 9,826,868 on Nov. 28, 2017; which itself is a continuation of U.S. patent application Ser. No. 13/255,875, issued as U.S. Pat. No. 9,204,769 on Dec. 8, 2015; which itself was a national phase entry of application PCT/CA2010/000342 filed on Mar. 9, 2010, and said patent application claimed priority from Canadian patent application no. 2,658,372, filed on Mar. 13, 2009, and (b) a continuation-in-part of U.S. patent application Ser. No. 17/342,299 filed on Jun. 8, 2021, which is currently pending; which itself is a continuation of U.S. patent application Ser. No. 16/900,465, filed on Jun. 12, 2020; which itself is a continuation of U.S. patent application Ser. No. 15/642,781, filed Jul. 6, 2017 and issued as U.S. Pat. No. 10,722,086 on Jul. 28, 2020 each of which is incorporated herein by reference in its entirety.

FIELD

This disclosure relates generally to surface cleaning apparatus such as hand vacuum cleaners, upright vacuum cleansers, stick vacuum cleaners or canister vacuum cleaners, and in particular portable surface cleaning apparatus, such as hand vacuum cleaners.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuum cleaners. Further, various designs for cyclonic surface cleaning apparatus, including battery operated cyclonic hand vacuum cleaners are known in the art.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with an aspect of this disclosure, which may be used alone or in combination with any one or more other aspects, a hand vacuum cleaner includes a dirty air inlet provided at a front end of the surface cleaning apparatus. The dirty air inlet at the front end of the surface cleaning apparatus may be the inlet end or nozzle of an inlet conduit or passage. The conduit or passage may be part of the main body. The inlet conduit or passage may have a longitudinally extending axis, and the conduit or passage may be a linear conduit or passage between a dirty air inlet and an outlet port of the cyclone air inlet conduit. The outlet port of the conduit may be rearward of the dirt air inlet (i.e., the conduit may be rearwardly extending). The outlet port may lead to the inlet of an air treatment member, and the inlet of the air treatment member may be at a rear end of the air treatment member.

In accordance with one aspect of this disclosure, which may be used alone or in combination with any one or more other aspects, a hand vacuum cleaner includes an air treatment member provided above the inlet conduit. The air treatment member may comprise the front portion of the surface cleaning apparatus other than the inlet conduit which is located at the lower end of the surface cleaning apparatus. The air treatment member may rest or seat on the inlet conduit (i.e., on an upper side of the inlet conduit) at a forward end of the hand vacuum cleaner, and the air treatment member may be releasably secured to the main body (e.g., the rear end of the air treatment member may be releasably secured to the front end of the main body) and/or the inlet conduit (e.g., the lower side of the air treatment member may be releasably secured to the upper side of the inlet conduit). The air treatment member may seat on the inlet conduit, and may optionally be secured to the inlet conduit at only one end (e.g., the front end or the back end) such as by one latching assembly (i.e., the other end or unsecured portion may rest on the conduit without being secured thereto). An inlet to the air treatment member may be provided at the rear end of the air treatment member, and the inlet may be in fluid communication with a rear end of the conduit.

In accordance with another aspect of this disclosure, which may be used alone or in combination with any one or more other aspects, a hand vacuum cleaner includes an air inlet into the air treatment member which is a tangential air inlet and is in a lower end of the air treatment member, when the upper end of the hand vacuum cleaner is positioned above the lower end of the hand vacuum cleaner (i.e., the 'in use' position). The air inlet may be in fluid communication or direct fluid communication with the inlet conduit, and airflow may enter the air treatment member through the inlet at the lower end in a direction that includes at least a component that is vertical and upwards. The inlet may be at a rear end of the air treatment member and may be mated with an outlet port of the inlet conduit, the inlet conduit extending rearwardly from the front of the hand vacuum cleaner and/or air treatment member.

In accordance with another aspect of this disclosure, which may be used alone or in combination with any one or more other aspects, an air treatment member includes a dirt outlet from an air treatment chamber (e.g., a cyclone chamber) to a dirt collection chamber wherein the dirt outlet is located at an upper end of the air treatment member when the hand vacuum cleaner is in the in use position. Dirt passing through the dirt outlet at the upper end of the air treatment member may fall downwardly inside of the dirt collection chamber to collect (e.g., aggregate) in the lower end of the dirt collection chamber, which may underlie the air treatment chamber. In this manner, the dirt outlet configuration may help improve the dirt separation efficiency of the air treatment member.

In accordance with another aspect of this disclosure, which may be used alone or in combination with any one or more other aspects, the air treatment chamber and the dirt collection chamber are concurrently openable. The chambers may be concurrently openable by opening a single wall or portion of the hand vacuum cleaner and/or a cyclone bin assembly, which may facilitate ease of use for an operator. For example, the front end and/or the rear end of the air treatment assembly may be moved, and the moveable end may include a closure member that closes an end of the dirt collection chamber and a closure member that closes an end of the air treatment chamber. Moving the moveable end may move both the closure of the dirt collection chamber and the closure of the air treatment chamber, thereby enabling the air treatment chamber and the dirt collection chamber to be concurrently emptiable. In some embodiments, the moveable end is a front wall or door of a cyclone bin assembly. In some embodiments, the cyclone bin assembly is removably attached to a main body of the hand vacuum cleaner at a rear end with the front end of the cyclone bin assembly exposed such that the front door or wall may be opened without removing the cyclone bin assembly from the main body.

In accordance with another aspect of this disclosure, which may be used alone or in combination with any one or more other aspects, a door of front portion of an air treatment assembly, which includes an air treatment chamber closure member and a dirt collection chamber closure member, is a stepped door or stepped front portion. For example, if the openable end of the air treatment chamber is positioned axially inwardly from the openable end of the dirt collection chamber, then an openable door may have an axially inner portion (i.e., an air treatment chamber closure member) that closes the openable end of the air treatment chamber wherein the axially inner portion is located inwardly from the portion of the door that closes the dirt collection chamber (i.e., a dirt collection chamber closure member). The openable door may include a transition member between the closure members such that the door does not include a recess or pocket between the closure members (i.e., the dirt collection chamber does not extend behind the air treatment chamber closure member). This may, e.g., prevent dirt from getting stuck between the dirt collection chamber closure member and the air treatment chamber closure member. The transition member may be a step feature, e.g., a generally axially extending wall extending between the closure members. Optionally, the inner surface of the step feature may meet the inner surfaces of each closure member at an angle. Optionally, the angle may be about between 25 and 155°, between 50 and 130°, or about 90°.

In accordance with another aspect of this disclosure, which may be used alone or in combination with any one or more other aspects, a hand vacuum cleaner includes an air treatment assembly which is removeable from the main body of the surface cleaning apparatus. A removable air treatment assembly may include an air treatment chamber and a dirt collection chamber. The removable air treatment assembly may be removeable to facilitate, e.g., cleaning the chambers, emptying the chambers, or cleaning an inlet conduit of the main body which leads to the air treatment chamber. The air treatment member may be removeable with or without a pre-motor filter (e.g., if the hand vacuum cleaning includes a pre-motor filter, the pre-motor filter may be left behind on the main body in some embodiments or the pre-motor filter may be removed with the air treatment assembly in some embodiments). The air treatment member may remove forwardly, downwardly or upwardly. Optionally, the air treatment member removes in a direction that is transverse to a longitudinal axis of the hand vacuum cleaner, a cyclone axis of rotation, a suction motor axis of rotation, and/or an inlet conduit axis. Optionally the transverse direction includes an upward component.

In accordance with another aspect of this disclosure, which may be used alone or in combination with any one or more other aspects, a hand vacuum cleaner includes a main body with a supporting recess into which the air treatment assembly is received when the air treatment assembly is attached to the main body. The recess may improve the stability of the connection between the air treatment assembly and the main body, particularly when the air treatment assembly and the main body are joined (i.e., secured together) by a single latching assembly and/or at a single point. For example, the main body may include spaced-apart sidewalls forming a recess (e.g., a U-shaped recess) between the sidewalls in which to receive the air treatment assembly. The sidewalls may each extend along an exterior surface of the air treatment assembly and abut the exterior surface (e.g., to support the air treatment assembly in a more rigid coupling to the main body). The air treatment assembly may be secured to the main body at a point within the recess, and may be secured to the main body only at one or more points within the recess (i.e., not at any point outside the recess, only, optionally, resting or seating on the main body at points outside the recess). At least 25%, at least 40%, at least 50%, or at least 75% of the outlet port of the inlet conduit may be located within the recess and/or between the sidewalls when the air treatment assembly is attached to the main body.

In accordance with another aspect of this disclosure, which may be used alone or in combination with any one or more other aspects, a hand vacuum cleaner includes a pre-motor filter that is accessible when the air treatment assembly is removed. The pre-motor filter may be inaccessible when the air treatment member is attached to the main body in an operating position of the hand vacuum cleaner. Removing the air treatment assembly may, whether the pre-motor filter is removed with the assembly or remains on the main body, expose the pre-motor filter, render a removeable wall of a housing of the pre-motor filter accessible to be lifted out, or expose an actuator of a latching assembly such that the actuator may be used to release the removeable wall of the housing of the pre-motor filter such that the removable wall may be lifted out. Optionally, removing the cyclone bin assembly exposes latch actuators that were positioned behind walls of a recess of the main body when the cyclone bin assembly is attached to the main body, and the latch actuators may be used to release a removeable wall of the housing of the pre-motor filter. The pre-motor filter may be inspected, cleaned, and/or replaced when the bin assembly is removed.

In accordance with another aspect of this disclosure, which may be used alone or in combination with any one or more other aspects, a hand vacuum cleaner includes a pre-motor filter that has a face (e.g., an upstream face and/or a downstream face) that is relatively large compared to one or more of the other components that define the air flow path. For example, the face may be larger than the largest surface area of the air treatment chamber (e.g., cyclone) in a plane that is perpendicular to a central axis (e.g., a cyclone axis of rotation), the suction motor in a plane that is perpendicular to the motor axis of rotation and/or the surface area of each cross section of the air flow path perpendicular to the air flow direction along the air flow path (i.e., no cross sectional area of the air flow path may be larger than the face of the filter). The pre-motor filter may be positioned facing the rear end of the air treatment chamber, the rear end of the air treatment assembly and/or the front end of the suction motor, and may extend beyond the edges of the facing component such that the pre-motor filter also extends beside adjacent components. A large surface area may reduce back-pressure.

In accordance with another aspect of this disclosure, which may be used alone or in combination with any one or more other aspects, a hand vacuum cleaner includes a pre-motor filter which is a pleated filter media with pleats that extend generally vertically when the hand vacuum cleaner is in use and/or parallel to a longest dimension of the pre-motor filter media. In other words, the upstream surface and/or downstream surface of the pre-motor filter may include pleats (i.e., alternating peaks and valleys formed by generally flat surfaces meeting along edges), and the pleats may be arranged generally parallel to a longest dimension of the pre-motor filter media (e.g., vertically, if the filter is arranged with a longest dimension extending vertically). Pleat orientation may be chosen to facilitate airflow across the surface of the filter.

In accordance with another aspect of this disclosure, which may be used alone or in combination with any one or more other aspects, a hand vacuum cleaner includes a plurality of energy storage members arranged in a pack. The pack may be removeable in a direction parallel to the longitudinal axis, the cyclone axis, the motor axis, and/or the inlet conduit axis. The energy storage member pack may have a longest dimension along a longitudinal axis, and the longitudinal axis may extend generally horizontally such that hand vacuum cleaner may stand on the battery pack. Optionally, the removal direction is along or generally along the longitudinal axis of the energy storage member pack and the removal direction may be a forward direction.

In accordance with another aspect of this disclosure, which may be used alone or in combination with any one or more other aspects, a hand vacuum cleaner includes a pre-motor filter with a face (e.g., the upstream face or the downstream face) that is directed towards an energy storage member and/or energy storage member pack when the filter is in the air flow path. The energy storage member and/or energy storage member pack may include a longest dimension that extends generally parallel to a longest dimension of the pre-motor filter.

In accordance with another aspect of this disclosure, which may be used alone or in combination with any one or more other aspects, a hand vacuum cleaner includes an air flow path that is optionally downstream of a pre-motor filter and extends along a portion of the energy storage members. For example, the air flow path may have a forward portion that is located at a front face of the energy storage members and a portion that extends past the energy storage members or pack between the forward portion of the air flow path and the suction motor. The portion of the air flow path that extends past the energy storage members may pass over the energy storage members or pack and/or around a side thereof. The air flow path above the energy storage members may extend generally rearwardly or downwardly and rearwardly.

In accordance with another aspect of this disclosure, which may be used alone or in combination with any one or more other aspects, a hand vacuum cleaner includes a pistol grip handle. The handle may be oriented generally vertically with a handle axis extending between a first end and a second end, with the handle axis extending generally vertically. Optionally, the upper end of the handle axis may be forward of the lower end of the handle axis. The handle may include a generally vertical hand grip portion (e.g., a portion sized and shaped to permit a user to wrap their hand around). A pistol grip handle may improve hand feel.

In accordance with another aspect of this disclosure, which may be used alone or in combination with any one or more other aspects, a hand vacuum cleaner includes a handle positioned below a suction motor. The handle may be secured at an end (e.g., an upper end, if the handle is oriented generally vertically) of the handle to the suction motor housing, and may be secured to a lower end of the suction motor housing. A finger grip area may be below the suction motor (e.g., a projection of the suction motor generally vertically may pass through the handle and/or a finger grip area forward of the handle). Arranging the handle vertically in line with, and preferably below, the suction motor may improve hand feel.

In accordance with another aspect of this disclosure, which may be used alone or in combination with any one or more other aspects, a hand vacuum cleaner includes a handle that is rearward of components of the apparatus. For example, the handle may be rearward of the air treatment member, the pre-motor filter, and/or the energy storage member. The handle may be below and/or next to components that are heavy (i.e., the suction motor and the energy storage member pack). Optionally, the handle is below the suction motor and the energy storage member pack is at a front end of a finger grip area that is forward of the handle. Lighter components (i.e., the air treatment chamber, the dirt collection chamber, the inlet conduit, and the pre-motor filter) may be farther from the handle than the heavy components, and may be, optionally, forward of the heavy components. A rearward handle may facilitate using a nozzle arranged at a front end of the hand vacuum cleaner.

In accordance with another aspect of this disclosure, which may be used alone or in combination with any one or more other aspects, a hand vacuum cleaner includes a control panel containing one or more toggle (e.g., a button or touchscreen) operable to control the surface cleaning apparatus or a component of the surface cleaning apparatus (e.g., turn on the motor or adjust a setting of the motor). The control panel may be located on a rear external surface of the surface cleaning apparatus and/or on a centre line of the surface cleaning apparatus. The control panel may be positioned on and/or may form a generally planar rear surface of the hand vacuum cleaner. A rear-facing control panel may be easily accessible.

In accordance with another aspect of this disclosure, which may be used alone or in combination with any one or more other aspects, a hand vacuum cleaner includes one or more components that are centrally positioned. The components may be symmetrically positioned about a longitudinally extending (front to rear) horizontal plane (e.g., centered between upper and lower ends of the hand vacuum cleaner), a longitudinally extending vertical plane (e.g., centered between lateral sides of the hand vacuum cleaner), and/or a transversely extending (perpendicular to a front to rear longitudinal axis) vertical plane (e.g., centered between front and rear ends of the hand vacuum cleaner). For example, the pre-motor filter, the air treatment chamber, the dirt collection chamber, the suction motor, the post-motor filter, and/or the handle may be symmetrical about a longitudinally extending vertically centered plane and/or a longitudinally extending horizontally centered plane. Optionally, the pre-motor filter, the air treatment chamber, the suction motor, and the handle are symmetrical about a longitudinally extending vertical centered plane. An inlet to the air treatment chamber may be asymmetrically position with respect to a longitudinally extending horizontally centered plane and/or a longitudinally extending vertically centered plane.

In accordance with another aspect of this disclosure, which may be used alone or in combination with any one or more other aspects, a hand vacuum cleaner includes a vortex finder axially aligned with components of the surface cleaning apparatus. A projection of the vortex finder may intersect one or more, or all, of the suction motor, post-motor filter, dirt collection chamber, pre-motor filter, energy storage member, and/or pack. The vortex finder may be axially aligned with one or more, or all, of the suction motor, a post-motor filter, a dirt collection chamber, a pre-motor filter, and an energy storage member or pack.

In accordance with another aspect of this disclosure, which may be used alone or in combination with any one or more other aspects, a hand vacuum cleaner includes an inlet conduit axially aligned with components of the surface cleaning apparatus. The inlet conduit may be axially aligned with one or more, or all, of the handle, the hand grip area and the energy storage member or pack.

In accordance with another aspect of this disclosure, which may be used alone or in combination with any one or more other aspects, a hand vacuum cleaner includes a central longitudinally extending axis and/or a cyclone axis axially aligned with components of the surface cleaning apparatus. A projection of the central longitudinally extending axis and/or a cyclone axis may intersect one or more, or all, of the dirt collection chamber, the pre-motor filter, the energy storage member, the pack, the finger gap and the handle.

In accordance with another aspect of this disclosure, which may be used alone or in combination with any one or more other aspects, a hand vacuum cleaner includes a power connector for an accessory axially aligned with components of the surface cleaning apparatus. A projection of the power connector along the longitudinal axis, the cyclone axis, the motor axis, and/or the inlet conduit axis may intersect one or more, or all, of the energy storage member or pack, the finger gap, and the handle.

In accordance with another aspect of this disclosure, which may be used alone or in combination with any one or more other aspects, a hand vacuum cleaner includes a lower surface that is generally horizontal (e.g., parallel to the longitudinal axis extending between the front and rear ends of the hand vacuum cleaner) such that the surface cleaning apparatus may stand upright when the lower surface is resting on a horizontally extending environmental surface (e.g., a table or counter). The horizontal surface may be a generally planar surface with a lateral width that is at least 50%, 60%, or 75% of the total width of the hand vacuum cleaner. The suction motor and/or energy storage members may be the heaviest components of the hand vacuum cleaner, and the horizontal surface may extend below the suction motor and/or energy storage members when the hand vacuum cleaner is upright. The lower surface may be only below the suction motor and/or the energy storage members, rather than extending across the entire lower end of the hand vacuum cleaner (e.g., the lower surface of the hand vacuum cleaner below the air treatment chamber and the inlet conduit is not planar and/or horizontally extending). For example, the lower surface may extend below at least 50%, 60% or 75% of the suction motor and the energy storage members.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
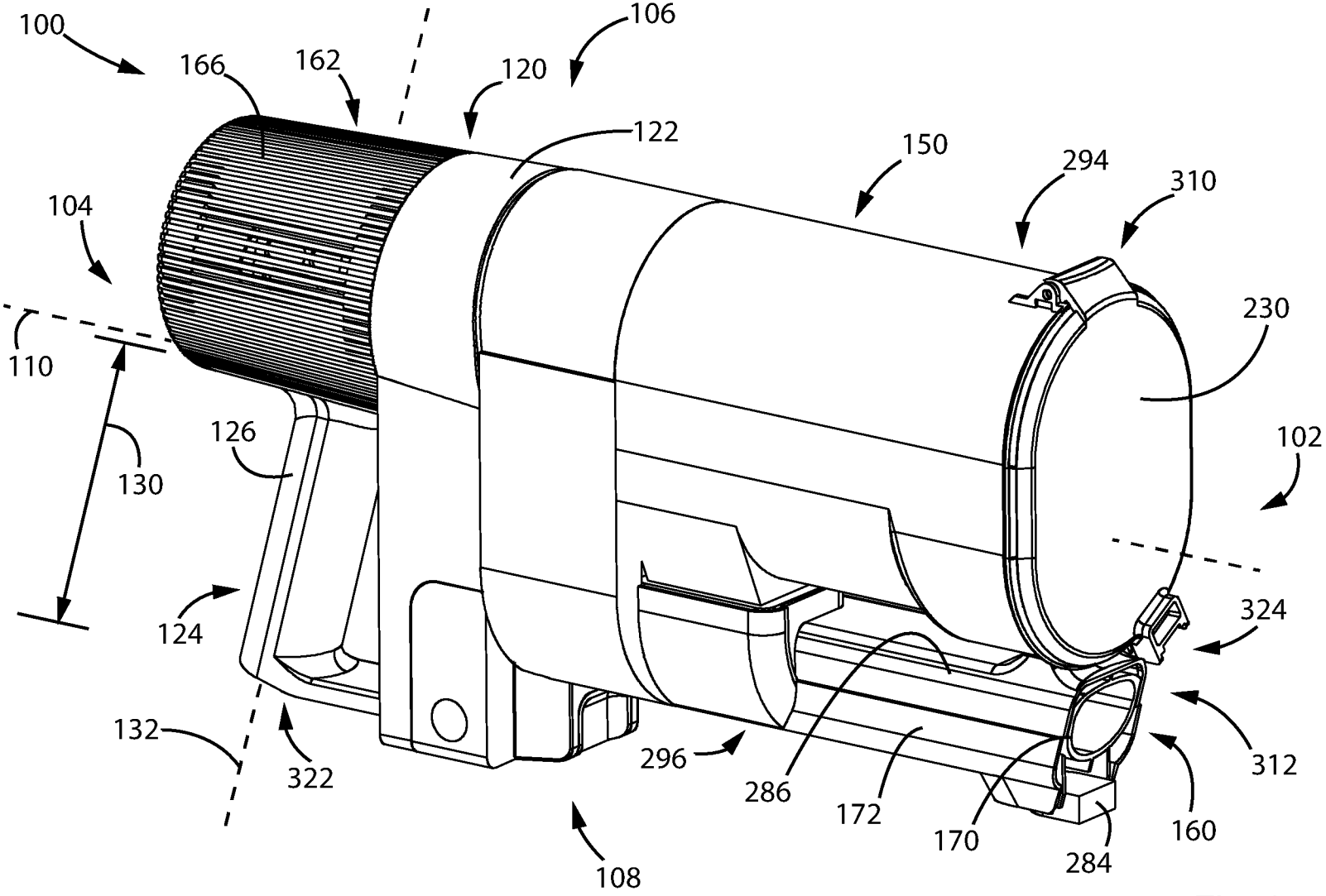
FIG. 1 is a front top perspective view of a first hand vacuum cleaner.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Surface Cleaning Apparatus

Figure 2:
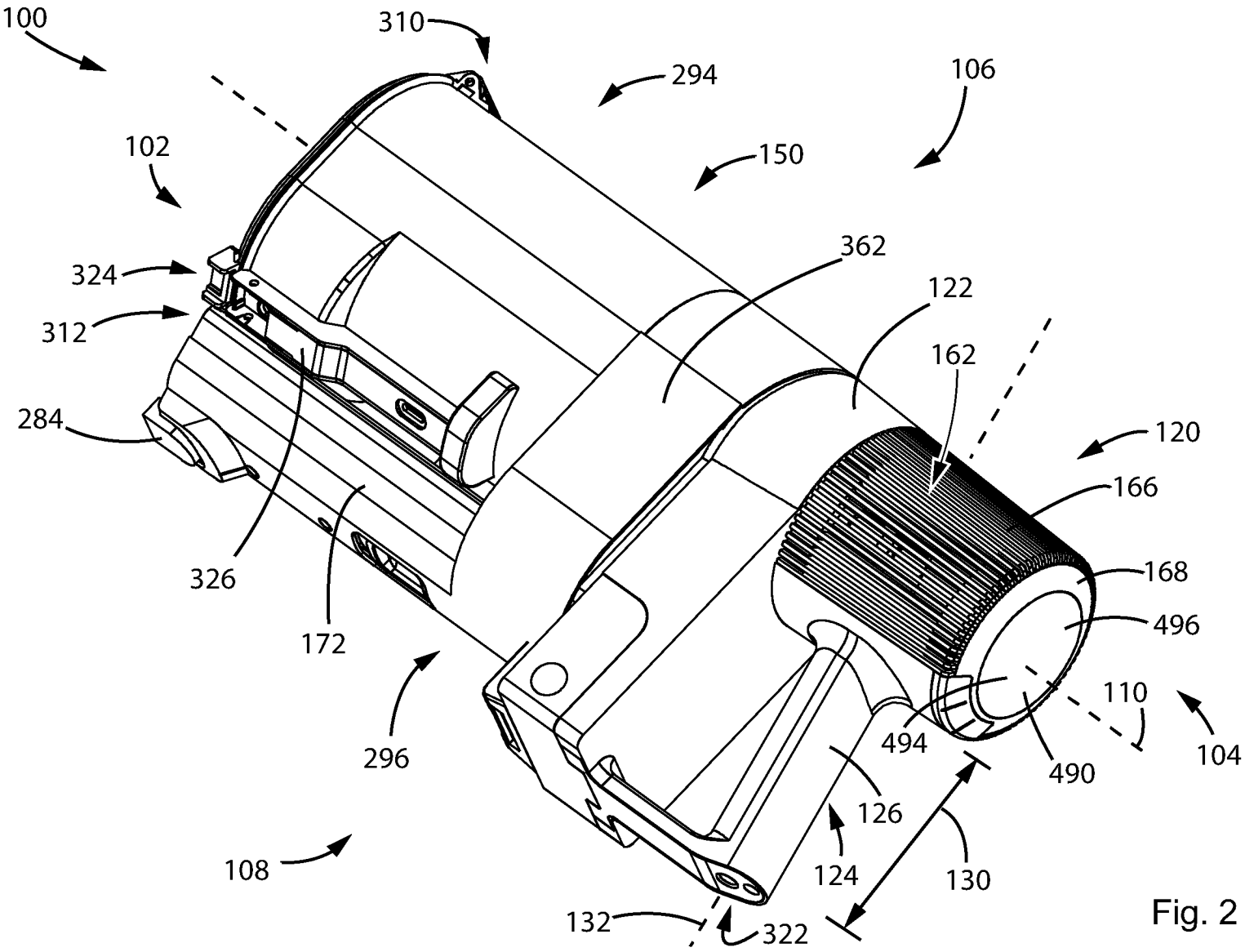
FIG. 2 is a rear bottom perspective view of the hand vacuum cleaner of FIG. 1.

Referring to FIGS. 1 and 2, an exemplary embodiment of a surface cleaning apparatus are shown generally as 100. The illustrated example surface cleaning apparatus is a hand vacuum cleaner, which may also be referred to as a "hand-vac" or "hand-held vacuum cleaner".

As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g., a floor) during use. It will also be appreciated that the hand vacuum cleaner may be mounted to an outlet end of a wand which is pivotally mounted to a surface cleaning head so as to provide a stick type vacuum cleaner.

It will be appreciated that any one or more of the features of the surface cleaning apparatus 100 set out herein may alternately be used in any type of surface cleaning apparatus, such as an upright surface cleaning apparatus, a stick vac, a canister surface cleaning apparatus, an extractor or the like. It will also be appreciated that a surface cleaning apparatus may use any configuration of the operating components and the airflow paths exemplified herein.

As exemplified, the surface cleaning apparatus 100 has a front end 102, a rear end 104, an upper end or top 106 and a lower end or bottom 108 with a longitudinal axis 110 that extends between the front and the rear ends 102, 104.

An air flow path 164 extends from a dirty air inlet 160 provided at a front end of the inlet conduit 172, through an air treatment assembly 150, an optional pre-motor filter 190, a suction motor and fan assembly 180 an optional post motor filter to a clean air outlet 162. In the exemplified embodiments provided herein, the inlet conduit 172 and the air treatment assembly 150 have a height and a central longitudinal axis, which extends between the front end and the rear end of the hand vacuum cleaner, is positioned vertically centrally along the height between an upper and lower end of the inlet conduit 172 and the air treatment assembly 150. Preferably, when the upper end 102 of the surface cleaning apparatus 100 is positioned above the lower end 104, the central longitudinal axis is oriented generally horizontally.

As exemplified in FIG. 1, the clean air outlet 162 may be provided at an upper portion of the rear end 104. The clean air outlet 162 may include a grill located on an upper surface of the surface cleaning apparatus 100. It will be appreciated that the dirty air inlet 160 and/or the clean air outlet 162 may be provided at different locations and/or be of different configurations.

The surface cleaning apparatus 100 includes a main body 120 comprising a housing 122, and a handle 124. As exemplified, the handle 124 may be a pistol grip handle 124 with a hand grip portion 126 that extends generally vertically. The handle 124 has a longest dimension 130 in the direction of handle axis 132. As exemplified in FIG. 4, the handle axis 132 may be generally transverse to the longitudinal axis 110, the cyclone axis 140, the motor axis 142, and the conduit axis 144. It will be appreciated that the housing 122 and/or handle 124 of the surface cleaning apparatus 100 may be in other configurations, shapes, and/or positions in other examples.

Figure 3:
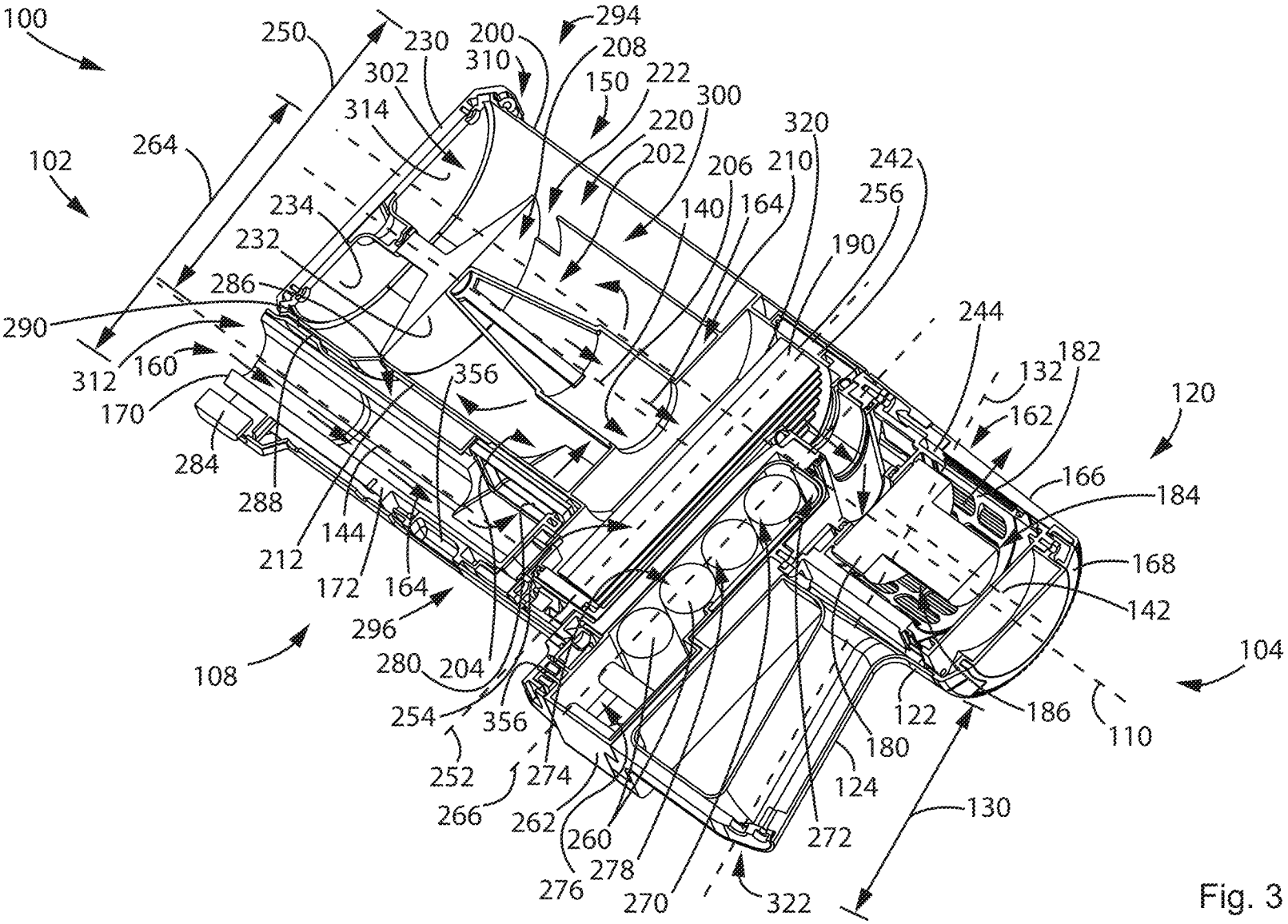
FIG. 3 is a rear bottom cross-sectional perspective view of the hand vacuum cleaner of FIG. 1.
Figure 4:
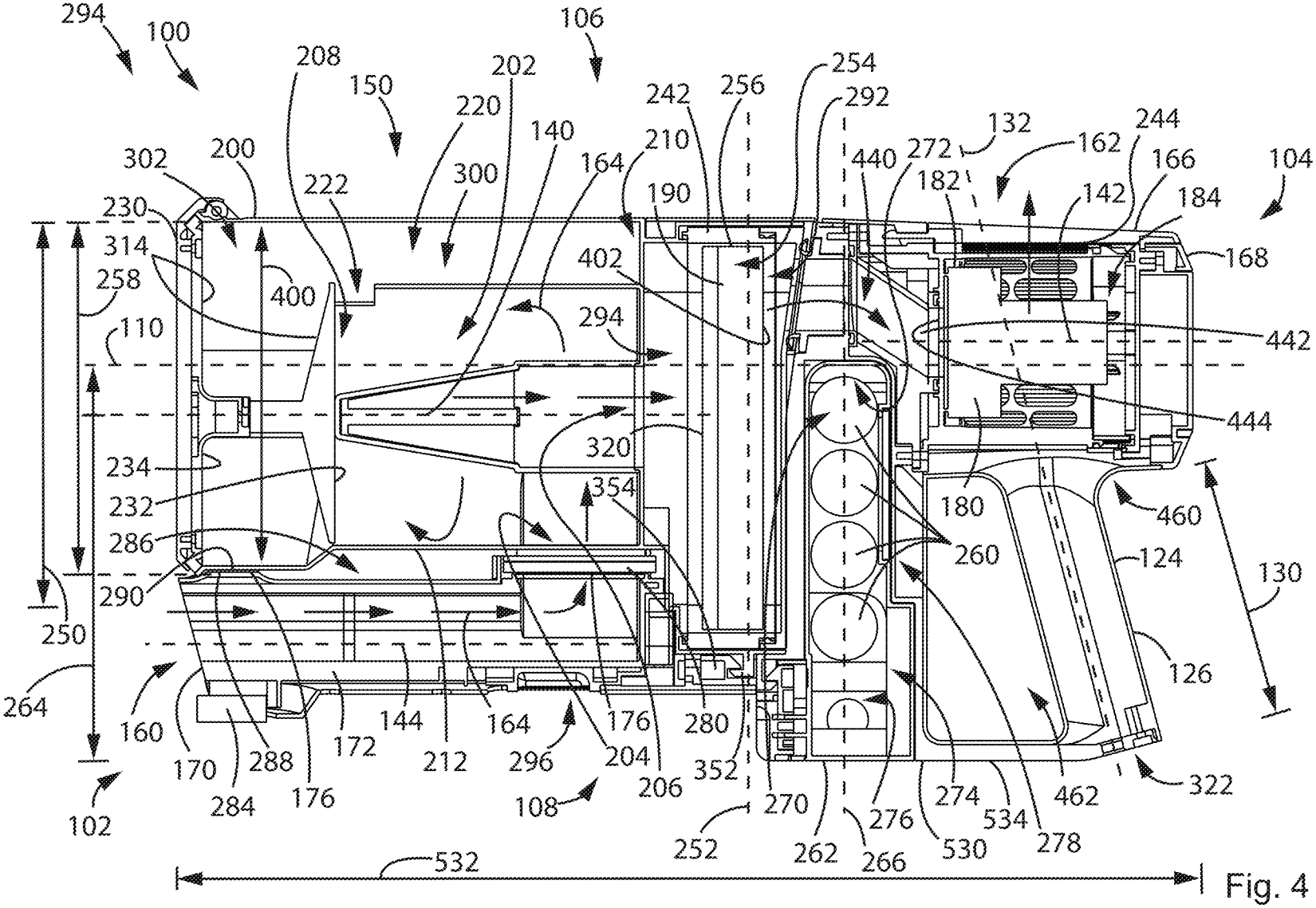
FIG. 4 is a first side cross-sectional view of the hand vacuum cleaner of FIG. 1.

As exemplified in FIGS. 3 and 4, the air treatment assembly 150, which is connected to the main body 120, comprises a single cleaning stage (such as a single cyclonic stage, which may comprise one or more cyclones in parallel, or a single non-cyclonic momentum separator chamber) and, as such, the air treatment assembly 150 may be referred to as an air treatment member 150. The air treatment member may have a single air treatment chamber and an axis 140, which extends between the front and rear ends of the air treatment assembly 150, is centrally located in the air treatment chamber.

As exemplified, the rear end 104 may have a sidewall 166 that extends to a rear face 168 and the clean air outlet 162 may be provided in the sidewall 166.

The dirty air inlet 160 is provided at a front end 102 of the surface cleaning apparatus 100. The dirty air inlet 160 of the surface cleaning apparatus 100 is the inlet end of an inlet conduit or passage 172. The inlet conduit or passage 172 has a longitudinally extending axis 144. The conduit 172 extends between the dirty air inlet 160 and an outlet port 280 of the inlet conduit 172. The outlet port 280 may be located at the inlet port of the air inlet 204 of the air treatment member 150.

Optionally, as exemplified, the air inlet 204 of the air treatment member 150 may be at a rear end 104 of the air treatment member 150. If the air treatment member comprises a cyclone, then the air inlet 204 may be a tangential air inlet. It will be appreciated that any air inlet of an air treatment member may be used. If the air treatment assembly 150 houses more than one air treatment member, then the air inlet 204 may be located in the sidewall of the air treatment assembly 150 at a location between the front and rear end of the air treatment assembly 150. Alternately, an air treatment comber 202 of the air treatment assembly 150 may have an air inlet at the front thereof, in which case the air inlet 204 may be located in the sidewall of the air treatment assembly 150 at the front end of the air treatment assembly 150.

Optionally, the inlet end 170 of the conduit 172 can be used as a nozzle 170 to directly clean a surface. Alternatively, or in addition to functioning as a nozzle 170, inlet conduit 172 may be connectable or directly connectable to the downstream end of any suitable accessory tool such as a rigid air flow conduit (e.g., an above floor cleaning wand), a crevice tool, a mini brush, and the like. Accordingly, a stick vac comprising a floor cleaning head, a rigid air flow conduit that is moveably mounted to the floor cleaning head at an inlet end of the rigid air flow conduit, and the hand vacuum cleaner disclosed herein, may be provided.

The inlet conduit or passage 172 may be, as exemplified in FIGS. 3 and 4, a generally linear conduit or passage 172. The conduit or passage 172 may extend rearwardly from the inlet end 170, and may extend generally parallel to one or more of the longitudinal axis 110, the cyclone axis 140 and the suction motor axis 142. The axis 144 of the conduit 172 may extend between the rear end 104 and the front end 102 of the hand vacuum cleaner, and may extend along a longest dimension of the conduit 172.

An electrical connector 284 may be provided at the front end 102 to provide electricity to the attachment (e.g., the floor cleaning head) from the hand vacuum cleaner 100 (e.g., from an optional on-board energy storage member 260). The electrical connector 284 may be provided adjacent the dirty air inlet 160 (e.g., to be contacted by an electrical connector of the attachment adjacent the air outlet of the attachment). As exemplified, the electrical connector 284 may be directly beside (e.g., below) the dirty air inlet 160. In other words, the electrical connector 284 may be close enough to the inlet 160 to be mated to an electrical connector mounted on a wand that is joined to the inlet 160. For example, the electrical connector may be within 10 cm, 5 cm, or 3 cm of the inlet 160.

As exemplified, the inlet conduit 172 is part of the main body 120 and extends forwardly therefrom. Optionally, as discussed subsequently, the inlet conduit 172 may be provided at a lower portion of the front end 102 and the air treatment assembly 150 may be removably mounted thereto and may be removable in an upward direction. Alternately, the inlet conduit 172 may be provided at an upper portion of the front end 102 and the air treatment assembly 150 may be removably mounted thereto and may be removable in a downward direction. Alternately, as exemplified in the embodiment of FIG. 18, the inlet conduit may be provided on a front face, optionally an openable front face, of the air treatment assembly 150.

An air moving member 180 is also provided to generate vacuum suction through the air flow path 164. The air moving member may include a suction motor and fan assembly 180, which may be referred to as suction motor 180. The suction motor 180 is contained within a suction motor housing 182, and the suction motor housing 182 may form part of the outer surface of the main body housing 122. The suction motor housing 182 may be of any suitable construction, including any of those exemplified herein.

The suction motor 180 in the illustrated example is positioned downstream from the air treatment member 150, although it will be appreciated that the suction motor 180 may be positioned upstream of the air treatment member 150 (e.g., a dirty air motor) in alternative embodiments. As exemplified, the motor 180 may be rearward of the cyclone air treatment assembly 150. The suction motor 180 may be located at the rear end 104 of the hand vacuum cleaner 100, and may be located at the upper end 106 of the hand vacuum cleaner 100. Air may travel rearwardly from the optional pre-motor filter 190 to the suction motor 180, and air flow direction between the air treatment member 150 and the suction motor 180 may have a rearward component at each point along the way.

The suction motor 180 rotates about a central axis of rotation 142. Preferably, when the upper end 106 of the surface cleaning apparatus 100 is positioned above the lower end 108, the motor axis of rotation 142 is oriented generally horizontally and extends between the front end 102 and the rear end 104. In other examples, however, the axis of rotation 142 may extend at any angle to the horizontal, or it may extend vertically. Accordingly, the suction motor 180 may be oriented in any direction within the surface cleaning apparatus 100. The suction motor axis of rotation 142 may be spaced (e.g., vertically spaced) from the longitudinal axis 110 of the surface cleaning apparatus 100 or it may be coaxial therewith.

As exemplified, an upper end 184 of the suction motor 180 may be positioned at the upper end 106 of the hand vacuum cleaner 100 and a lower end 186 of the suction motor 180 may be located adjacent the air treatment chamber axis 140. The suction motor axis of rotation 142 may intersect the pre-motor filter 190, and may intersect the air treatment assembly 150.

The air treatment member 150 is configured to remove particles of dirt and other debris from the airflow and/or otherwise treat the airflow. Any air treatment member or members known in the art may be used. For example, the surface cleaning apparatus may use one or more cyclones, bags, screens, physical filter media (e.g., foam, felt, HEPA) or the like. The air treatment member 150 may comprise one or more cyclonic stages, each of which have one or more cyclones in parallel.

As exemplified in FIGS. 3 and 4, the air treatment member 150 is a cyclone assembly 150 having a single cyclonic cleaning stage 200 with a single cyclone chamber 202. The cyclone chamber 202 includes a cyclone air inlet 204, cyclone air outlet 206, a cyclone front end 208, a cyclone rear end 210 axially spaced from and opposed to the cyclone chamber front end 208, and a sidewall 212 between front and rear ends 208, 210. However, the air treatment member may also be arranged differently. For example, in alternative embodiments, the cyclone assembly 150 may include two or more cyclonic cleaning stages arranged in series with each other. Accordingly, the air treatment chamber axis 140 is a cyclone axis of rotation 140 which extends between a front end 102 and a rear end 104 of the apparatus 100. Each cyclonic cleaning stage may include one or more cyclone chambers 202 that may be arranged in parallel with each other. The cyclone may have an air inlet and an air outlet at the same end of it may be a uniflow cyclone (with the air inlet and the air outlet at axially opposed ends.

As exemplified, the longitudinal axis 110 is parallel to the cyclone axis of rotation 140, and may be coaxial therewith. Preferably, when the upper end 106 of the surface cleaning apparatus 100 is positioned above the lower end 108, the cyclone axis 140 is oriented generally horizontally. In other examples, however, the cyclone axis 140 may extend at any angle to the horizontal, or may extend vertically. Accordingly, the cyclone chamber 202 may be oriented in any direction within the surface cleaning apparatus 100.

As exemplified in FIGS. 3 and 4, the cyclone axis of rotation 140 may be spaced (e.g., vertically spaced) from the longitudinal axis 110 of the surface cleaning apparatus 100, or it may be coaxial therewith. The cyclone axis of rotation 140 may be parallel to and may be spaced from (e.g., vertically spaced from) the suction motor axis of rotation 142. The suction motor axis of rotation 142 may be above the cyclone axis of rotation 140 when the upper end 106 is above the lower end 108 and the cyclone axis of rotation 140 is centrally located in the air treatment chamber 202 and/or air treatment assembly 150.

The air treatment member 150 may include a dirt collection region 220. In the illustrated example, the dirt collection region 220 is external to the cyclone chamber 202 (and may be referred to as a dirt collection chamber 220), although in alternative examples the dirt collection region 220 may be, e.g., a lower portion of the cyclone chamber 202 or it may be an end of the cyclone chamber distal to the air outlet end of the cyclone chamber 202. It will be understood that the cyclone chamber 202 and dirt collection region 220 may be of any configuration suitable for separating dirt from an air stream and collecting the separated dirt, respectively.

As exemplified, the air treatment assembly comprises a cyclone chamber 202 and an exterior dirt collection chamber 220 are in communication via a gap or dirt outlet 222. The dirt outlet 222 may be one or more openings in a wall separating the air treatment chamber 202 and the dirt collection chamber 220. The opening has an outer perimeter defined by the wall in which the dirt outlet is provided or the walls which abut the dirt outlet. Any dirt outlet may be used.

The exemplary dirt outlet 222 is arranged such that dirt and debris—entrained in air flow inside of the cyclone chamber 202—may be ejected (e.g., "spit-out") through the gap and into the dirt collection chamber 220. The dirt outlet 222 may be a gap in the sidewall 212 of the cyclone chamber 202.

If the air treatment assembly 150 includes an air treatment chamber 202 and a dirt collection chamber 220 that is external to the air treatment chamber 202, then the air treatment chamber 202 and the dirt collection chamber 220 may be concurrently openable, such as by opening a wall or portion of each chamber, such as a front end and/or a rear end of the air treatment assembly 150 (e.g., front door 230), thereby enabling the air treatment chamber and the dirt collection chamber to be concurrently emptiable.

In some examples, during an opening or emptying operation, a wall or walls defining a first part of the perimeter of the dirt outlet 222 may be moved relative to a wall or walls defining a second part of the dirt outlet 222 thereby opening the dirt outlet 222. The dirt outlet 222 may be a gap between two or more separable plates or panels. For example, the dirt outlet 222 may be a gap between the sidewall 212 and the front or end wall or closure member 232 of the cyclone chamber 202. In some examples, the end wall 232 of the cyclone chamber 202 and the sidewall 212 may be moved apart (e.g., to open the cyclone chamber 202 and/or dirt collection chamber 220). Separating plates or panels that form the perimeter of the dirt outlet 222 may open up the dirt outlet (e.g., to allow bridging debris to be removed more easily from the dirt outlet 222).

The surface cleaning apparatus 100 may include one or more filters, such as a pre-motor filter 190 in the air flow path upstream of the suction motor 180 (e.g., upstream of the motor 180 and downstream of the air treatment member 150) and/or a post-motor filter 240 in the air flow path downstream of the suction motor 180. The pre-motor filter 190 and the post-motor filter 240 may be formed from any suitable physical, porous filter media and may have any suitable shape, including the examples disclosed herein. For example, the pre-motor filter 190 and/or the post-motor filter 240 may be one or more of a foam filter, felt filter, HEPA filter, other physical filter media, electrostatic filter, and the like.

The pre-motor filter 190 may be provided in a pre-motor filter housing 242. The post-motor filter 240 may be provided in a post-motor filter housing 244 (e.g., closed by the sidewall 166 in which the clean air outlet 162 is provided, and, optionally, overlaying the motor 180). The pre-motor filter housing 242 and the post-motor filter housing 244 may be of any suitable construction, including any of those exemplified herein. The pre-motor filter housing 242 and/or the post-motor filter housing 244 may be openable or accessible to allow the pre-motor filter 190 and/or the post-motor filter 240 to be cleaned and/or replaced.

The pre-motor filter 190 may be provided as part of the air treatment assembly 150 and removable therewith (see for example FIG. 7), or the pre-motor filter 190 may be part of the front end of the main body and not removeable as part of the air treatment assembly. The pre-motor filter 190 may come in any suitable shape or location, however, as exemplified, the pre-motor filter 190 may have a longest dimension 250 in a longitudinal (vertical) direction or axis 252 of the pre-motor filter 190. The pre-motor filter longitudinal axis 252 may be generally transverse to the apparatus longitudinal axis 110, the cyclone axis 140, the motor axis 142, and/or the conduit axis 144.

The axis 142 of the suction motor 180 may extend through a volume 254 defined by the outer perimeter 256 of the pre-motor filter 190 and/or through the pre-motor filter housing 242, and may extend through a portion of the pre-motor filter 190. In some examples, the pre-motor filter 190 has a vertical length in a vertical plane that is greater than a vertical length of the suction motor 180 in a vertical plane. A greater length may allow for a greater surface area (e.g., to allow for greater air flow/less backpressure).

As exemplified, power may be supplied to the surface cleaning apparatus 100 (e.g., to components or elements such as the suction motor 180) from an on-board energy storage member 260 (e.g., a capacitor or battery). For example, the on-board energy storage member 260 may be a battery or, as exemplified, a plurality of batteries. The on-board energy storage member 260 may be provided in a pack 262 (e.g., a removeable pack). The pack 262 may be a battery pack.

As exemplified, the energy storage member pack 262 may have a longest dimension 264 along a longitudinal direction or axis 266 of the pack 262. The axis 266 of the pack 262 may be generally transverse 110 (see for example FIG. 2) or parallel (see for example FIG. 18) to the longitudinal axis, the cyclone axis 140, the motor axis 142, and/or the air inlet conduit axis 144. However, it will be apricated that the on-board energy storage member 260 and/or pack 262 may be provided at any configuration and/or location in the surface cleaning apparatus 100.

In some embodiments, the plurality of energy storage members 260 and/or pack 262 has a first portion 270 at the first end 272, a second portion 274 at the second end 276 and a middle portion 278 positioned between the first and second portions 270, 274. The middle portion 278 may comprises 20%, 30% or 40% of the length 264 of the plurality of energy storage members 260.

It will be appreciated that in some examples, the surface cleaning apparatus 100 may alternatively or additionally include a power cord to supply power to the components of the surface cleaning apparatus 100 (e.g., the motor 180) directly, and/or to supply power to the on-board energy storage member 260 (e.g., a capacitor or battery) to supply power to powered components (e.g., the motor 180).

Air Treatment Member Above the Inlet Conduit

The following is a description of a positioning of the air treatment member 150 above the inlet conduit 172, which may be used by itself or in combination with one or more of the front inlet, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, as exemplified in FIGS. 1-4, the air treatment member 150 is provided above the inlet conduit 172 and is optionally removably mounted from a position above the inlet conduit 172. As exemplified, the inlet conduit 172 is located at the lower end 108 of the surface cleaning apparatus 100 and the air treatment member 150 is located at an upper end 106 of the surface cleaning apparatus 100 and overlies the air inlet 172 and may be located on the upper end 286 of the inlet conduit 172. Accordingly, the front end of the surface cleaning apparatus consists of the air treatment member 150 and the inlet conduit 172. Together, the air treatment member 150 and the inlet conduit 172 define the vertical height of the front end of the surface cleaning apparatus 100.

Optionally, the front end 294 of the air treatment member 150 may not extend beyond the inlet conduit 172 and may be located at the dirty air inlet 160 (e.g., to facilitate use of the dirty air inlet 160 as part of the nozzle 170). Optionally, the front end 294 of the air treatment member 150 may be located rearward of the dirty air inlet 160.

As exemplified in FIG. 4, the air treatment assembly 150 is seated on the inlet conduit 172, with a lower surface 288 of the air treatment assembly 150 resting on an upper surface 290 of the inlet conduit 172. Optionally, the air treatment assembly 150 may seat on the inlet conduit 172 at two or more points on the inlet conduit 172 (e.g., two or more points 176 on an upper surface of the inlet conduit—see FIG. 4) or along the entire length of the air treatment member 150 that overlies the air inlet 172. The lower surface 288 may abut but not be secured to the upper surface 290, e.g., if the rear end 104 of the air treatment member 150 is secured to the main body. Alternately, the air treatment member 150 may be secured to the upper surface 290 and optionally also to the main body. If the air treatment member 150 is removeable, then a releasable latch may be provided to releasably secure the air treatment member 150 to the air inlet 172 and/or the main body.

The air inlet of the air treatment assembly 150 may be located at its rear end 104. Accordingly, the air inlet conduit 172 may extend to the rear end of the air treatment assembly 150. If the air treatment assembly includes more than one air treatment member (e.g., an air treatment chamber 202 and a pre-motor filter 190 which is rearward of the air treatment chamber 202), and the air inlet 204 to the air treatment chamber 202 is located at a rear end of the air treatment chamber 202, then the air inlet conduit 172 may extend to the location of the air inlet 204 (with the outlet port 280 aligned with an inlet port of the air inlet 204) and the rear end 104 of the air treatment assembly 150 may extend rearwardly beyond the inlet conduit 172. Accordingly, the portion of the air treatment assembly 150 that extends rearwardly beyond the inlet conduit 172 may contain a component that is different from a component above the inlet conduit 172. For example, the air treatment chamber 202 may be above the inlet conduit 172, and a downstream air treatment member (e.g., the pre-motor filter 190, as exemplified and/or a second cyclonic stage) may be located in the portion of the air treatment assembly 150 that extends rearwardly of the inlet conduit 172.

As exemplified, the inlet conduit 172 may be a generally linear conduit from the dirty air inlet 160 for at least 75%, 80%, 90% or all of the air flow path 164 between the dirty air inlet 160 and the outlet port 280. The outlet port 280 may open through an upper wall of the inlet conduit 172, as exemplified. The outlet port 280 may face a direction that is at least 45°, at least 60°, or about 90° from the direction in which the dirty air inlet 160 faces.

It will be appreciated that if the air treatment chamber 202 is a cyclone chamber, then the air inlet 204 may be a tangential air inlet 204 and the inlet port of the tangential air inlet 204 may abut the outlet port 280 of the air inlet conduit 172. If the air treatment assembly 150 is removable, then a gasket or other sealing member may be provided on one or both of the inlet port of the tangential air inlet 204 and the outlet port 280 of the air inlet conduit 172. If the air inlet conduit 172 underlies that air treatment assembly, then the air inlet 204 may be provided in a bottom surface of the air treatment assembly 150, as exemplified in FIG. 3.

Optionally, the air treatment chamber 202 may have a rear wall or end 210 that is above or generally above the rearward end of the inlet conduit 172. The rear wall or end 210 of the air treatment chamber 202 may extend generally parallel to the direction of air entering the air treatment chamber 202 at the end 210 and/or perpendicular to the direction of air at the inlet end of the inlet conduit 172.

As exemplified in FIG. 4 and as discussed subsequently, the pre-motor filter 190 may be provided in the portion of the air treatment assembly 150 that extends rearward of the rear end 296 of the inlet conduit 172. The portion of the air treatment assembly 150 that extends beyond the inlet conduit 172 may have a larger cross sectional area (e.g., area in a plane perpendicular to the longitudinal axis 110 and/or the conduit axis 144) than the area of portion of the air treatment assembly 150 above the inlet conduit 172 (e.g., because the assembly 150 can extend further downward at a position rearward of the inlet conduit 172). This may allow the rearward component of the assembly 150 (e.g., the pre-motor filter 190) to have a greater size, such as a greater height, than would be available above the inlet conduit 172 (i.e., without increasing the overall height of the apparatus 100).

According to this aspect, the inlet conduit 172 may extend rearwardly below the air treatment chamber 202 to provide airflow to the air treatment chamber 202 at the rear end 210 of the air treatment chamber 202. The air treatment assembly may have a rearwardly positioned air outlet that is aligned with an air inlet of the main housing and may be aligned with the air inlet of the suction motor 180. A rear end of the air treatment assembly 150 may toe into a recess in the main body or, as discussed subsequently, be removably receivable in a generally U-shaped recess provided at a front end of the motor housing portion of the main body.

Dirt Collection Forward of Cyclone Chamber

The following is a description of a dirt collection chamber 220 that is forward of the cyclone chamber 202, which may be used by itself or in combination with one or more of the air treatment member being positioned above inlet conduit, lower tangential inlet to air treatment member, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, when the upper end 106 of the hand vacuum cleaner 100 is positioned above the lower end 108 of the hand vacuum cleaner 100 with the dirty air inlet 160 at a front end 102 and a clean air outlet 162 at a rear end 104, all of a portion of the dirt collection chamber 220 is forward of the air treatment chamber 202. Optionally at least 50%, 60%, or 70% of the volume of the dirt collection chamber 220 is positioned forward of the air treatment chamber 202. A portion of the dirt collection chamber 220 may also or alternatively be to one side (e.g., above, below and/or to a lateral side) of the air treatment chamber 202 (e.g., radially outside the air treatment chamber 202 on at least one side, with a sidewall of the air treatment chamber 202 forming an inner wall of the dirt collection chamber 220).

Figure 14:
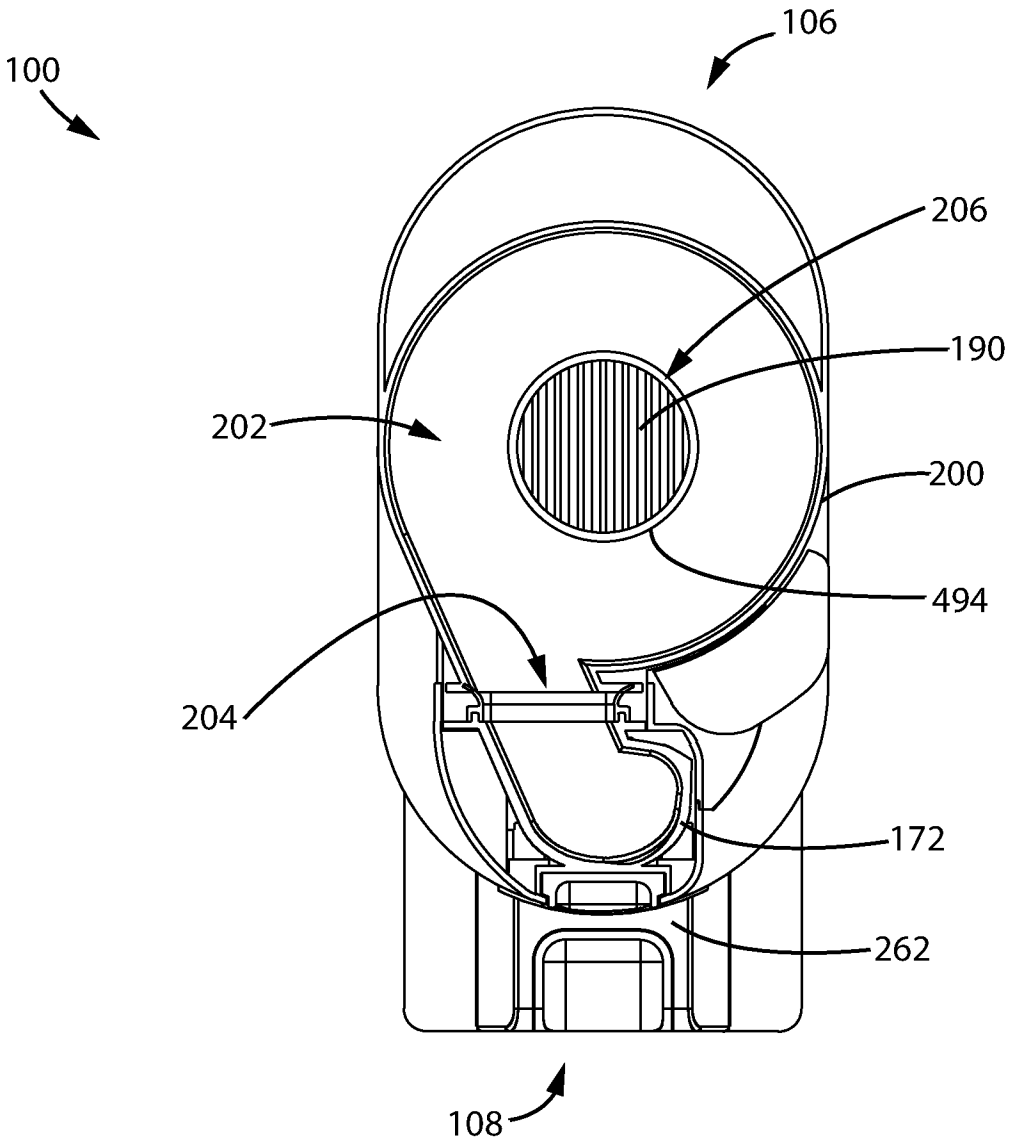
FIG. 14 is a front cross-sectional view of the hand vacuum cleaner of FIG. 1.
Figure 15:
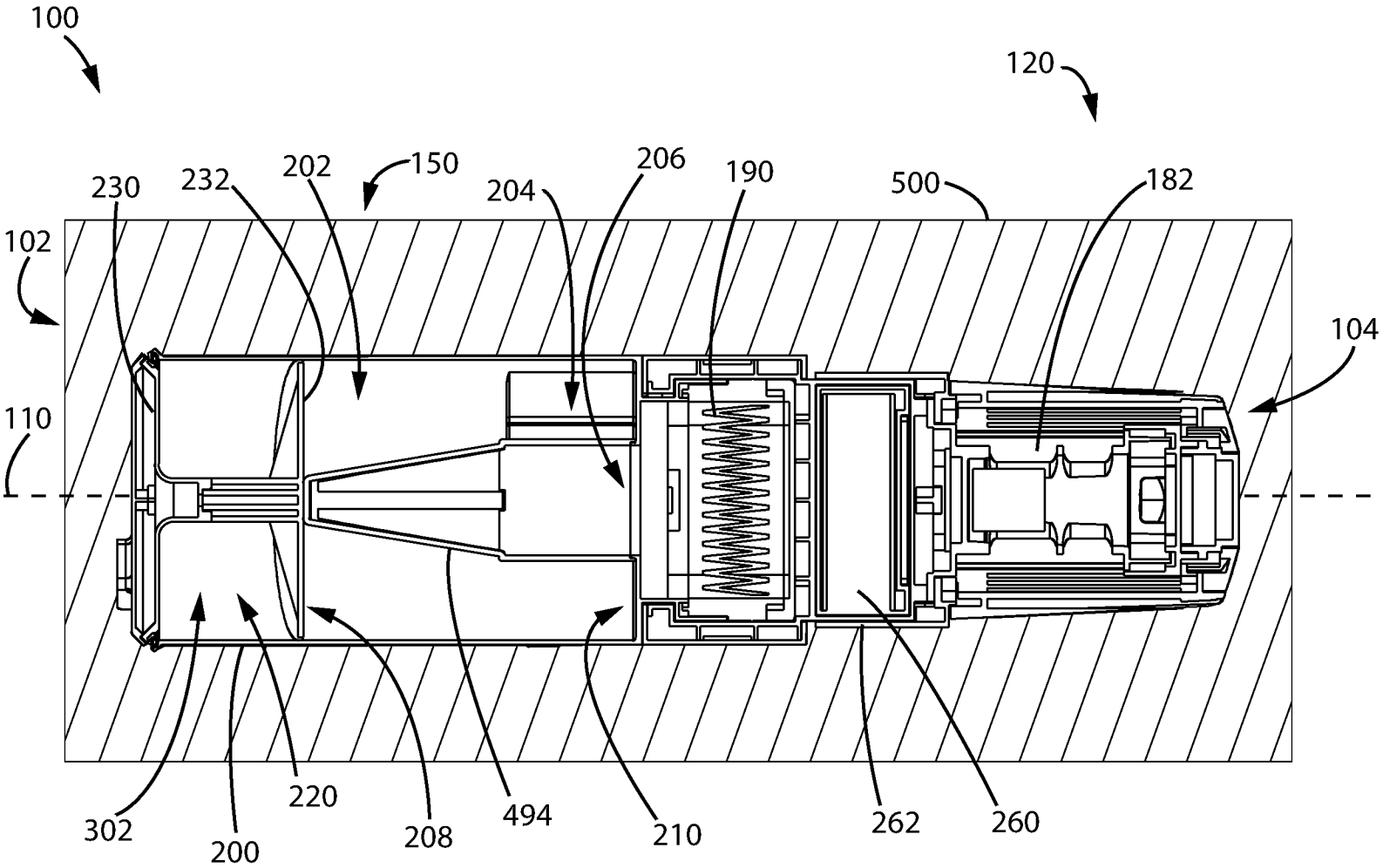
FIG. 15 is a first top cross-sectional view of the hand vacuum cleaner of FIG. 1.
Figure 16:
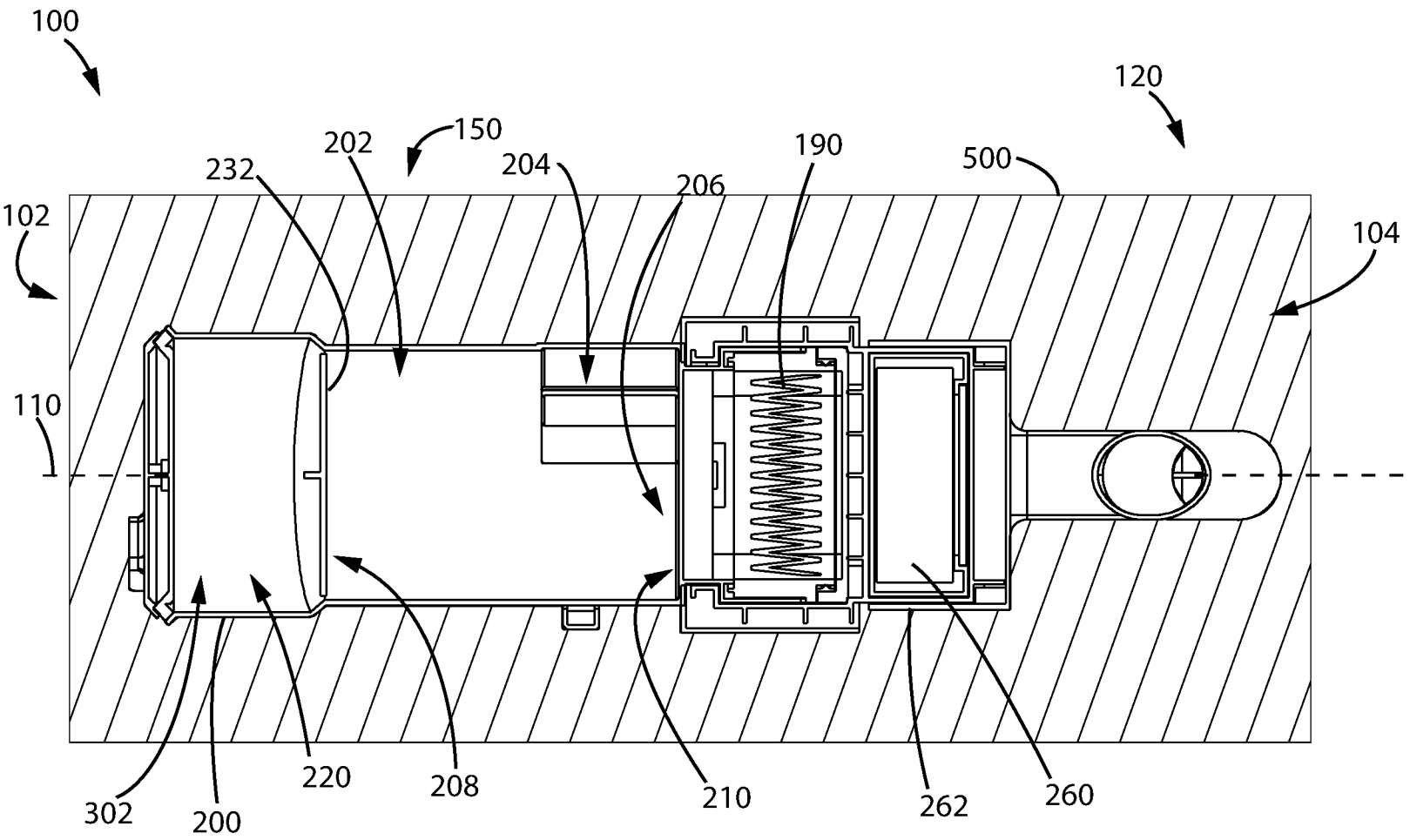
FIG. 16 is a second top cross-sectional view of the hand vacuum cleaner of FIG. 1.
Figure 17:
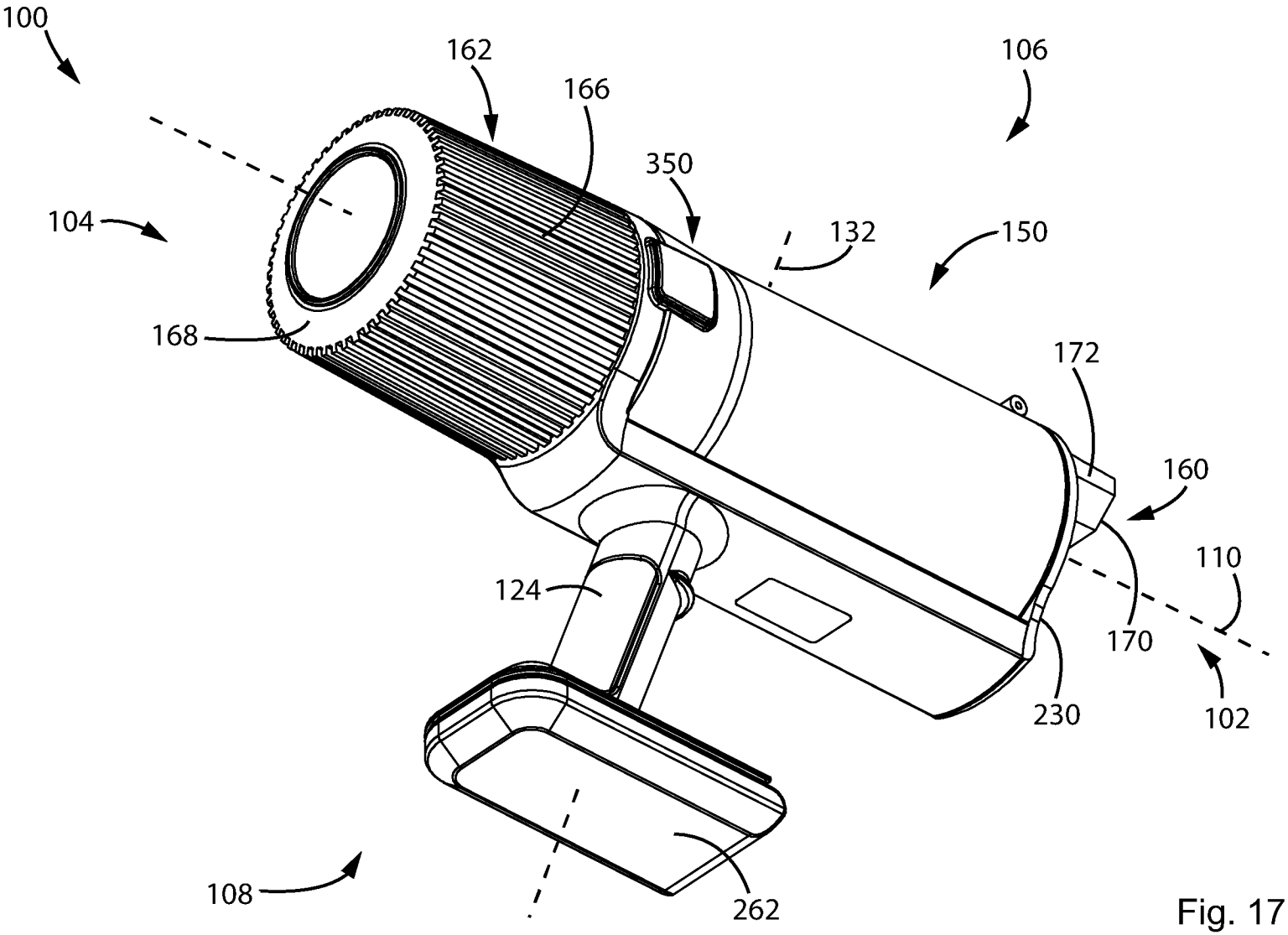
FIG. 17 is a rear bottom perspective view of a second hand vacuum cleaner.

As exemplified in FIGS. 3 and 4, the dirt collection chamber 220 includes a main portion forward of the air treatment chamber 202, and optionally another portion above the air treatment chamber 202. Accordingly, at least 50%, at least 75% or at least 80% of the dirt collection chamber 220 may be forward of the air treatment chamber 202. All or a portion of the remainder may be above the air treatment chamber 202 (see, e.g., FIGS. 14-16) and/or below the air treatment chamber 202.

Positioning the dirt collection chamber 220 only forward of the air treatment chamber 202 and/or above or below the air treatment chamber 202 above the cyclone chamber 202, rather than below or to a lateral side) may help reduce the overall width of the surface cleaning apparatus 100.

As discussed subsequently, the front end 230 of the dirt collection chamber 220 may be openable (e.g., to empty the dirt out of the dirt collection chamber 220). The openable end 230 may also include a closure member 232 closing the air treatment chamber 202, such that opening the end 230 to empty the dirt collection chamber 220 also opens the air treatment chamber 202.

Upper Dirt Outlet

The following is a description of an upper dirt outlet, which may be used by itself or in combination with one or more of the air treatment member being positioned above inlet conduit, lower tangential inlet to air treatment member, dirt collection forward of cyclone chamber, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, all or a majority of the dirt outlet 222 is provided at an upper end of the dirt collection chamber 220 (when the surface cleaning apparatus is in an in use position—e.g., the upper end 106 is above the lower end 108). Dirt may fall downwardly inside the dirt collection chamber 220 to collect (e.g., aggregate) in the lower end of the dirt collection chamber 220. In this manner, the dirt outlet 222 configuration may help improve the dirt separation efficiency of the air treatment member.

The dirt outlet 222 may be sized to facilitate movement of dirt between the chambers 220, 202 (e.g., the dirt outlet may have a cross-sectional area of at least 1 sq. cm, at least 2 sq. cm, or at least 5 sq. cm).

The dirt outlet 222 may be at an end of the air treatment chamber 202 (i.e., within 10% or 20% of the total length of the air treatment chamber 202 from an end of the air treatment chamber). As exemplified in FIGS. 4 and 18, the dirt outlet 222 is at the front end of the air treatment chamber 202.

The dirt outlet 222 may optionally be provided at an opposite end of air treatment chamber 202 from the air outlet 206 of the air treatment chamber 202. As exemplified in FIG. 4, the air treatment chamber 202 may have an air inlet 204 and an air outlet 206 at a common end (e.g., the rear end 210), and the dirt outlet 222 may be provided at the opposite end (e.g., the front end 208). As exemplified in FIG. 18, the air treatment chamber 202 may have an air outlet 206 at the rear end 210 and the air inlet 204 and the dirt outlet 222 may be provided at the front end 208. However, it will be understood that the air inlet 204, the air outlet 206 and the dirt outlet 222 may be of any suitable size, shape, and/or location.

The exemplified dirt outlet 222 is an opening in a direction parallel to the cyclone axis of rotation (e.g., to assist in ejecting debris). The air flow within the air treatment chamber 202 may be generally circular, with the dirt outlet 222 provided along the edge of the air flow trajectory. The dirt outlet 222 may be, as exemplified in FIG. 4, a circumferentially extending slot in the sidewall 212. A direction of airflow through the dirt outlet 222 may be generally transverse to the axis 140 of the air treatment chamber 202. The direction of dirt exiting through the dirt outlet 222 may include a generally upward vertical component (see FIG. 4) or a generally downward component (see FIG. 18).

The dirt outlet 222 may open into a portion of the dirt collection chamber 220 that is radially positioned from the air treatment chamber 202. The exemplified in FIG. 4, the dirt collection chamber 220 includes a first portion 300 that is radially outward of the cyclone chamber 202 (e.g., wherein a sidewall 212 of the cyclone chamber 202 forms an inner wall of the portion 300) and a second portion 302 that is forward of the cyclone chamber 202. The dirt outlet 222 opens into the first portion 300, and the first portion 300 may be smaller than the second portion 302. The first portion 300 may be less than 60%, less than 70%, or less than 80% of the volume of the second portion 302.

As exemplified, the first portion 300 may extend rearwardly from the second portion 302 and may extend to a rear end of the air treatment chamber 202. The forward end of the first portion 300 may face the openable door 230 such that the first portion 300 may empty directly through the second portion 302 and out the opening created by opening the door 230.

The first portion 300 may extend from the second portion 302 generally linearly (e.g., to prevent debris from being caught when emptying).

While one dirt outlet 222 is exemplified, in some examples the air treatment chamber 202 may further comprise one or more additional dirt outlets. For example, when the upper end 106 of the hand vacuum cleaner 100 is positioned above the lower end 108 of the hand vacuum cleaner 100, an additional dirt outlet located at a lower end of the air treatment chamber 202 and/or in an end wall.

Concurrently Openable Cyclone and Dirt collection chamber

The following is a description of an openable door to the cyclone chamber and the dirt collection chamber, which may be used by itself or in combination with one or more of the air treatment member being positioned above inlet conduit, lower tangential inlet to air treatment member, dirt collection forward of cyclone chamber, upper dirt outlet, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the air treatment chamber 202 and the dirt collection chamber 220 are concurrently openable, such as by opening a first wall or portion of each chamber, which may be a single wall or portion. For example, the front end and/or the rear end of the air treatment assembly 150 may be moved and the front end and/or rear end may include a dirt collection chamber closure member 234 and a treatment chamber closure member 232, thereby enabling the air treatment chamber and the dirt collection chamber to be concurrently emptiable. This aspect may be used by itself or in combination with one or more other aspects of this disclosure.

As exemplified in FIG. 4, the front wall 230 of the cyclone air treatment assembly 150 may be openable, and may include both a dirt collection chamber front wall or dirt collection chamber closure member 234 of the dirt collection chamber 220 and an air treatment chamber front wall or treatment chamber closure member 232 of the air treatment chamber 202.

The closure members 232, 234 may be spaced from one another. For example, the front of the air treatment chamber 202 may be axially spaced from or recessed within the front end of the dirt collection chamber 220. As exemplified in FIGS. 4 and 18, the closure members 232, 234 generally parallel to one another. Optionally, the dirt collection chamber closure member 234 may be positioned behind the treatment chamber closure member 232 (see for example FIG. 4 wherein the dirt collection chamber 220 extends between the closure members 232, 234). Alternately, the dirt collection chamber closure members 234 may not be positioned behind the treatment chamber closure member 232, e.g., if the dirt collection chamber does not include an area between the air treatment member closure member 232 and the front wall of the air treatment assembly 150. For example, in FIG. 18, the closure members 232, 234 extend in the same plane and comprise different portions of a planar door. Alternately, in FIGS. 26 and 27, the treatment chamber closure member 232 is positioned axially forwardly of the dirt collection chamber closure members 234 but the dirt collection chamber 220 does not include a portion axially aligned with the air treatment chamber 202.

The openable end or door 230 may be openable (e.g., pivotally or removeable) in any suitable way. As exemplified in FIGS. 3 to 6, the front end 102 may have a first side 310 that is rotationally mounted to the air treatment assembly 150 and a vertically opposed side 312 that is releasably securable to the air treatment assembly 150. In the illustrated example of FIG. 1, the opposed side 312 is releasably secured to the air treatment assembly 150 by a latching assembly 324.

The door 230 may be openable in a way that does not impede emptying of dirt through the opening governed by the door 230. For example, the rationally mounted side 310 may be an upper side of the door or end 230, such that the door 310 swings upwardly when opened (e.g., to facilitate emptying downward). As exemplified, when the front end 230 is in a closed position, the radially outward portion 322 of the handle 124 and the vertically opposed side 312 of the front end 230 may be located on a common end (e.g., the lower end 108) of the hand vacuum cleaner 100 (e.g., to facilitate emptying the apparatus in the direction of the radially outward portion 322 of the handle 124). As exemplified, when the front end 230 is closed, the vertically opposed side 312 (e.g., the lower side) may be adjacent the inlet port of the inlet conduit 172, which may assist in emptying the air treatment assembly without dirt fall on the inlet conduit 172.

Figure 6:
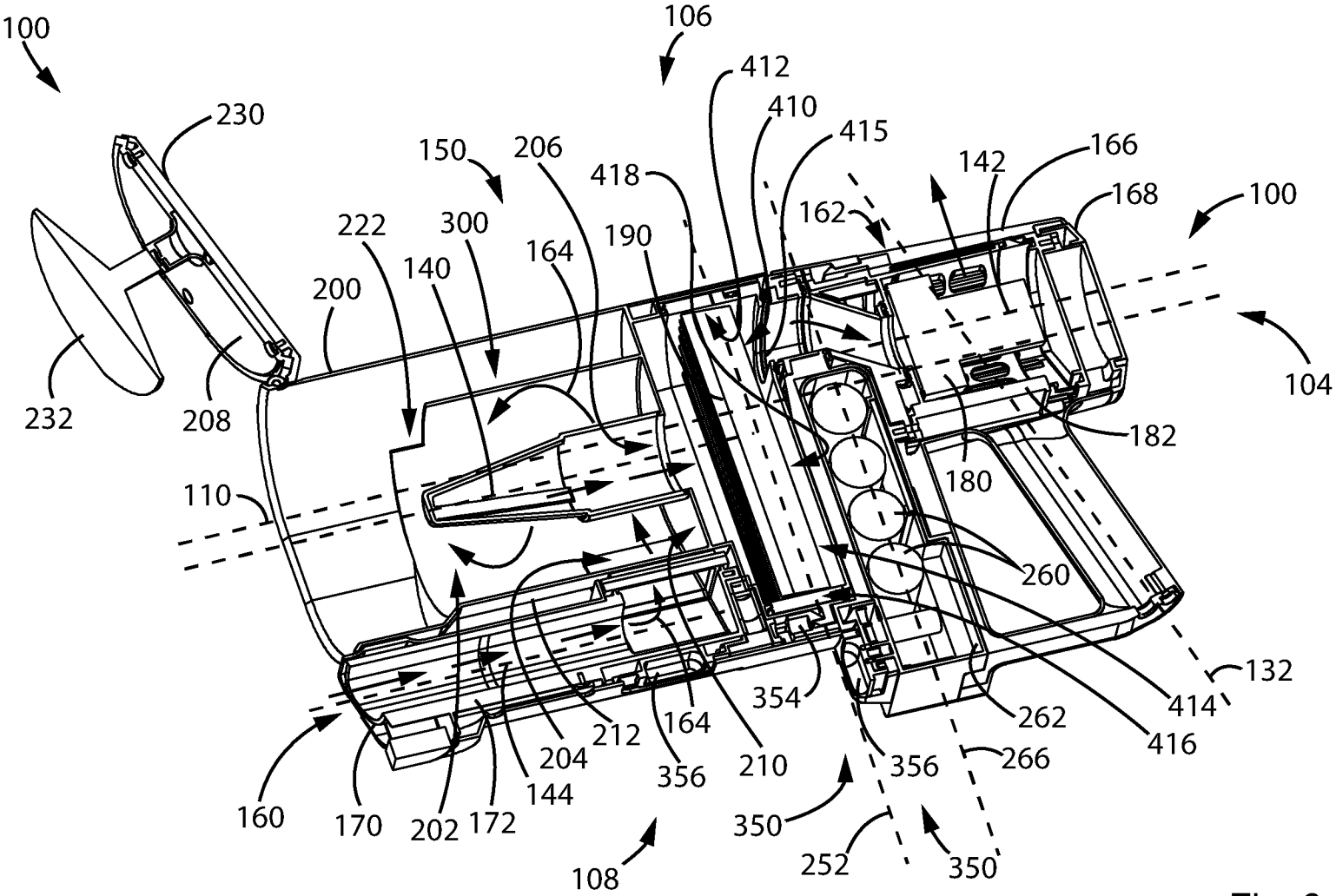
FIG. 6 is a front bottom cross-sectional perspective view of the hand vacuum cleaner of FIG. 1.

In some examples, as exemplified in FIG. 6, the openable front end 230 is openable in the absence of moving the air treatment member 150 with respect to the inlet conduit 172 (e.g., to allow a user to empty dirt without detaching the assembly 150). The door 230 may be openable when the air treatment assembly 150 is secured to the main body 120, such as by having the rotationally mounted end 310 at an upper end and clearance between the opposed end 312 and the conduit 172 (e.g., to allow the opposed end 312 to swing past the conduit 172). The latching assembly 324 may be, as exemplified in FIGS. 1 and 2, securing the opposing end 312 at a position off-center (i.e., to one side of an axially vertical plane that is centered between the lateral sides of the apparatus 100). The latching assembly 324 may be positioned outside the vertically central 5%, 10% or 15% of the front face of the door 230. Optionally, as exemplified in FIG. 2, the actuator 326 of the latch assembly 324 (i.e., operable to release the latch assembly 324) is located rearward of the front face and to one lateral side. Sliding the latch actuator 326 releases the latch thereby enabling the door 230 to open. The latch actuator 326 may be biased, e.g., by a spring to the closed position. Therefore, closing the door may result in the latch assembly 324 locking the door 230 in the closed position.

Optionally, the size of the dirt outlet 222 is increased by opening the door 230. As exemplified in FIG. 4, the dirt outlet 222 may have a forward side defined by the door 230 (i.e., the cyclone chamber front end 232) and a rearward side defined by the sidewall 212 and, when the front end 230 of the cyclone unit is opened, the forward side of the slot 222 is moved relative to the rearward side of the slot 222 whereby the slot 222 is opened (e.g., to facilitate removal of bridging debris).

Stepped Door

The following is a description of a stepped door, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, a door or openable end includes an air treatment chamber closure member 232 and a dirt collection chamber closure member 234 wherein air treatment chamber closure member 232 is positioned inwards of the dirt collection chamber closure member 234 and the dirt collection chamber closure member 234 does not include a portion axially aligned with the air treatment chamber closure member 232. Accordingly, a transition wall may extend axially or generally axially between the closure members 232, 234. In such an embodiment, the air treatment chamber 202 may be located partially or fully radially inwardly of the dirt collection chamber 220 and the opening of the air treatment chamber 202 that is closed by the closure member 232 is spaced axially inwardly from the opening of the dirt collection chamber 220 that is closed by the closure member 234.

Figure 26:
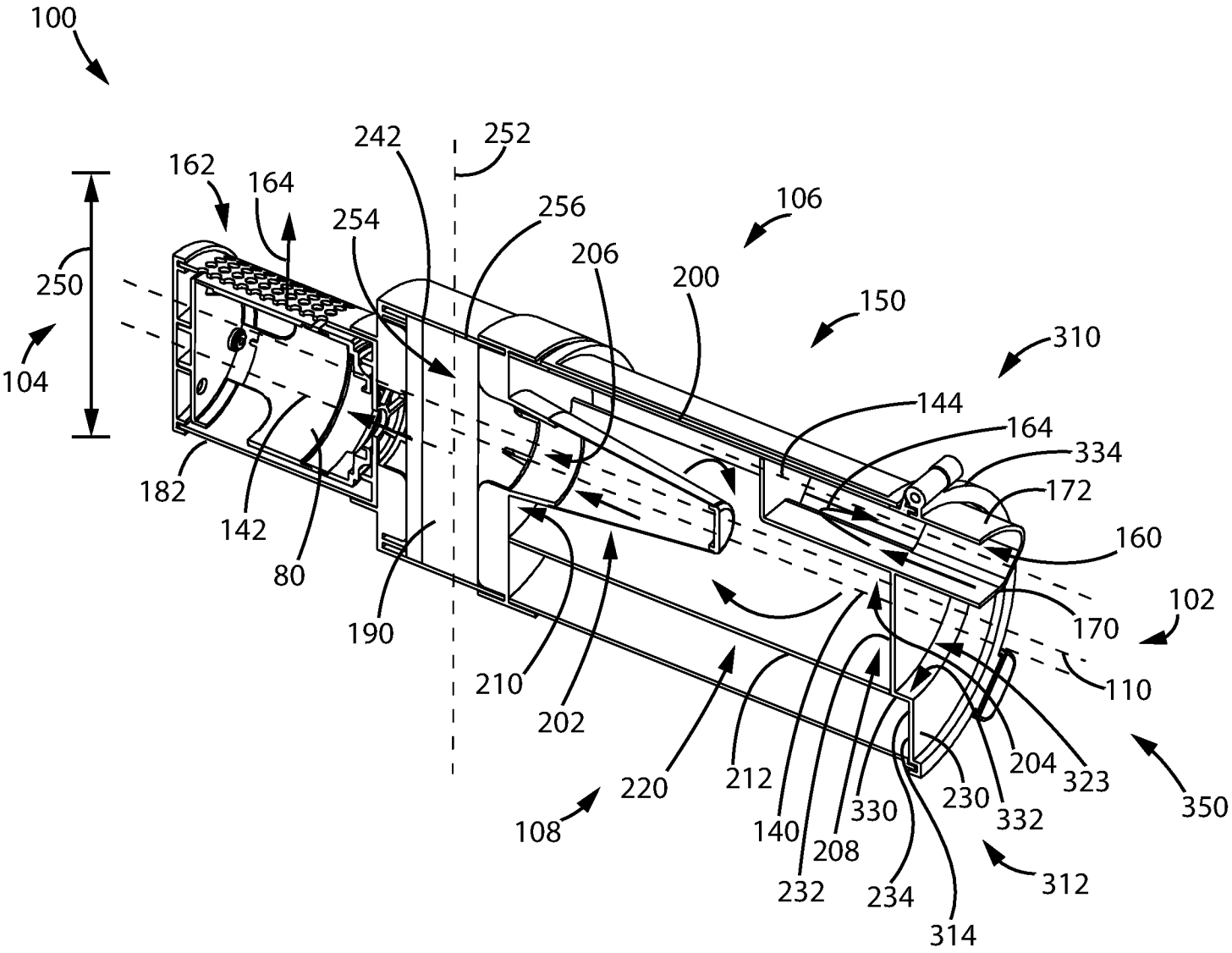
FIG. 26 is a front top cross-sectional perspective view of a third hand vacuum cleaner; and, FIG. 27 is a front top cross-sectional perspective view of the hand vacuum cleaner of FIG. 26 with a front door open.

It will be appreciated that the air treatment chamber 202 may be located asymmetrically within the dirt collection chamber 220, such as at an upper end of the dirt collection chamber 220 (see for example FIG. 26).

It will also be appreciated that the air treatment chamber 202 may be positioned axially forward of the dirt collection chamber 220 and the air treatment chamber closure member 232 may be positioned axially outwardly of the dirt collection chamber closure member 234.

It will also be appreciated that, in other embodiments, the dirt collection chamber 220 may be partially or fully nested within the air treatment chamber 202 and the position of the closure members reversed.

The door 230 is openable to provide access to both the dirt collection chamber and the air treatment chamber 202. As exemplified, the door 230 includes a transition between the closure members 232, 234, rather than the dirt collection chamber 220 continuing between the closure members 232, 234 (e.g., to prevent dirt from getting stuck between the front door 230 and the front of the cyclone chamber 202). For example, as exemplified in FIGS. 26 and 27, the cyclone chamber 202 is recessed from the front end of the cyclone air treatment assembly 150 and the dirt collection chamber 220 extends forwardly of the cyclone chamber 202 (i.e., the front end of the dirt collection chamber 220 is forward of the front end of the cyclone chamber 2020). The transition positions the air treatment chamber closure member 232 forward of the dirt collection chamber closure member 234 such that, when the door 230 is closed, the air treatment chamber closure member 232 is located radially inwardly from an outer perimeter 334 of the openable front end 230 and both the air treatment chamber 202 and the dirt collection chamber 220 are closed.

When the openable front end 230 is in an opened position (FIG. 27), a front end of the air treatment chamber 202 and a front end of the dirt collection chamber 220 are each opened. When the openable front end 230 is in a closed position (FIG. 26), the dirt collection chamber closure member 234 seals the front end of the dirt collection chamber 220 and the air treatment chamber closure member 232 seals the front end of the air treatment chamber 202.

The front door 230 has an air treatment chamber closure member 232 that is axially spaced from of the dirt collection chamber closure member 234. For example, as exemplified in FIG. 26, a transition member 330 may comprise an axially extending cylindrical member provided on the inner side of the openable front end 230 with the air treatment chamber closure member 232 located radially inwardly from the dirt collection chamber 220 are closed.

As exemplified, the door 230 has an inner face 314 that does not include any pockets or recesses between the closure members 232, 234 that comprise part of the dirt collection chamber 220. Accordingly, the transition member 330 and the closure members 232, 234 define a continuous inner face of the door 230.

It will be appreciated that the transition member 330 may be of various shapes that extends between the closure members 232, 234. As exemplified in FIGS. 26 and 27, the transition member 330 comprises a step 328 that is cylindrical that extends between the closure members 232, 234, which is provided on the inner surface 314 of the door 230. Alternately, the transition member 330 may be a curved wall portion joining the two spaced-apart closure members. It will be appreciated that the transition member 330 may have more than one step, may extend at an angle (e.g., it could be fursto conical in shape). For example, the step 328 may comprise a generally planar wall portion extending at an angle of more than 10°, more than 25°, more than 50°, more than 75°, or, as exemplified, about 90° to each of the closure members 232, 234.

In the illustrated example of FIG. 26, the front face of the door 230 also has a corresponding stepped transition 332 (e.g., a recess corresponding to the rearward side of the air treatment chamber closure member 232). However, it will be apricated that the front face may have other shapes, such as planar without stepped transition 332 (e.g., if the door 230 includes a hollow closed pocket in front of the air treatment chamber closure member 232).

Figure 27:
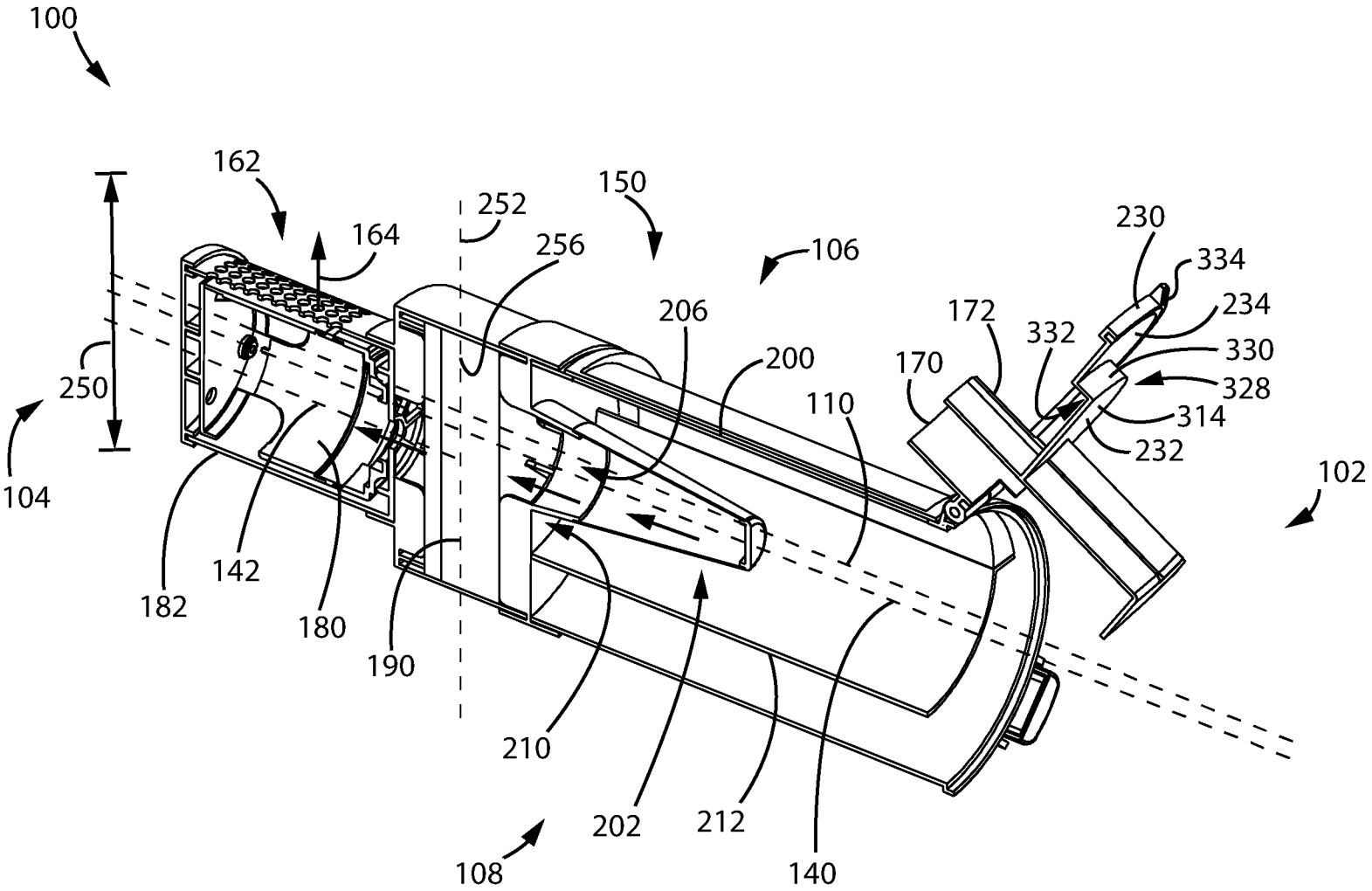

Optionally, the air treatment assembly air inlet 204 and/or the dirty air inlet 160 may be provided in the openable front end 230, as exemplified in FIGS. 26 and 27. The air inlet conduit 172 may extend through the air treatment chamber closure member 232 and/or the dirt collection chamber closure member 234. The dirty inlet 160 may be provided forward of the air treatment chamber closure member 232 and/or the dirt collection chamber closure member 234.

Optionally, as exemplified, the dirt outlet 222 is provided at a rear end 210 of the air treatment chamber 202. The dirt outlet 222 may be provided at the end of the air treatment chamber 202 that is opposite the end at which the air treatment assembly air inlet 204 is provided. The exemplified dirt outlet 222 is provided in an axially extending sidewall 212 of the air treatment chamber 202. The dirt outlet 222 may be provided at the end in which an air outlet 206 is provided (e.g., the air treatment chamber 202 may be a uniflow cyclone chamber 202).

Removable Air Treatment Member

The following is a description of a removable air treatment member, which may be used by itself or in combination with one of more of the air treatment member being positioned above inlet conduit, lower tangential inlet to air treatment member, dirt collection forward of cyclone chamber, upper dirt outlet, concurrently openable cyclone and dirt collection chamber, stepped door, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the air treatment assembly 150 of the surface cleaning apparatus 100 is removeable from the main body of the surface cleaning apparatus 100 in a closed configuration, with or without the pre-motor filter 190. A removable air treatment assembly 150 may include an air treatment chamber 202 and a dirt collection chamber 220. The removable air treatment assembly 150 may be removeable to facilitate, e.g., cleaning the chambers 202, 220, emptying the chambers 202, 220, or cleaning an inlet conduit 172 of the main body 120 which leads to the air treatment chamber 202.

Figure 7:
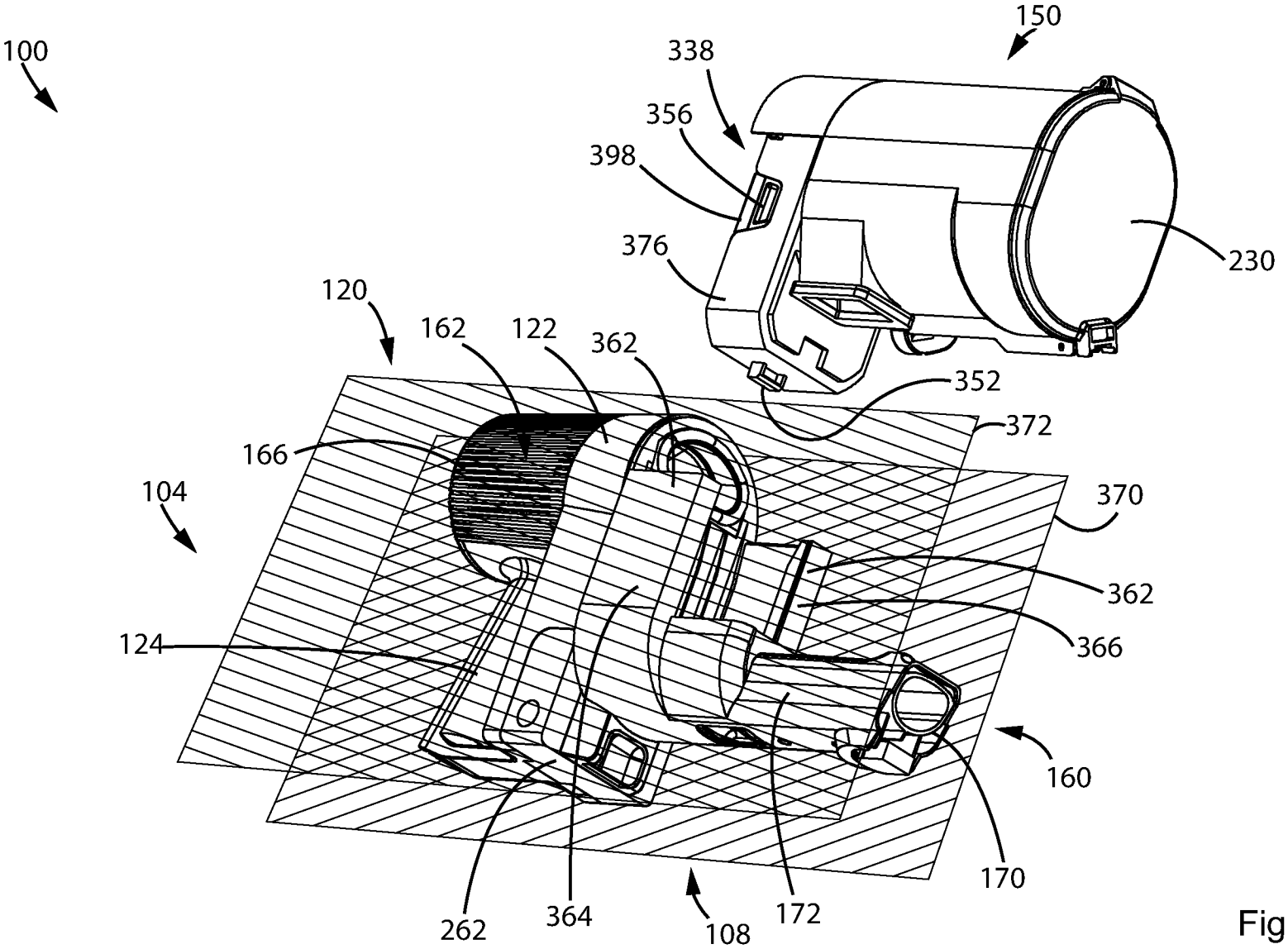
FIG. 7 is a front bottom perspective view of the hand vacuum cleaner of FIG. 1 with a bin assembly removed.
Figure 8:
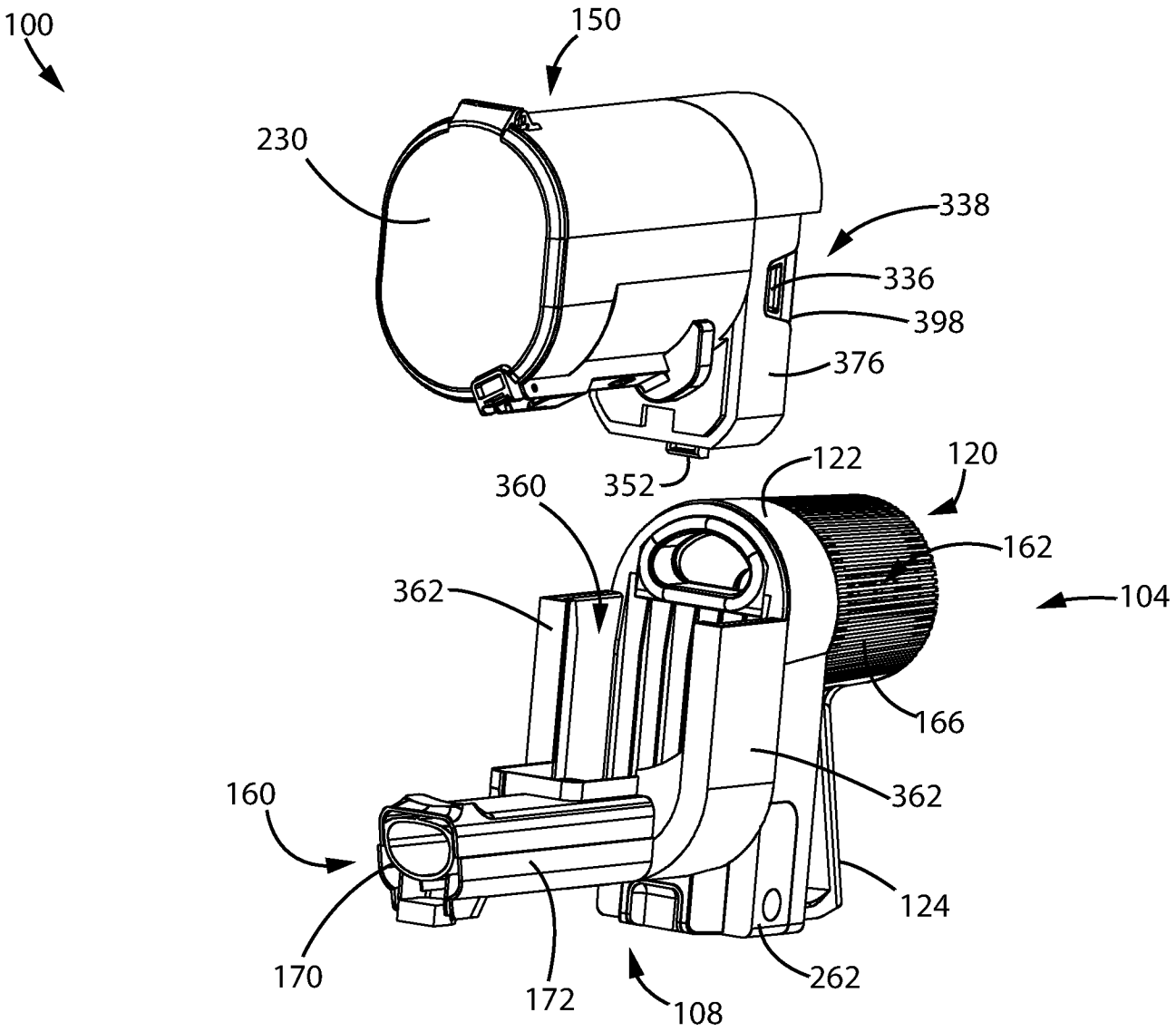
FIG. 8 is a front perspective view of the hand vacuum cleaner of FIG. 1 with the bin assembly removed.

As exemplified in FIGS. 7 and 8, the air treatment assembly 150 is provided at the front end of the main body 120. The air treatment assembly 150 may be removably secured to the main body 120 in any manner known in the art. The air treatment assembly 150 may be removed from the main body 120 to provide greater access to one or more components, as noted previously. For example, removing the air treatment assembly 150 may expose the outlet port 280 of the inlet conduit 172 to enable an operator to clear the outlet port 280 if the port 280 is blocked. An air treatment member 150 that is removable may be easier to clean and/or empty than an air treatment member 150 that is not removable from a main body 120.

It will be appreciated that the air treatment assembly 150 may remove in any direction, such as forwardly, rearwardly, laterally, downwardly or upwardly. In some embodiments, the air treatment assembly 150 is removeable in a direction that is generally transverse to the longitudinal axis 110, the cyclone axis of rotation 140, the suction motor axis of rotation 142, and/or the inlet conduit axis 144. For example, the air treatment assembly 150 may remove generally, laterally, downwardly, or upwardly.

Optionally, the air treatment assembly 150 removes in a direction that is transverse to a longitudinal axis 110 of the hand vacuum cleaner 100, a cyclone axis of rotation 140, a suction motor axis of rotation 142, and/or an inlet conduit axis 144. The transverse direction may comprise or consist of an upward component if the inlet conduit 172 is located below the air treatment assembly 150 and, alternately, the transverse direction may comprise or consist of a downward component if the inlet conduit 172 is located above the air treatment assembly 150.

As exemplified in FIG. 7, the air treatment assembly 150 is removeable in a direction that includes an upward component, and may be removeable generally upwardly in which a removal direction of the air treatment assembly 150 includes a majority component that is upward.

One or more releasable fasteners may hold the air treatment assembly 150 to the main body 120. Any latching mechanism known in the art may be used. The latching mechanism may engage any one or more portions of the main body 120. For example, the latching mechanism may engage the inlet conduit 172. Alternately as exemplified in FIGS. 3 to 6, or in addition, the apparatus 100 the latching mechanism may engage the main body at the location of the rear end of the air treatment assembly (at a location of the motor hosing portion of the main body 120.

As exemplified in FIG. 4, the latch assembly 350 holding the assembly 150 to the main body 120 comprises a main body latch member 352 that is fixed in position and a moveable bin latch member 354. The main body latch member 352 is arranged to hold the mating latch member 354 of the cyclone air treatment assembly 150. A latch actuator 356 (e.g., a finger tab that may be pushed inwardly to disengage the members 352, 254) may be used to release the latch members 352, 354 whereupon the air treatment assembly 150 may be removed from the main body 120.

The illustrated latch members 352, 354 are provided at a lower rearward end of the air treatment assembly 150, and the latch actuator 356 is provided at a lower end 108 of the main body 120. However, it will be appreciated that the latch members 352, 354 and the latch actuator 356 may be provided at any suitable location on the apparatus 100.

As exemplified, the electrical connector 284 adjacent the nozzle 170 may remain when the cyclone air treatment assembly 150 is removed. Although it will be appreciated that in other embodiments the electrical connector 284 could be provided on the removable air treatment assembly 150, with suitable connectors between the bin assembly and the main body 120 to electrically couple the electrical connector 284 to the energy storage members 260 when the air treatment assembly 150 is attached.

The air treatment member 150 may be removeable with or without a pre-motor filter 190. For example, if the hand vacuum cleaner 100 includes a pre-motor filter 190, the pre-motor filter 190 may remain in the main body 120. Alternatively, and as exemplified, the pre-motor filter 190 may be removed with the air treatment assembly 150 (i.e., the assembly 150 includes at least a portion of the housing of the pre-motor filter 190 such that the pre-motor filter 190 is carried away with the assembly 150).

Support Recess for Removeable Air Treatment Member

The following is a description of a main body recess to hold the air treatment assembly, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the main body 120 includes a recess 360 into which part or all of the air treatment assembly 150 is received when the air treatment assembly 150 is attached to the main body 120. The recess 360 may improve the stability of the connection between the air treatment assembly 150 and the main body 120, particularly when the air treatment assembly 150 and the main body 120 are secured together at a single point and/or by a single latching assembly 350 (e.g., as exemplified).

In accordance with this aspect, a single recess 360 may be provided. The recess 360 may be provided at a location that is axially spaced from the location at which the air treatment assembly 150 is secured to the main body 120 or, as exemplified, at the same end of the air treatment assembly 150 that is secured to the main body 120.

The recess 360 may be of any shape in which a portion of the air treatment assembly is slideably receivable and the recess 360 may be formed by one or more sidewalls extending out, e.g., axially outwardly from the main body 120.

As exemplified in FIGS. 7 and 8, the main body 120 may include first and second laterally opposed sidewalls 364, 366. The recess 360 of the main body 120 is provided between the pair of sidewalls 362, one of which is provided on each on each of the opposed sidewalls 364, 366. As exemplified in FIG. 2, the air treatment assembly 150 may be removably mounted to the cleaner body 120 with the rear end of the air treatment member 150 seated between the sidewalls 362 when the air treatment member 150 is mounted to the cleaner body 120.

In this embodiment, the sidewalls 362 extend forwardly from the portion of the main body housing the energy storage members 260 and upwardly from the portion of the main body 120 joining the inlet conduit 172 to the handle 124. The exemplified sidewalls 362 are generally vertical walls extending parallel to the longitudinal axis 110, the cyclone axis 140, the suction axis 142, and/or the conduit axis 144. Accordingly, as exemplified, the inlet conduit 172 and the sidewalls 362 define a generally U-shaped recess 360 in which the air treatment member 150 is removably received.

It will be appreciated that the portion of the main body immediately rearward of the sidewalls 362 may house any component of the surface cleaning apparatus, such as the suction motor 180, or the pre-motor filter 190 if the pre-motor filter is not removable with the air treatment assembly 150.

It will be appreciated that the bottom of the recess 360 (the portion that connects the two sidewalls 362, may be any portion of the main body 120. As exemplified the connecting portion comprises a recess in which part of the pre-motor filter housing which has the main body latch member 352 is removably receivable (see for example FIG. 7).

The sidewalls 362 are arranged to surround the rear end of the cyclone air treatment assembly 150 when the air treatment assembly 150 is attached to the main body 120. The exemplified sidewalls 362 are provided as supporting walls, and each may extend at least 5%, 10%, or 15% of the length of the air treatment assembly 150 along which the sidewalls 362 extend (e.g., the length along the longitudinal axis 110 as exemplified).

If the inlet conduit 172 is located at the same elevation as the connecting portion of the sidewalls 362, then the inlet conduit 172 may be provided, e.g., at a lower end of the sidewalls 362 as exemplified and the outlet port 280 of the inlet conduit 172 may be located within the recess at a location between the sidewalls 362 or, as exemplified, the outlet port 280 may be located immediately forward of the sidewalls 362 (See for example FIG. 7).

The air treatment assembly 150 may be secured to the main body 120 at a point within the recess 360. Optionally, the air treatment assembly 150 is only secured to the main body 120 within the recess 360 (i.e., at one or more points within the recess, and, optionally, at only a single point within the recess). Accordingly, the latch assembly 350 may be arranged with the main body latch member 352 provided within the recess 360 (e.g., optionally at a bottom end of the recess, as exemplified in FIG. 4) to hold the air treatment assembly 150 in place in the recess 360 when secured to the bin latch member 354.

Optionally, as exemplified, the rearward end of the air treatment assembly 150 has recessed side portions 376 in which walls 362 of the main body recess 360 are received, see for example FIGS. 7 and 8). As exemplified, the recessed side portions 376 form part of the pre-motor filter housing and therefore, the part of all of the axial length of the pre-motor filter may be located in the recess 360.

Pre-Motor Filter Accessible when Air Treatment Member is Removed

The following is a description of a pre-motor filter that is accessible when air treatment member 150 is moved, which may be used by itself or in combination with one of more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the surface cleaning apparatus 100 includes a pre-motor filter 190. The pre-motor filter 190 may be positioned rearward of the cyclone outlet 206 and may face the cyclone outlet 206. As exemplified in FIG. 10, the cyclone outlet 206 may include an opening in the front wall of the pre-motor housing 242 (i.e., leading directly to the filter 190 or an upstream header 294 in the housing 242). Accordingly, the pre-motor filter 190 may be accessible when the air treatment member 150 is removed. The pre-motor filter 190 may be inaccessible when the air treatment member 150 is attached to the main body in an operating position of the hand vacuum cleaner (e.g., the position of FIG. 1). The pre-motor filter may be inspected, cleaned, and/or replaced when the bin assembly is removed.

Figure 9:
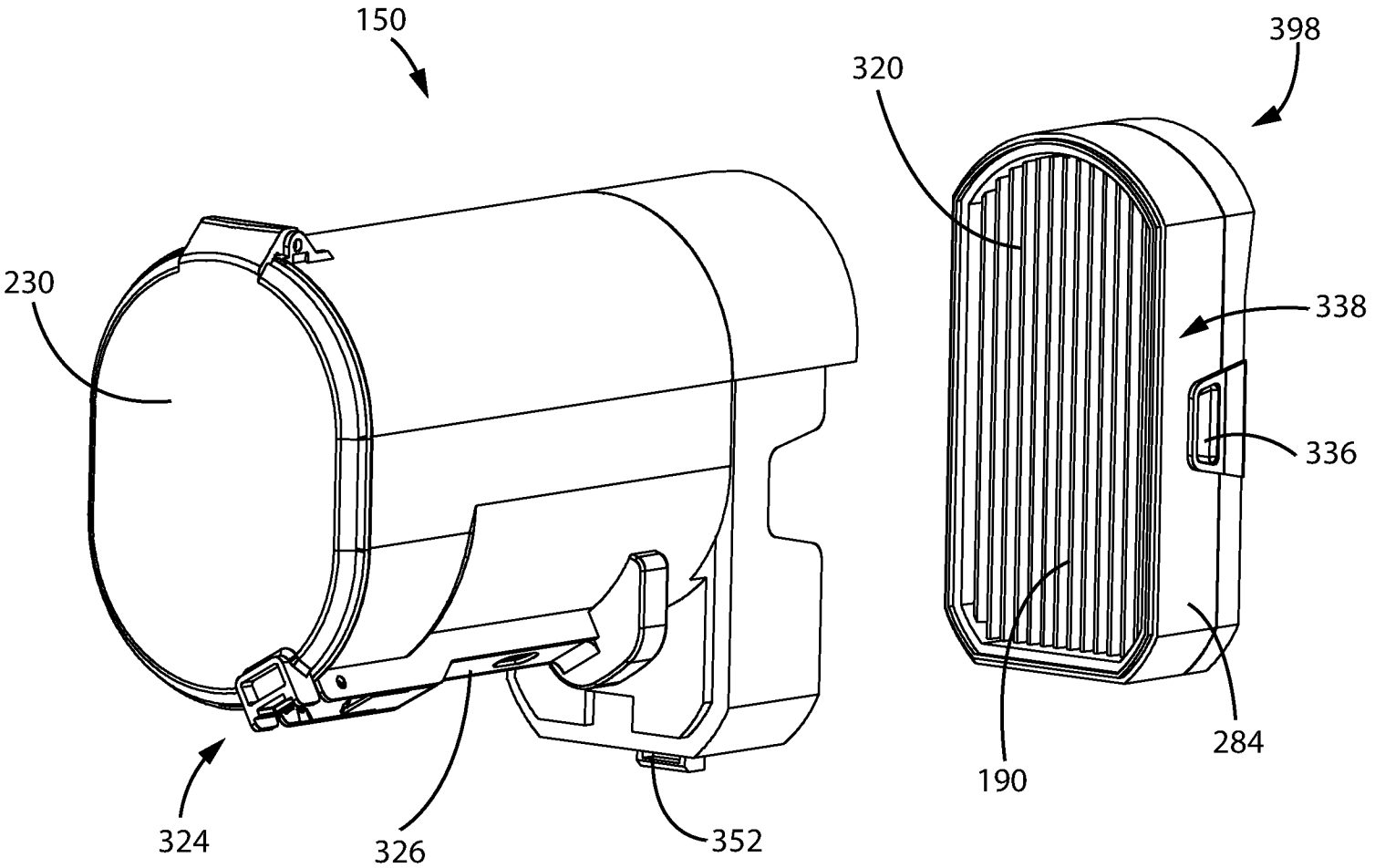
FIG. 9 is a front perspective view of the bin assembly of the hand vacuum cleaner of FIG. 1 in a partially exploded view.
Figure 10:
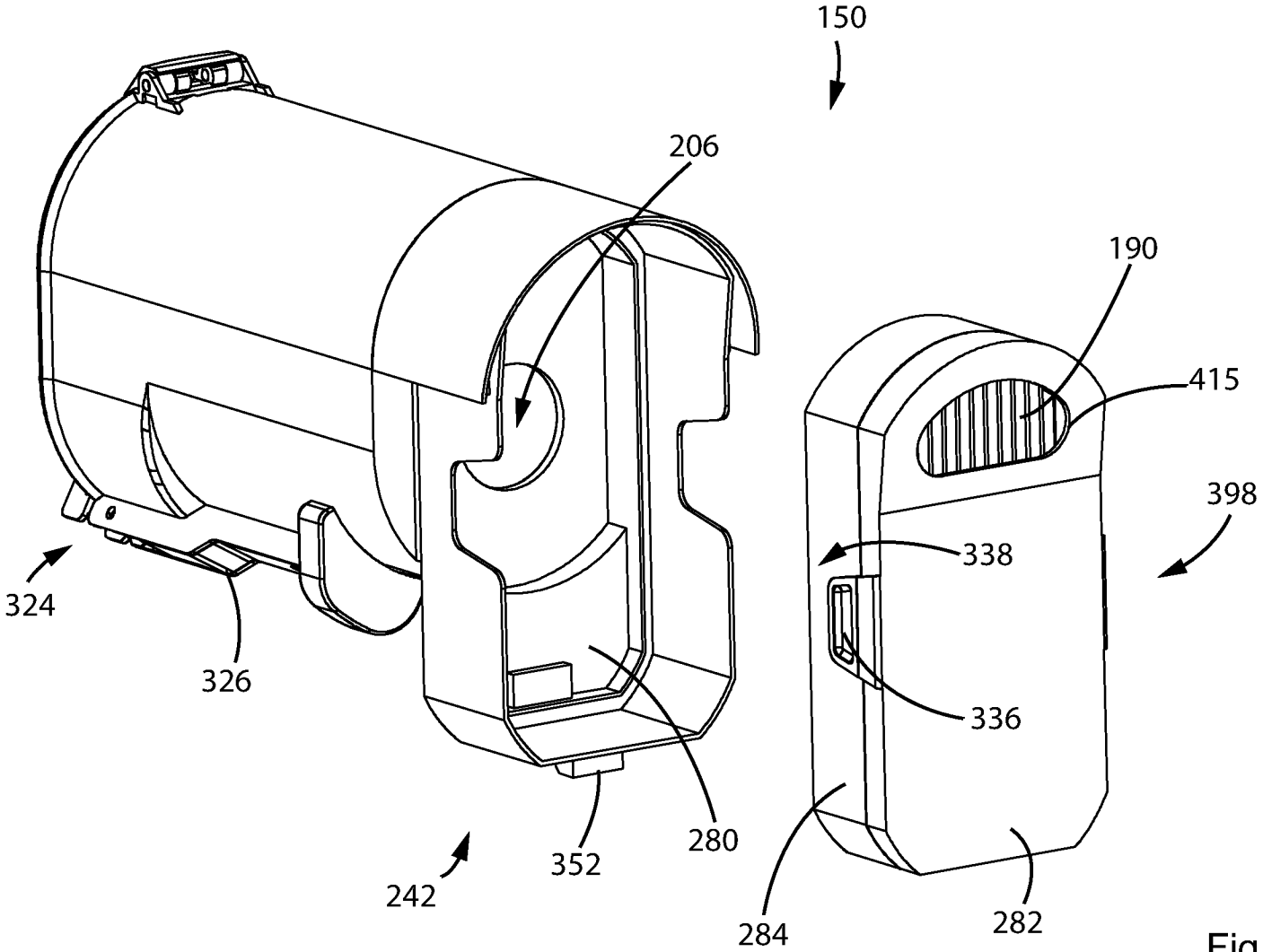
FIG. 10 is a rear perspective view of the bin assembly of the hand vacuum cleaner of FIG. 1 in a partially exploded view.

As exemplified in FIGS. 9 and 10, the pre-motor filter 190 may be removably received (e.g., held) in the pre-motor filter housing 242 when the air treatment member 150 is mounted to the main body in the operating position. As exemplified, the pre-motor filter housing 242 may be defined by a front wall 280, a rear wall 282 and a sidewall 284. In this example, the front wall 280 and the sidewall 284 are part of the air treatment assembly 150. The optional rear wall 282 is a holder of the pre-motor filter 190. Accordingly, walls 280, 282, 284 form an openable housing 242.

It will be appreciated that the housing 242 may be part of the main body 120 or part of the removable assembly 150 (i.e., removes with the assembly 150 when the assembly 150 is removed from the main body 120), or may include a portion that is part of the main body 120 and a portion that is part of the assembly 150.

Removing the air treatment assembly 150 may, whether the pre-motor filter 190 is removed with the assembly 150 or remains on the main body 120, expose the pre-motor filter 190, render a removeable wall of a housing of the pre-motor filter 190 accessible to be lifted out, or expose an actuator of a latching assembly such that the actuator may be used to release the removeable wall of the housing of the pre-motor filter 190 such that the removable wall may be lifted out.

As exemplified in FIGS. 9 and 10, the pre-motor filter housing 242 may include a moveable housing portion 398 that may be held in position by a latching assembly 338. As exemplified in FIGS. 7 to 10, the pre-motor filter housing 242 is openable when the latching assemblies 338 that hold the air treatment assembly 150 to the main body 120 are released. It will be appreciated that any suitable latching assemblies may be used, any number of latching assemblies may be used, and the latching assemblies may be positioned in any suitable location.

In the exemplified embodiment of FIGS. 9 and 10, the moveable housing portion 398 is a filter holder which comprises a rear wall and a sidewall of the pre-motor filter housing 242. It will also be appreciated that the moveable housing portion 398 may be of any configuration and may not hold the pre-motor filter 190. Instead, the pre-motor filter 190 may remain in the rear end of the air treatment assembly 150 when the moveable housing portion 398 is moved to an open position (e.g., by pivoting the moveable housing portion 398 to an open position or by removing the moveable housing portion 398 from the air treatment assembly 150). Accordingly, the moveable housing portion 398 may comprise an openable door which reveals the pre-motor filter 190 when opened.

In the exemplified embodiment of FIGS. 9 and 10, the moveable housing portion 398 is held to a front portion of the housing portion, which as exemplified is a rear portion of the air treatment assembly 150, by the releasable latch assembly 338 on each lateral side of the apparatus 100. Each releasable latch assembly 338 includes an actuator 336 on a lateral wall of the housing 242 that is inaccessible when the air treatment assembly 150 is attached to the main body 120. When the air treatment assembly 150 is removed, the latch actuators 336 are accessible and the operator may press in on the opposed latch actuators thereby releasing the latch assemblies 338.

As exemplified in FIGS. 1 to 10, removing the air treatment assembly 150 may expose latch actuators 336 that are positioned behind walls 362 of a recess 360 of the main body 150 when the cyclone air treatment assembly 150 is attached to the main body 150. The latch actuators 336 may be used to release a removeable filter holder of the housing 242 of the pre-motor filter 190. When the latch assemblies 338 are released, the moveable housing portion 398 may be pulled rearwardly out of the rear end of the air treatment assembly 150 to open the pre-motor filter housing 242 to provide access to the pre-motor filter 190.

Figure 18:
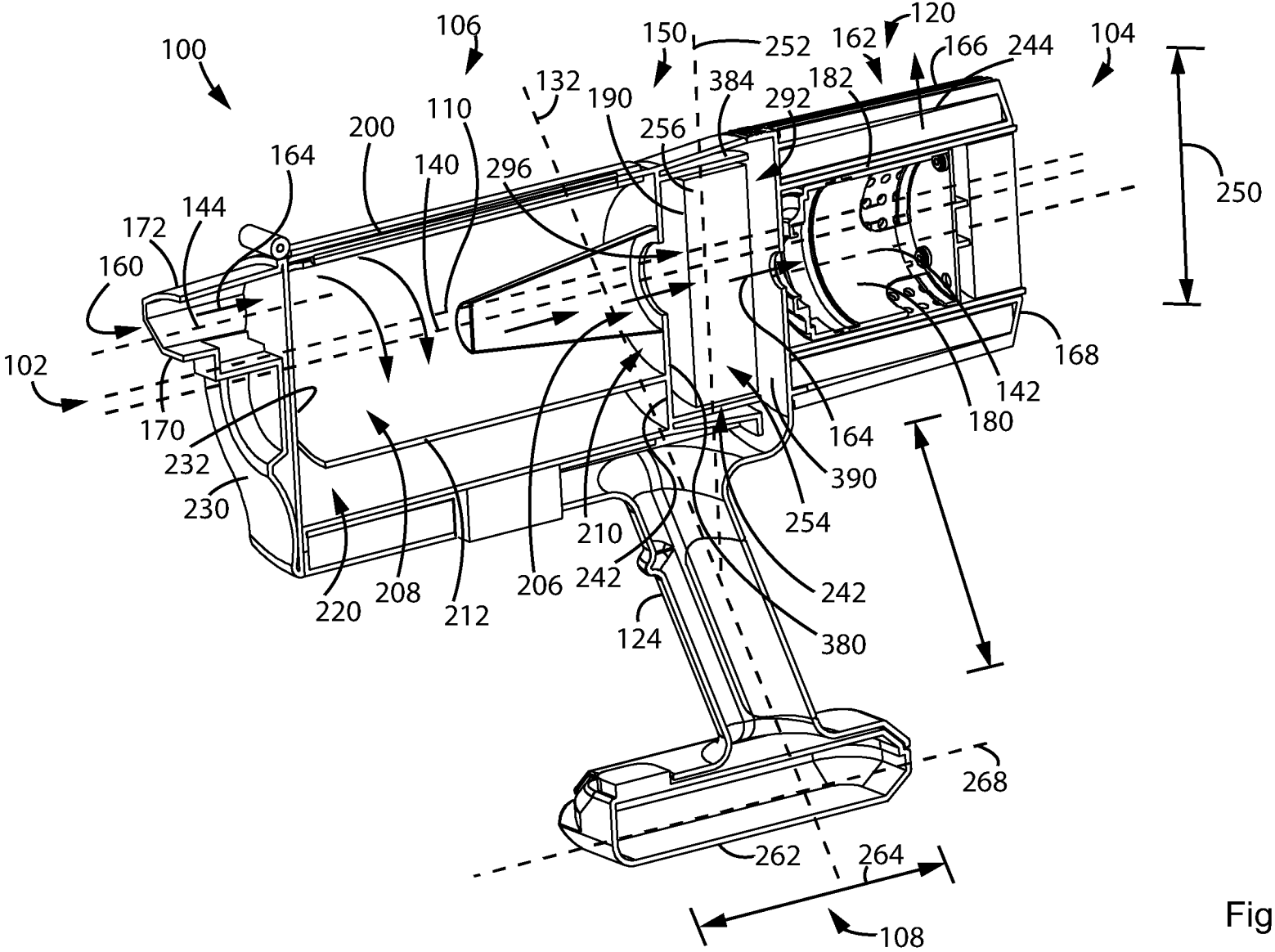
FIG. 18 is a front cross-sectional perspective view of the hand vacuum cleaner of FIG. 17.
Figure 19:
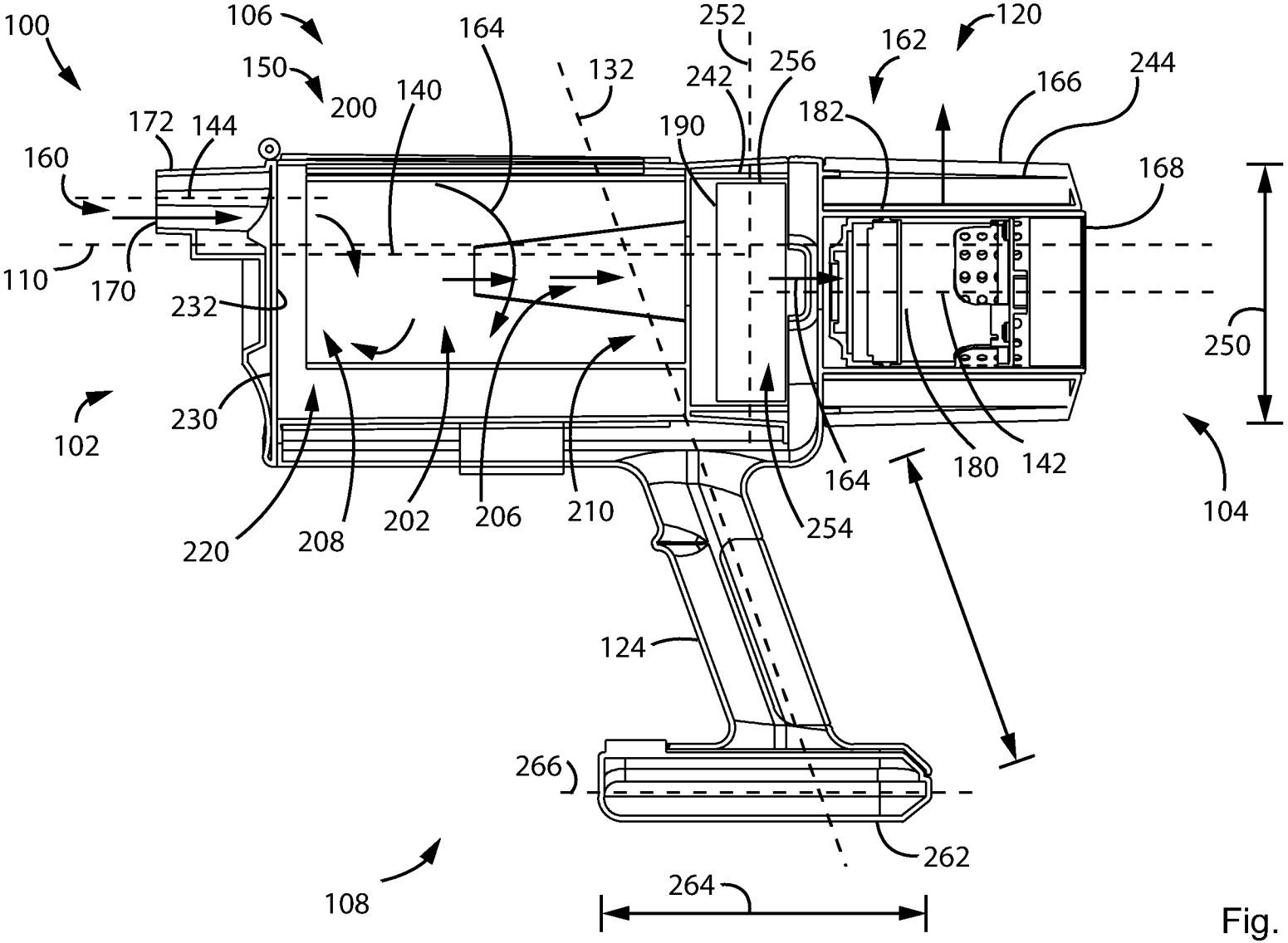
FIG. 19 is a side cross-sectional view of the hand vacuum cleaner of FIG. 17.
Figure 20:
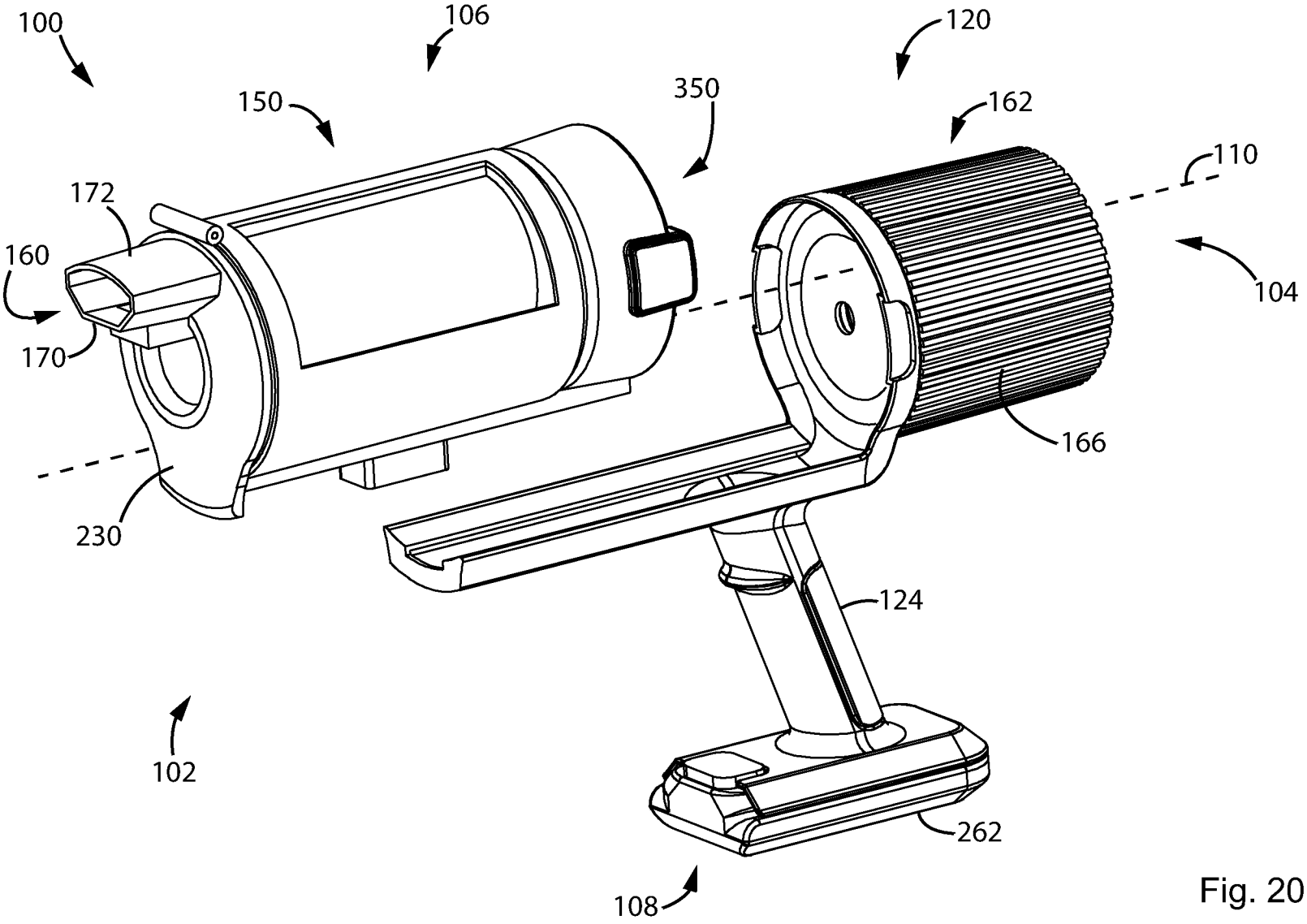
FIG. 20 is a front perspective view of the hand vacuum cleaner of FIG. 17 with a bin assembly removed.
Figure 21:
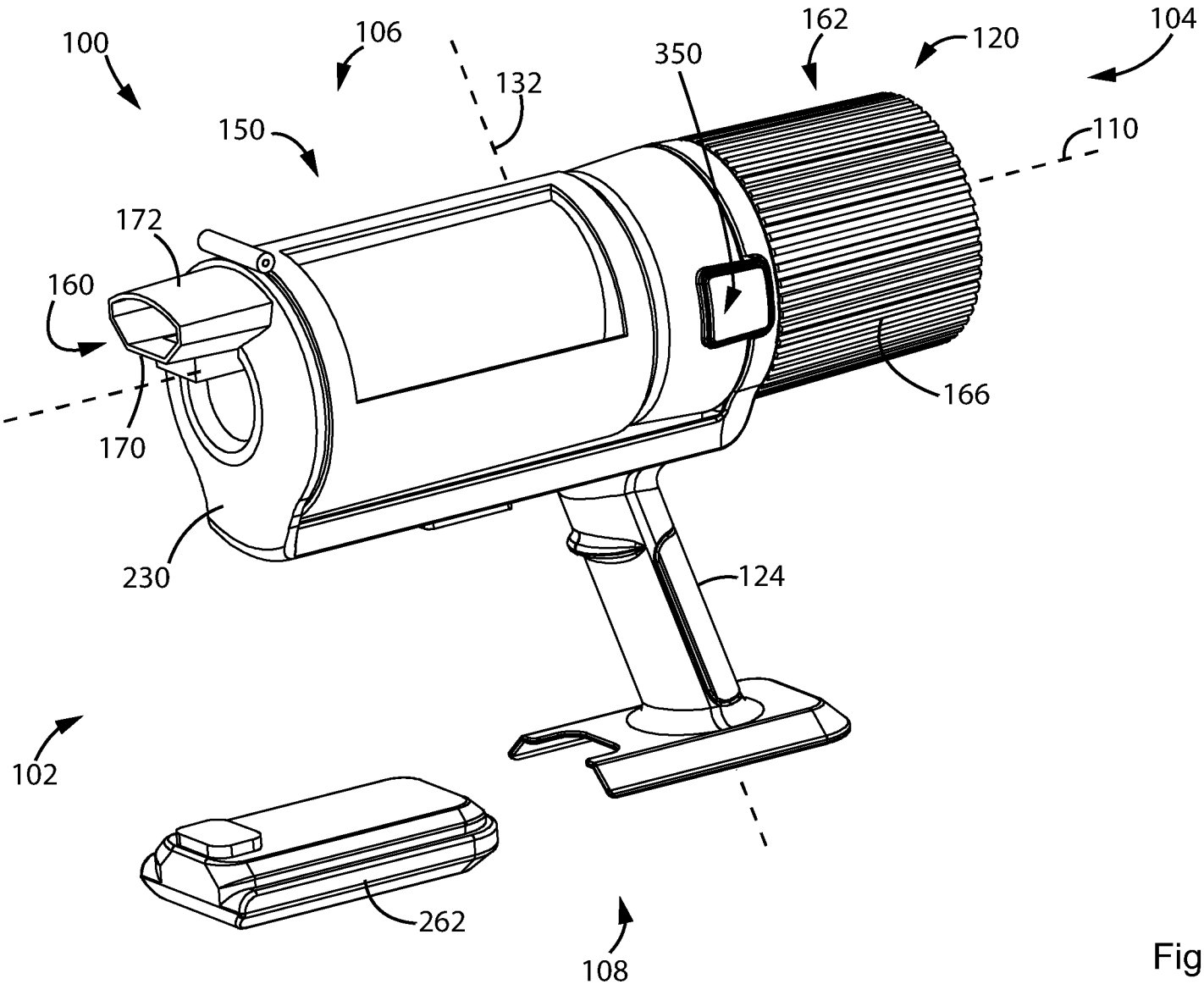
FIG. 21 is a front perspective view of the hand vacuum cleaner of FIG. 17 with an energy storage member pack removed.
Figure 22:
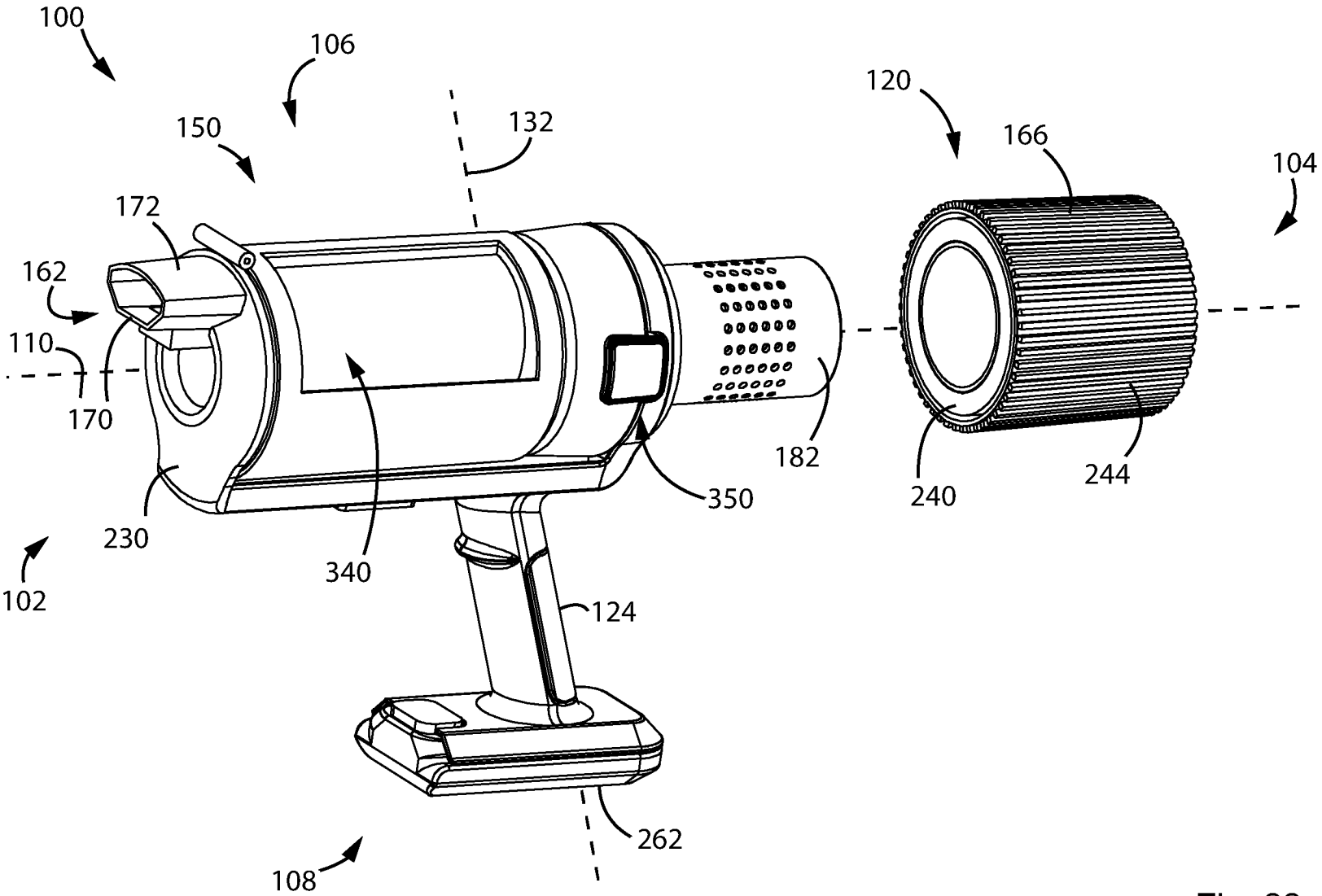
FIG. 22 is a front perspective view of the hand vacuum cleaner of FIG. 17 with a post-motor filter housing removed.
Figure 23:
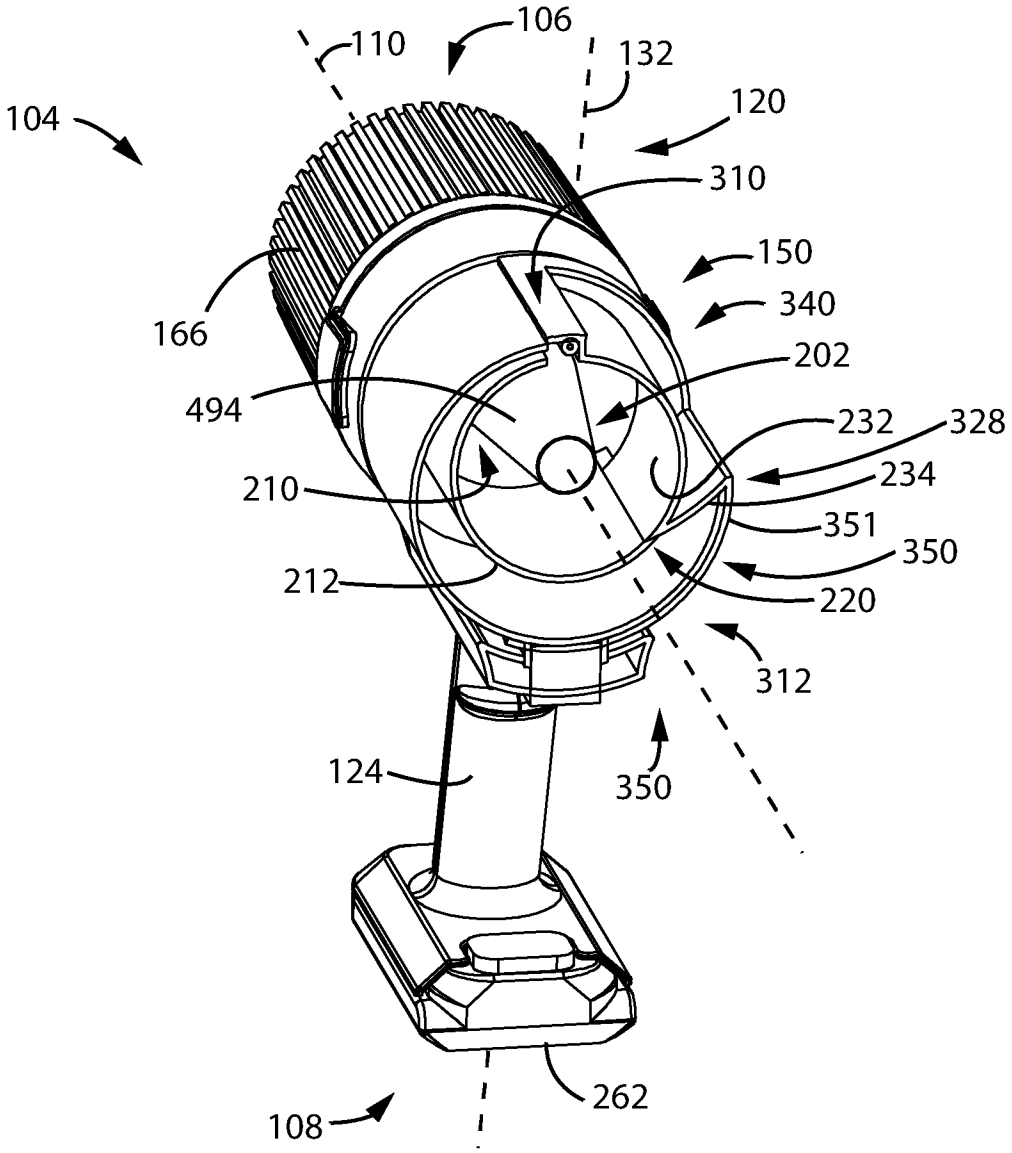
FIG. 23 is a front top cross-sectional perspective view of the hand vacuum cleaner of FIG. 17 with a stepped door closed.
Figure 24:
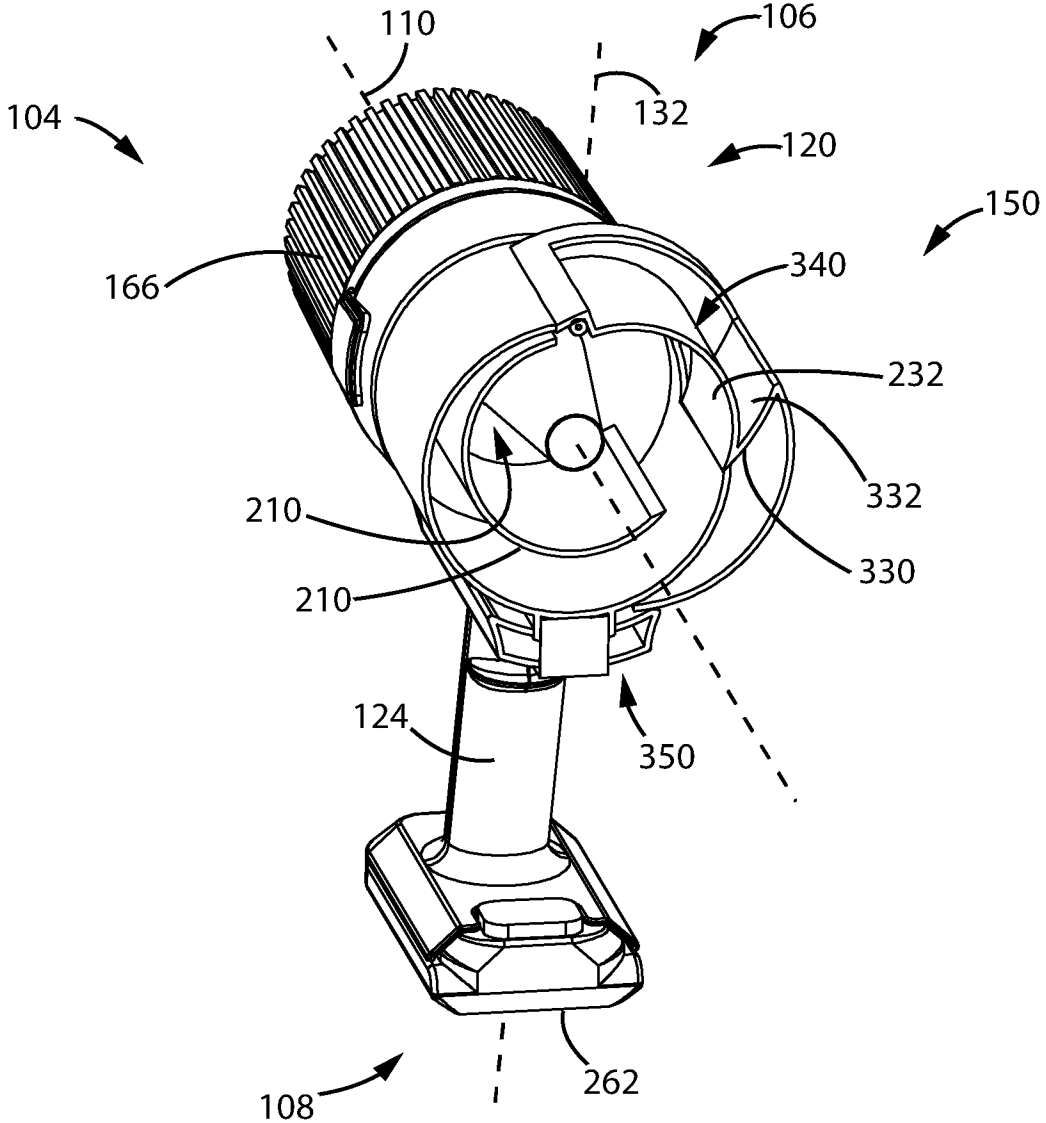
FIG. 24 is a front top cross-sectional perspective view of the hand vacuum cleaner of FIG. 17 with a stepped door partially open.
Figure 25:
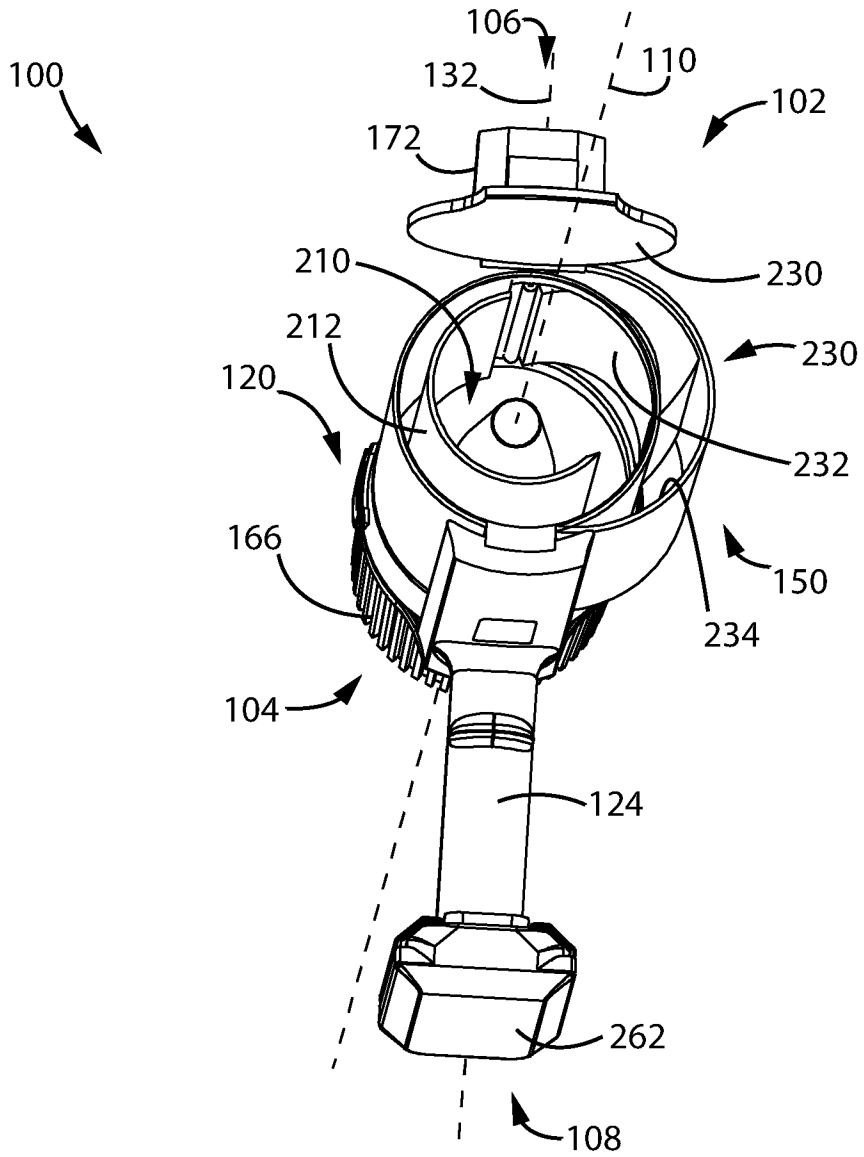
FIG. 25 is a front bottom cross-sectional perspective view of the hand vacuum cleaner of FIG. 17 with a stepped door partially open.

Alternatively, as exemplified in FIG. 18, the main body 120 and the air treatment assembly 150 each form part of the housing 242. As exemplified, the pre-motor filter is recessed in a rear end of the air treatment assembly 150. The main body 120 has a forward facing wall 390 (which may be considered a front wall of the main body when the air treatment assembly 150 is removed. When the air treatment assembly 150 is mounted to the main body 120, the forward facing wall 390 defines the rear wall 382 of the pre-motor filter housing 242. The main portion of the housing 242 is part of the air treatment assembly 150, and so the filter 190 removes with the assembly 150, exposing a rearward (or downstream) side of the filter 190.

As exemplified in FIGS. 9, 10, and 17-20, the pre-motor filter 190 may be removable from the air treatment assembly 150 in an axial direction (e.g., parallel to the longitudinal axis 110, the cyclone axis 140, and/or the motor axis 142). The filter 190 may, as exemplified, remove rearwardly.

Alternatively, the filter 190 may be removed forwardly, e.g., if the filter is seated in a forward portion of the main body 120 and remains with the main body 120 when the air treatment assembly 150 is removed. Accordingly, removing the air treatment assembly 150 may expose the upstream (e.g., dirty) side of the filter 190. Also, for embodiments in which the pre-motor filter 190 remains with the body 120, the filter 190 and/or a latch assembly holding a moveable housing portion 398 of the housing 242 may be accessible when the air treatment assembly 150 is attached, or removing the air treatment assembly 150 may make accessible the filter 190 and/or a latch assembly holding a moveable wall of the housing 242.

As exemplified in FIGS. 4 and 18, the pre-motor filter housing 242 may comprise a downstream header 292 and/or an upstream header 294. The downstream header 292 may be located between a rearward facing downstream side of the pre-motor filter 190 and the forward facing wall 390 in the embodiment of FIG. 18 or the rear wall 382 of the housing 242 in the embodiment of FIGS. 1 to 6. Headers may facilitate air distribution and/or recovery from across the surface of the filter 190. For example, and air inlet and/or air outlet of the housing 242 may be smaller than the corresponding face of the filter 190 (e.g., much smaller, such as having an inlet area or outlet area that is less than 40%, less than 20% or less than 10% of the surface area of the upstream face or downstream face of the filter 190), and a header may facilitate air movement between the inlet or outlet and the upstream or downstream face. One or more of the headers may be opened when opening the housing 242.

Large Pre-Motor Filter

The following is a description of a relatively large pre-motor filter, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the pre-motor filter 190 has a surface area (e.g., upstream and/or downstream) that is relatively large as compared to any other portion of the air flow path 164. The surface area may be larger than the largest surface area of the cyclone 202 in a plane that is perpendicular to the cyclone axis of rotation 140. The surface area may be larger than the largest surface area of the suction motor 180 in a plane that is perpendicular to the motor axis of rotation 142. The surface area may be equal to or larger than the surface area of each cross section of the air flow path 164 perpendicular to the air flow direction along the air flow path (i.e., no cross sectional area of the air flow path may be larger than the surface area of the filter). A large surface area may reduce back-pressure. This aspect may be used by itself or in combination with one or more other aspects of this disclosure.

As exemplified, the pre-motor filter 190 may be positioned facing the rear end 210 of the air treatment chamber 202, the rear end of the air treatment assembly 150, and/or the front end of the suction motor 180.

The upstream and/or downstream face of the filter 190 may extend beyond the edges of the facing component which it overlies such that the pre-motor filter 190 also overlies an adjacent component or part of main body 120. As exemplified in FIG. 4, a dimension of the pre-motor filter 190 may be larger than the corresponding dimension of the cyclone 202. The pre-motor filter 190 may have a dimension in a direction transverse to the central longitudinally extending axis 110, the cyclone axis 140, and/or the motor axis 142 that is larger than a dimension of the cyclone 202 in the same direction transverse to the central longitudinally extending axis 110, the cyclone axis 140, and/or the motor axis 142. For example, the height 250 (e.g., generally vertical dimension between the upper end and the lower end) of the filter 190 may be greater than the height 400 of the cyclone.

As exemplified, the pre-motor filter 190 may overlie the dirt collection chamber 220. Accordingly, if the assembly 150 comprises both an air treatment chamber 202 and a dirt collection chamber 204, the filter 190 may be positioned axially rearwardly of the air treatment chamber 202 and the dirt collection chamber 204 and may overlie part or all of the air treatment chamber 202 and the dirt collection chamber 204.

Further, as exemplified in FIG. 4, a portion of the pre-motor filter may extend radially outwardly of the air treatment chamber 202 and the dirt collection chamber 204. As exemplified, the pre-motor filter may also overlie part or all of the air inlet conduit 172. Accordingly, if the air inlet conduit is located radially outwardly of the air treatment chamber 202 and the dirt collection chamber 204, then the pre-motor filter may have, e.g., a height that is greater than a height of the portion of the air treatment assembly that houses the air treatment chamber 202 and the dirt collection chamber 204.

As exemplified in FIG. 4, the pre-motor filter housing 242 may have a length (height) 250 in a direction transverse to the central longitudinally extending axis 110, the cyclone axis 140, and/or the motor axis 142. The length 250 extends between a first end (e.g., upper end) of the pre-motor filter housing 242 and a second end (e.g., lower end) of the pre-motor filter housing 242. The portion of the air treatment assembly that houses the air treatment chamber 202 and the dirt collection chamber 204 has a length (height) 258 that is smaller than the length 250.

As exemplified in FIG. 6, the pre-motor filter 190 has a first portion 410 at the first end 412, a second portion 414 at the second end 416 and a middle portion 418 positioned between the first and second portions 410, 414. As exemplified, the pre-motor filter housing 242 may have an air outlet 415 at the first end of the pre-motor filter housing 242. In some embodiments, as exemplified, a projection of the air outlet 415 parallel to the longitudinal axis 110, the cyclone axis 140, the motor axis 142, and/or the conduit axis 144 intersects the first portion 410 of the pre-motor filter 190.

An air outlet 206 of the air treatment assembly 150 may face an upstream side 320 of the pre-motor filter 190. In some embodiments, the middle portion 418 may comprise 20%, 30%, 40%, or 50% of the length 250 of the pre-motor filter 190. The air outlet 206 of the air treatment assembly 150 may face the middle portion 418. As exemplified in FIG. 10, the cyclone chamber air outlet 206 may be at the rear end 210 of the cyclone chamber 202. The air outlet 206 may be arranged such that air exits the air treatment assembly air outlet 206 in an axial direction (i.e., generally parallel to the longitudinal axis 110, the cyclone axis 140, and/or the motor axis 142). In some examples, a projection of the air outlet 206 generally parallel to the longitudinal axis 110, the cyclone axis 140, and/or the motor axis 142 intersects the pleated filter material of the pre-motor filter 190 and intersects it at the middle portion 418.

The pre-motor filter 190 may be length that is larger than, or similar in size to, the length of one or more alternate components. As exemplified in FIG. 4, the longest dimension 264 (e.g., the height) of the energy storage member pack 262 may be from 50% to 150%, 75% to 125%, or 80% to 110% of the longest dimension 250 of the pre-motor filter 190. Alternately, or in addition, the longest dimension 250 of the pre-motor filter 190 may be longer than the longest dimension 130 of the handle 124. As exemplified, the longest dimension 250 of the pre-motor filter 190 may be from 50% to 150%, 75 to 125%, or 100% to 125% of the longest dimension 130 of the handle 124.

Vertically Pleated Pre-Motor Filter

The following is a description of vertically pleated pre-motor filter, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the pre-motor filter 190 is a pleated filter media. The upstream surface 320 and/or downstream surface 402 of the pre-motor filter 190 includes pleats (i.e., alternating peaks and valleys formed by generally flat surfaces meeting along edges). The pleats may be arranged parallel to a longest dimension of the pre-motor filter (e.g., vertically, in the exemplified embodiment of FIG. 9) and/or pleats that extend generally transverse to the longitudinal axis 110, cyclone axis 140, motor axis 142, and/or conduit axis 144.

Figure 12:
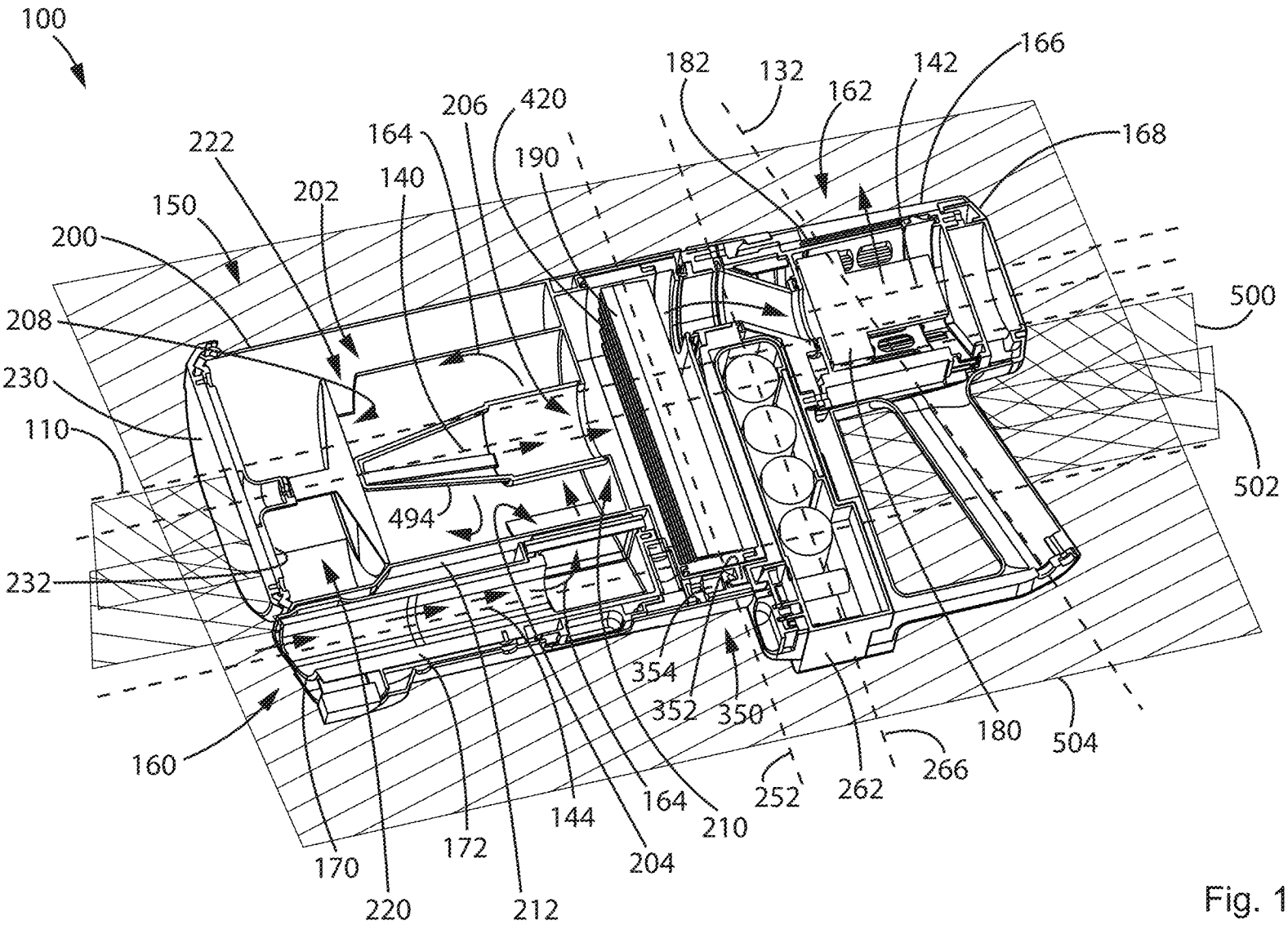
FIG. 12 is a front bottom cross-sectional perspective view of the hand vacuum cleaner of FIG. 1.

As exemplified in FIG. 12, the pre-motor filter 190 comprises a pleated filter material wherein the pleats 420 extend vertically.

Pleats 420 parallel to the longest dimension may improve airflow. For example, air entering the upstream header 294 adjacent one of the upper end 412 or the lower end 416 may more easily disperse across the upstream face 320 of the pre-motor filter 190 when the pleats 420 run between the upper end 412 and the lower end 416 (e.g., as opposed to if the pleats run parallel to the shortest dimension or another dimension). Pleat orientation may be chosen to facilitate airflow across the surface of the filter.

Energy Storage Member Pack Removes Transversely

The following is a description of an energy storage member pack that removes transversely, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the apparatus 100 includes a plurality of energy storage members 260 arranged in a removable pack 262 that is removeable in a direction transverse to the longitudinal axis 110, the cyclone axis 140, the motor axis 142, and/or the inlet conduit axis 144. The removal direction may include a downward component, and the removal direction may be generally downwardly so that the energy storage member pack 262 is removeable from the lower side of the apparatus 100.

Figure 11:
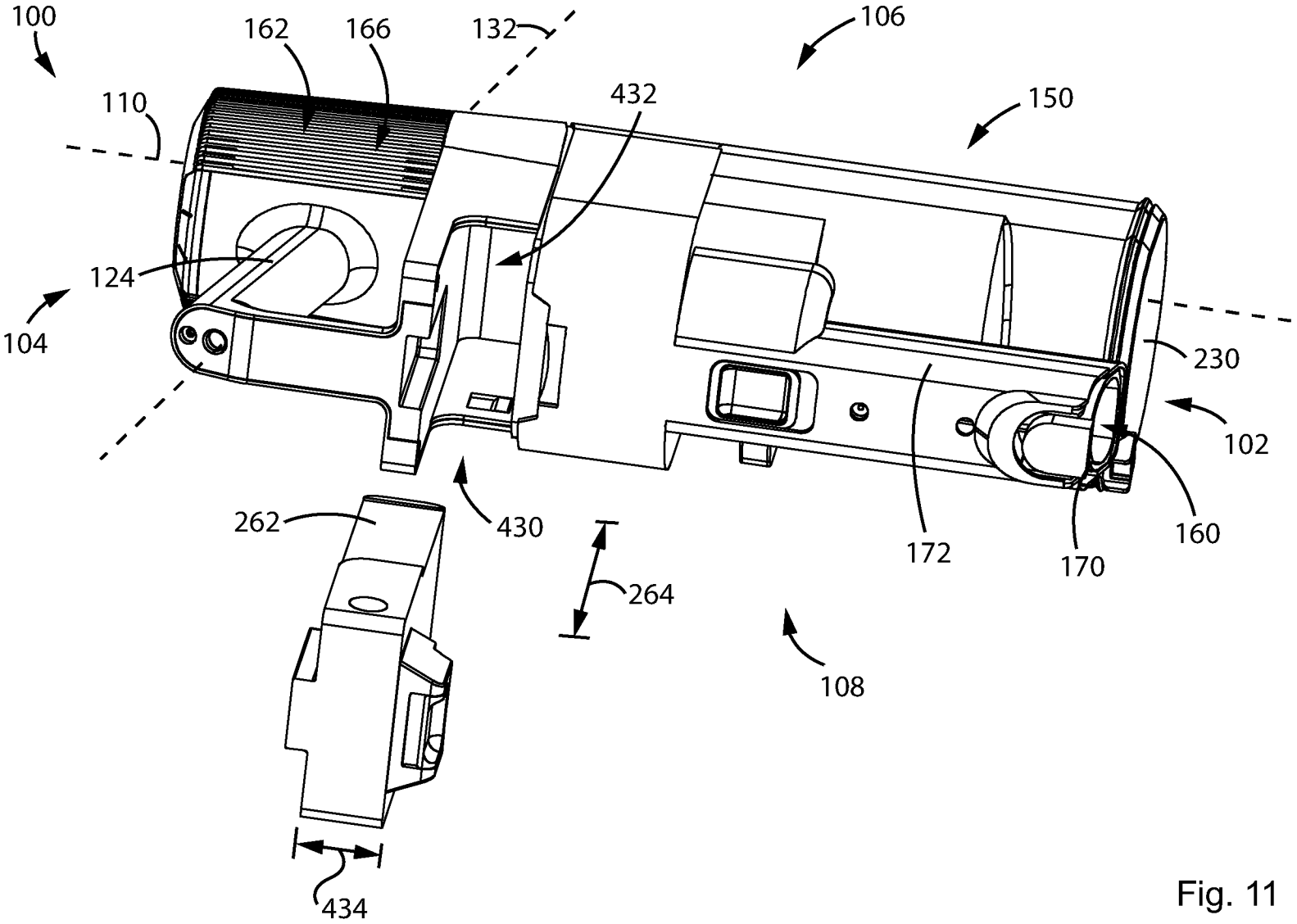
FIG. 11 is a bottom perspective view of the hand vacuum cleaner of FIG. 1 with an energy storage member pack removed.

As exemplified in FIG. 11, the lower end 108 of the hand vacuum cleaner 100 has an opening 430 for removably receiving the energy storage member pack 262. The opening 430 leads into a recess 432 that extends into (e.g., upwardly into) the main body 120 of the apparatus 100. As exemplified, the energy storage member pack 262 is removable in a transverse direction that is generally transverse to the air treatment assembly axis 140, the motor axis 142, the inlet conduit axis 144, and/or the longitudinal axis 110.

As exemplified in FIG. 4, when the energy storage member pack 262 is positioned in the hand vacuum cleaner 100, the energy storage member pack 262 extends generally vertically. The energy storage member pack may have a longest dimension 364 along a longitudinal axis 266 of the pack 262, and the longitudinal axis 266 may extend generally vertically such that the removal direction is along or generally along the longitudinal axis 266 of the energy storage member pack 262. The pack 262 may be an elongated pack, in which a longest dimension 264 of the pack is at least 150%, 175%, or 200% the length of the next longest dimension that is perpendicular to the longest dimension. As exemplified, the height 264 of the pack 262 is at least 150% the size of the width 434 of the pack 262.

The energy storage member pack 262 positioned in the hand vacuum cleaner 100 may extend generally parallel to the pistol grip handle 124. In other words, the longitudinal axis 266 of the pack 262 may be generally parallel to the axis 132 of the handle 124.

Alternately, or in addition, the energy storage member pack 262 positioned in the hand vacuum cleaner 100 may extend generally parallel to the pre-motor filter 190. In other words, the longitudinal axis 266 of the pack 262 may be generally parallel to the axis 252 of the filter 190. As exemplified, the energy storage member pack 262 is located immediately rearward of the pre-motor filter 190 and the energy storage member pack 262 or a forward wall defining a recess in which the energy storage member pack 262 is received may optionally abut a rear wall of the downstream header.

Pre-Motor Filter Facing Energy Storage Members

The following is a description of a pre-motor filter facing an energy storage member, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the pre-motor filter 190 has a face (e.g., the upstream face 320 or the downstream face 402) that faces the energy storage members 260 when the filter 190 is in the air flow path 164.

As exemplified in FIG. 4, the pre-motor filter 190 is positioned with the downstream face 402 facing at the energy storage member pack 262, and the longest dimension of the energy storage pack 262 is generally parallel to the longest dimension of the pre-motor filter 190.

Figure 5:
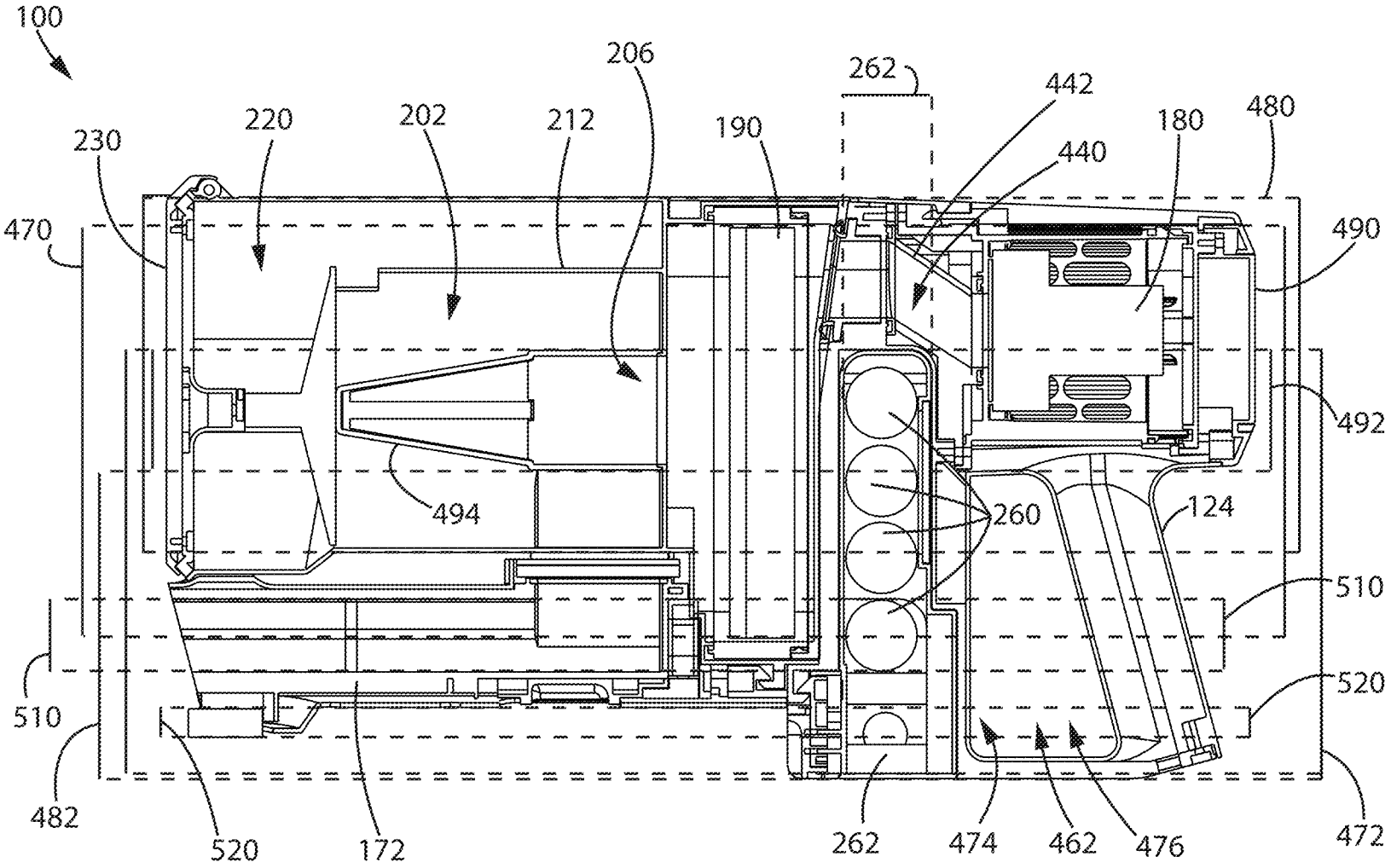
FIG. 5 is a second side cross-sectional view of the hand vacuum cleaner of FIG. 1.

As exemplified in FIG. 5, a projection 470 of the pre-motor filter 190 along the longitudinal axis 110, the cyclone axis 140, the motor axis 142, and/or the inlet conduit axis 144 may pass through one or more of the energy storage members 260 and/or the energy storage pack 262. A projection of the upstream face 320 or the downstream face 402 of the pre-motor filter 190, which extends through the other of the upstream face 320 and the downstream face 402, may also extend through the energy storage members 260 and/or the energy storage pack 262.

Air Passage Above the Energy Storage Members

The following is a description of an air passage over the energy storage member, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, pistol grip handle, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, a portion of the air flow path 164 that extends past the energy storage members 260 comprises a duct or conduit that is positioned above the energy storage members 260 and is external to the energy storage members 260 and/or energy storage member pack 262.

As exemplified in FIG. 4, the air flow path 164 comprises a downstream portion 440 that extends from the pre-motor filter housing 242 over the energy storage members 260 and/or pack 262 to the suction motor 180.

The downstream portion 440 extends between the pre-motor filter housing 242 and the suction motor 180. To maximize the vertical height of the energy storage member pack 262, and to thereby accommodate a larger number of energy storage members 260, the energy storage member pack 262 may extend upwardly into the main body 120 all of the way except for a space at an upper end of the surface cleaning apparatus 100 in which the duct 442 is located. Therefore, to accommodate a generally vertically extending energy storage member pack 262, as discussed previously, the air outlet of the pre-motor filter housing 242 may be provided in an upper portion 410 pre-motor filter housing 242.

To limit the vertical height of the surface cleaning apparatus when oriented as shown in FIG. 4, the suction motor 180 is positioned such that the upper end of the suction motor does not extend above any other component and thereby require the rear end of the surface cleaning apparatus to be taller. Accordingly, as exemplified, the upper end of the suction motor 180 may be located at about an elevation of the upper end of the pre-motor filter housing 242 and/or an upper end of the air treatment member assembly 150. Accordingly, all or a portion of the air inlet of the suction motor 180 may be positioned below an upper end of the energy storage member pack 262. As a result, the duct 442 extends from an upper portion 410 of the pre-motor filter housing 242 rearwardly and downwardly to the inlet of the suction motor 180.

It will be appreciated that, in other embodiments, the duct 442 may extend generally rearwardly.

Pistol Grip Handle

The following is a description of a pistol grip handle, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, rearwardly positioned handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the handle 124 may be a pistol grip handle. A pistol grip handle may improve hand feel. As exemplified in FIG. 4, the handle 124 is oriented generally vertically and/or transvers to the longitudinal axis 110, the cyclone axis 140, the motor axis 142, and/or the conduit axis 144. In this orientation, the handle axis 132 extends between a first or upper end 460 and a second or lower end 322, with the handle axis 132 extending generally vertically and/or transvers to the longitudinal axis 110, the cyclone axis 140, the motor axis 142, and/or the conduit axis 144.

The handle 124 may include a generally vertical hand grip portion 126 (e.g., a portion sized and shaped to permit a user to wrap their hand around). The apparatus 100 may have a finger gap 462 adjacent the handle 124 (e.g., forward of the hand grip portion 126) to receive the fingers of an operator.

Optionally, as exemplified, the handle 124 may be positioned below the suction motor 180. The first end 460 handle 124 may be secured to a portion of the main body 120 that houses the suction motor 180, which may be referred to as the suction motor housing 182, and optionally a lower side 108 of the suction motor housing 182. Accordingly, the finger grip gap or area 462 may be partially or fully below the suction motor 180. Arranging the handle vertically in line with, and preferably below, the suction motor may improve hand feel.

As exemplified in FIG. 4, the handle has a radially outward or lower portion 322 that is spaced from the lower side 108 of the suction motor housing 182.

A projection of the motor 180 generally vertically and/or transvers to the longitudinal axis 110, the cyclone axis 140, the motor axis 142, and/or the conduit axis 144 may intersect the handle 124 and/or finger gap 462. Optionally, the entirety of the handle 124 and/or finger gap 462 falls within a projection of the motor 180 generally vertically and/or transvers to the longitudinal axis 110, the cyclone axis 140, the motor axis 142, and/or the conduit axis 144.

Rearwardly Positioned Handle

The following is a description of a handle 124 positioned rearward of other components of the apparatus 100, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned control panel, centrally positioned components, in-line vortex finder, in-line inlet conduit, in-line central longitudinally extending axis and/or cyclone axis, in-line power connector, or horizontal resting position, which are set out herein.

In accordance with this aspect, the handle 124 is rearward of components of the apparatus 100. The handle 124 may be rearward of components such as the air treatment member 150, the pre-motor filter 190, and/or the energy storage member 260. A rearward handle 124 may improve hand-feel and/or facilitate using a nozzle 170 provided at a front end of the hand vacuum cleaner 100.

The handle 124 may be below and/or next to components that are heavy (i.e., the suction motor 180 and the energy storage member pack 262). Optionally, as exemplified in FIG. 4, the handle 124 is below the suction motor 180 and the energy storage member pack 262 is at a front end 474 of a finger grip area 462 that is forward of the handle 124. As exemplified, the finger gap 462 may be positioned between the pistol grip handle 124 (such that the pistol grip handle 124 may be provided at a rearward end 476 of the finger gap 462) and the energy storage members 260 and/or pack 262, or a rear wall of a recess which receives same, may define the front end 474 of the finger gap 462. As exemplified in FIG. 5, a projection 472 of the energy storage pack 262 along the longitudinal axis 110, the cyclone axis 140, the suction motor axis 142, and/or the conduit axis 144 may intersect the finger gap 462 and may intersect all of the finger gap 462.

Lighter components (i.e., the air treatment chamber 202, the dirt collection chamber 220, the inlet conduit 172, and the pre-motor filter 190) may be farther from the handle 124 than the heavy components, and may be, optionally, forward of the heavy components. Accordingly, the finger gap may be positioned rearward of the air treatment assembly 150. As exemplified in FIG. 5, a projection 480 of a portion of the air treatment assembly 150 along the longitudinal axis 110, the cyclone axis 140, the suction motor axis 142, and/or the conduit axis 144 may extend through most (e.g., 60-80%) of the finger gap 462. Optionally, a projection 480 of a portion of the air treatment assembly 150 may extend through all of the finger gap 462

Optionally, as exemplified, the pre-motor filter 190 is positioned forward of the pistol grip handle 124. As exemplified in FIG. 5, a projection 482 of the handle 124 and the finger gap 462 along the longitudinal axis 110, the cyclone axis 140, the suction motor axis 142, and/or the conduit axis 144 may intersect the pre-motor filter 190.

Rearwardly Positioned Control Panel

The following is a description of a rearwardly positioned control panel, which may be used by itself or in combination with one of more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, centrally positioned components, in-line vortex finder, in-line inlet conduit, in-line central longitudinally extending axis and/or cyclone axis, in-line power connector, or horizontal resting position, which are set out herein.

In accordance with this aspect, the surface cleaning apparatus 100 includes a user interface 490. The user interface 490 may be a control panel that contains one or more actuators (e.g., a button or touchscreen) operable to control one or more functions of the surface cleaning apparatus 100 or a component of the surface cleaning apparatus 100 (e.g., an on/off actuator to turn the motor 180 on and off, an on/off actuator to turn on and off a brush motor if the surface cleaning apparatus is connected to a surface cleaning head having a rotatable brush, or the actuator may have multiple positions to enable a motor to operate at multiple speeds). Alternately, or in addition, as exemplified in FIG. 2, the user interface 490 may comprise or consist of an information display having a first portion 494 that provides a first information and a second portion 496 that provides a second information of a different type than the first portion. For example, the first information may be whether a brush roll of a surface cleaning head that is upstream of the dirty air inlet 160 is operating and the second information may be an operating power mode of the suction motor 180 of the hand vacuum cleaner 100.

If the user interface 490 is only an information display panel, then as exemplified in FIG. 2, the rear end 104 may include one or more actuators, such as power switch 498.

The control panel 490 is located on a rear external surface of the surface cleaning apparatus 100 and/or may be on a center line of the surface cleaning apparatus. A rear-facing control panel may be easily accessible.

As exemplified in FIG. 2, the control panel or user interface 490 is provided at the rear end 104 on a rear surface 168 of the surface cleaning apparatus 100, wherein all or at least a portion of the control panel 490 is visible when viewing the surface cleaning apparatus 100 directly from the rear end 104. It will be appreciated that the rear-facing control panel may extend vertically as exemplified in FIG. 2 or generally vertically (e.g., upwardly and forwardly at an angle of less than 45°, 30° or 25° from the vertical.

Alternately or in addition, the control panel 490 may be centered, wherein the control panel 490 is on the longitudinal axis 110 of the surface cleaning apparatus. Alternately or in addition, the cyclone axis 140 may pass through the control panel 490. Alternately or in addition, as illustrated in FIG. 5, a projection 492 of the vortex finder 494 passes through the control panel 490.

As exemplified in FIG. 2, the control panel 490 may be on the rear most wall 169 that is spaced from the openable front end 320, and, when the openable front end is in a closed position, the openable front wall 320 may be generally parallel to the rear wall 168. A rear-facing control panel may be easily accessible (e.g., even when the front end 102 is used as a nozzle 170 applied to a surface and/or opened to dump the dirt collection chamber 220).

The suction motor axis 142 may extend through the information display device 490. Optionally, the information display device 490 may be positioned above the air treatment member 150 or a centerline thereof. For example, the suction motor axis 142 may be spaced (e.g., vertically) from the cyclone axis 140 and may pass beneath the display 490.

The rear end 104 may be of any suitable shape. As exemplified, the rear end 104 may be generally planar. A planar shape may facilitate mounting the control panel 490 and/or additional actuator(s).

Centrally Positioned Components

The following is a description of centrally positioned components, which may be used by itself or in combination with one of more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, in-line vortex finder, in-line inlet conduit, in-line central longitudinally extending axis and/or cyclone axis, in-line power connector, or horizontal resting position, which are set out herein.

Figure 13:
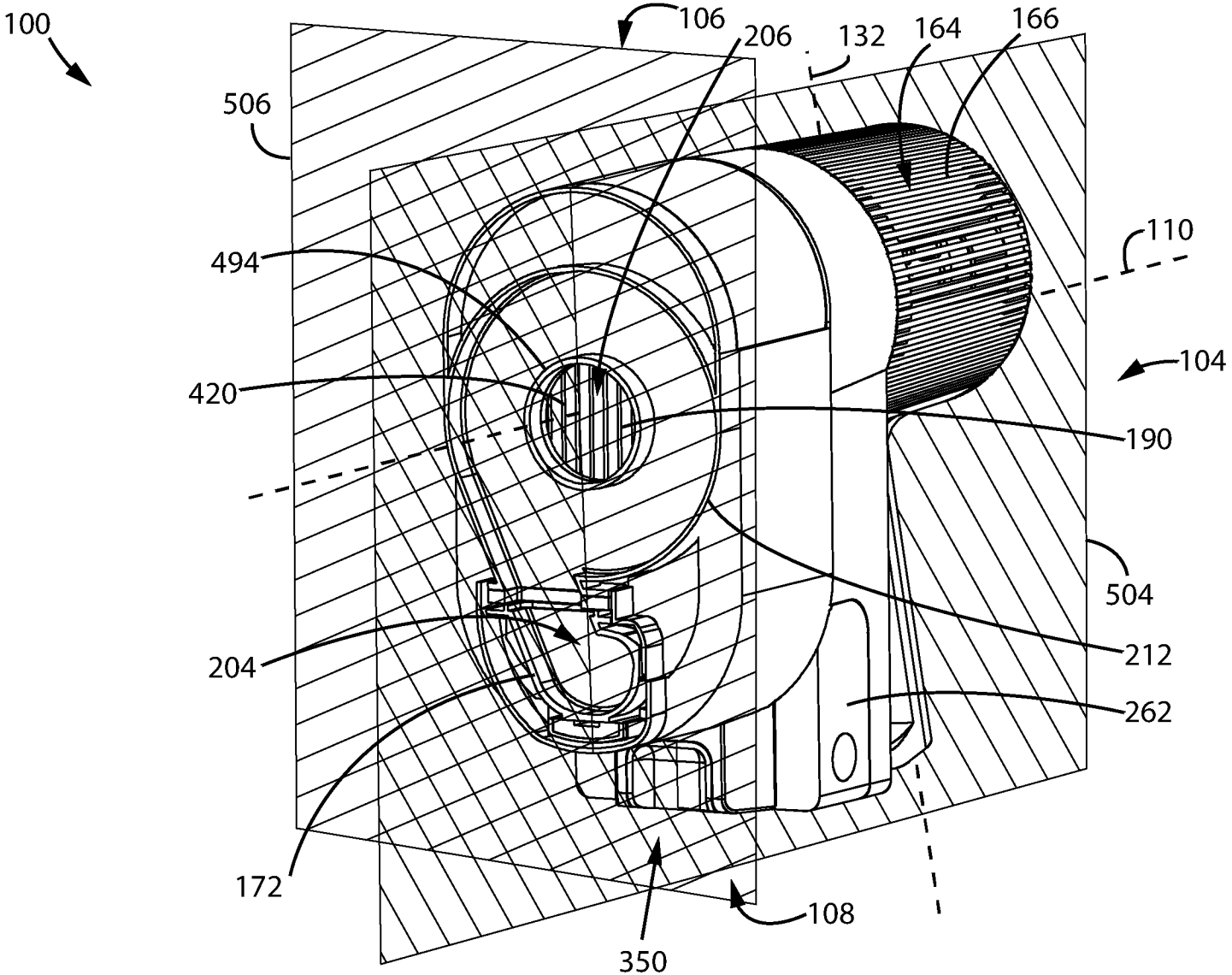
FIG. 13 is front cross-sectional perspective view of the hand vacuum cleaner of FIG. 1.

In accordance with this aspect, one or more components of the surface cleaning apparatus 100 are centrally positioned. The components may be positioned, or optionally symmetrically positioned, above and below a longitudinally extending horizontal plane (e.g., plane 500 in which the cyclone axis 140 lies or plane 502 in which the longitudinal axis 110 may lie, exemplified in FIGS. 12 and 16, centered between the top and bottom of the apparatus 100, optionally with the longitudinal axis 110 extending in the plane) and/or to the left and right of a longitudinally extending vertical plane (e.g., a plane 504, exemplified in FIGS. 12 and 13, centered between the lateral sides of the surface cleaning apparatus with the longitudinal axis 110 extending in the plane), and/or forward and rearward of a transversely extending vertical plane (e.g., a plane 506, exemplified in FIGS. 12 and 13, centered between the front and rear ends of the apparatus and wherein the longitudinal axis 110 is perpendicular to the plane 506). Central and/or symmetrical positioning of one or more components, optionally the heavier components such as the suction motor and the energy storage members 260, such that the weight of the components is evenly, or generally evenly, distributed on either side of one more of the planes may improve the balance of the surface cleaning apparatus 100 or otherwise improve the hand feel and/or the performance of the surface cleaning apparatus 100.

In an example, the longitudinally extending horizontal plane 502 may extend through one or more of the handle 124, the air treatment member 150, the dirt collection chamber 220, the pre-motor filter 190, the bin electrical connector 284, the energy storage member 260, and an openable end of the air treatment assembly 150, and may bisect one or more of these components.

Alternately, or in addition, a central axis 140 of the cyclone 202 may extend between the front end 102 of the hand vacuum cleaner 100 and the rear end 104 of the hand vacuum cleaner 100 and be centrally positioned between an upper end of the air treatment assembly 150 and a lower end of the air treatment assembly 150, and the central axis 140 may be located in the horizontal plane 500, and the horizontal plane 500 may extend through the pre-motor filter 190, the housing of the suction motor 180, and the plurality of energy storage members 260 and the inlet conduit 172 may be located below the horizontal plane. In some embodiments, the central axis 140 extends through the middle portion 418 of the pre-motor filter 190. The central axis 140 may extend through the middle portion 418 of the energy storage members 260.

Alternately, or in addition, the longitudinally extending vertical plane 504 may extend through one or more of the handle, the air treatment member 150, the dirt collection chamber 220, the pre-motor filter 190, the bin electrical connector 284, the energy storage member 260, the post motor filter 240, and an openable end of the air treatment assembly 150, and may bisect one or more of these components. For example, the plane 504 may extend through the dirt outlet 222 and an outlet port 280 of the inlet conduit 172 is located on one side of the vertical plane 504.

Alternately, or in addition, the transversely extending vertically centered plane 506 may extend through one or more of the air treatment member inlet 204, the vortex finder 494, the inlet conduit 172, and the air treatment member 150, and the dirt collection chamber 220, It will be understood that one or more of the components may be symmetrical about the longitudinally extending horizontally centered plane 500 or 502, the transversely extending vertically centered plane 504, and/or the longitudinally extending vertically centered plane 506. For example, the pre-motor filter 190 may be substantially symmetrical about the centre line (e.g., symmetrical about a vertical plane 504 and/or a horizonal plane 500) extending through the vortex finder 494 parallel to the longitudinal axis 110. As another example, the energy storage members 260 and/or pack 262 may be symmetrically positioned about one or more of these planes 500, 502, 504, 506. As another example, the motor controls 490 may be generally symmetrical about one or both of these planes.

In some examples, a main subset of the elements of the apparatus 100 (e.g., the inlet conduit 172, the air treatment member 150, the dirt collection chamber 220, the motor 180, the energy storage member pack 262, the handle 124, and the pre-motor filter 190) are symmetrical about at least one or at least two or at least three of the planes 500, 502, 504, 506, except the inlet 204 to the air treatment chamber 202 and/or the outlet 280 of the conduit 172, which is on one side of the vertically extending longitudinal plane 504 and on one side of the horizontally extending longitudinal plane 500 and/or 502. For example, the pre-motor filter 190, the air treatment chamber 202, the suction motor 180, and the handle 124 may be symmetrical about a longitudinally extending vertical centered plane (e.g., plane 504), while the inlet 204 to the air treatment chamber 202 is asymmetrically position with respect to the longitudinally extending horizontally centered plane (e.g., plane 500 and/or 502) and/or the longitudinally extending vertically centered plane (e.g., plane 504).

As exemplified in FIGS. 1 to 16, apparatus 100 may exhibit symmetry and/or balance about the horizontal plane 500 and/or 502. The horizontal plane 500 and/or 502 may extend through an upper end of the handle 124. The horizontal plane 500 and/or 502 may extend through a portion of a cleaner body 120 that houses the suction motor 180. The suction motor 180 may be positioned above the horizontal plane 500 and/or 502. The dirt outlet 222 of the cyclone 202 may be positioned above the horizontal plane 500 and/or 502.

Optionally, as exemplified, at least 80% of the motor 180 is positioned above the horizontal plane 500 and/or 502 and at least 75% of the plurality of energy storage members 260 are positioned below the horizontal plane 500 and/or 502.

Alternately, or in addition, the lower side of the hand vacuum 100 below the horizontal plane 500 and/or 502 and/or center line 140 may include the inlet conduit 172, at least 25%, 40%, or 50% of the pre-motor filter 190, at least 25%, 50%, or more than half of the pack 262, and at least 10%, 25%, or 50% of the handle 124, while the upper side of the hand vacuum cleaner 100 above the horizontal plane 500 or 502 and/or the center line 140 may include the dirt outlet 222, at least 25%, 40%, or 50% of the pre-motor filter 190, at least 10%, 20% or 30% of the pack 262, at least 50%, 75% or 90% of the motor 180, and at least 25%, 50%, or 75% of the post-motor filter.

In-Line Vortex Finder

The following is a description of an in-line vortex finder, which may be used by itself or in combination with one of more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line inlet conduit, in-line central longitudinally extending axis and/or cyclone axis, in-line power connector, or horizontal resting position, which are set out herein.

In accordance with this aspect, the vortex finder (or air outlet 206 of an air treatment chamber) 494 of the surface cleaning apparatus 100 is axially aligned with components of the surface cleaning apparatus 100. The vortex finder 494 may be axially aligned with one or more of the suction motor 180, the post-motor filter 240, the dirt collection chamber 220, the front openable door 230, the headers 292 and 294, the pre-motor filter 190, the energy storage member pack 262 and the handle 124.

As exemplified in FIG. 5, an axial projection 492 of the vortex finder 494 and/or air chamber outlet 206 extends through the suction motor 180, a volume surrounded by a perimeter of the post-motor filter 240, the dirt collection chamber 220, the pre-motor filter 190, the headers 292 and 294, the user interface 490, the front openable door 230, the energy storage pack 262 and the handle 124.

As exemplified, the projection 492 of the vortex finder extends through the suction motor 180 adjacent a lower end of the duct 442 and also an upper end of handle 124.

As exemplified in FIG. 18, an axial projection 492 of the vortex finder 494 and/or air chamber outlet 206 extends through the suction motor 180, a volume surrounded by a perimeter of the post-motor filter 240, the pre-motor filter 190, the headers 292 and 294, the user interface 490 and the front openable door 230.

In-Line Inlet Conduit

The following is a description of an in-line inlet conduit, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line central longitudinally extending axis and/or cyclone axis, in-line power connector, or horizontal resting position, which are set out herein.

In accordance with this aspect, the inlet conduit 172 of the surface cleaning apparatus 100 is axially aligned with components of the surface cleaning apparatus 100. The inlet conduit 172 may be axially aligned with one or more of the handle 124, the hand grip area 126, the energy storage member pack 262.

As exemplified in FIG. 4, an axial projection 510 of the inlet conduit 172 extends through the handle 124, the hand grip portion 126, the energy storage member pack 262 and the pre-motor filter 190. As exemplified, the inlet conduit 172 has an inlet conduit axis 144 that extends between a front end and the rear end 296 of the inlet conduit 172, and the inlet conduit axis 144 interests the handle 124.

As exemplified in FIG. 18, an axial projection 510 of the inlet conduit 172 extends through the suction motor 180, a volume surrounded by a perimeter of the post-motor filter 240, the pre-motor filter 190, the headers 292 and 294, the user interface 490 and the front openable door 230.

In-Line Central Longitudinally Extending Axis and/or Cyclone Axis

The following is a description of an in-line central longitudinally extending axis 110 and/or an inline cyclone axis 140, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line power connector, or horizontal resting position, which are set out herein.

In accordance with this aspect, the longitudinally extending axis 110 and/or the cyclone axis 140 of the surface cleaning apparatus 100 is axially aligned with components of the surface cleaning apparatus 100. The longitudinally extending axis 110 and/or the cyclone axis 140 may be axially aligned with one or more of the suction motor 180, the post-motor filter 240, the dirt collection chamber 220, the front openable door 230, the headers 292 and 294, the pre-motor filter 190, the energy storage member pack 262 and the handle 124.

As exemplified, the central longitudinally extending axis 110, the cyclone axis 140, and/or an axis that is parallel to the longitudinally extending axis 110 may extend through the dirt collection chamber and intersects the pre-motor filter 190.

As exemplified in FIG. 5, the air treatment member axis 140 extends through the suction motor 180, a volume surrounded by a perimeter of the post-motor filter 240, the dirt collection chamber 220, the pre-motor filter 190, the headers 292 and 294, the user interface 490, the front openable door 230 and the energy storage pack 262.

As exemplified in FIG. 18, the air treatment member axis 140 extends through the suction motor 180, a volume surrounded by a perimeter of the post-motor filter 240, the pre-motor filter 190, the headers 292 and 294, the user interface 490 and the front openable door 230

In-Line Power Connector

The following is a description of an in-line power connector, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, or horizontal resting position, which are set out herein.

In accordance with this aspect, the power connector 284 of the surface cleaning apparatus 100 is axially aligned with components of the surface cleaning apparatus 100. The power connector 284 may be axially aligned with one or more of the energy storage member pack 262, the finger gap 462, and the handle 124.

As exemplified in FIG. 5, the projection 520 of the power connector 284 at the nozzle 170 extends through the energy storage members pack 262, the handle 124 and the hand grip portion 126.

As exemplified in FIG. 18, a projection 520 of a power connector 284 that is located below the inlet conduit 172 would extend through the suction motor 180, a volume surrounded by a perimeter of the post-motor filter 240, the pre-motor filter 190, the headers 292 and 294, the user interface 490 and the front openable door 230.

Horizontal Resting Position

The following is a description of a horizontal resting position, which may be used by itself or in combination with one or more of the air treatment member being positioned above inlet conduit, lower tangential inlet to air treatment member, dirt collection forward of cyclone chamber, upper dirt outlet, concurrently openable cyclone and dirt collection chamber, stepped door, removable air treatment member, support recess for removeable air treatment member, pre-motor filter accessible when air treatment member is removed, large pre-motor filter, vertically pleated pre-motor filter, pre-motor filter facing energy storage members, energy storage member pack removes transversely, air passage above the energy storage members, pistol grip handle, rearwardly positioned handle, rearwardly positioned control panel, centrally positioned components, in-line vortex finder, in-line inlet conduit, in-line central longitudinally extending axis and/or cyclone axis, or in-line power connector, which are set out herein.

In accordance with this aspect, the surface cleaning apparatus 100 may include a lower surface 530 that includes a generally horizontal resting surface 534 such that the surface cleaning apparatus 100 may be upright (e.g., the upper end 106 above the lower end 108, such as the position of FIG. 4) when the surface 534 is resting on a horizontally extending environmental surface.

As exemplified in FIG. 4, the hand vacuum 100 may be stable when positioned as shown therein. The hand vacuum 100 is balanced on the handle 124 and battery pack housing 262 when placed on a horizontal environmental surface (e.g., a table).

Optionally, as exemplified, the lower surface 530 of the apparatus 100 may include a generally horizontal resting surface 534. The suction motor 180 and/or energy storage members 260 may be the heaviest components of the hand vacuum cleaner 100, and the horizontal surface 534 may extend below the suction motor 180 and/or energy storage members 260 when the hand vacuum cleaner 100 is upright.

The resting surface 534 may be generally planar and may extend parallel to the longitudinal axis 110, the cyclone axis 140, the suction motor axis 142, and/or the conduit axis 144.

The surface 534 may extend between the lateral sides of the apparatus 100. The lower surface 530 may be planar with a lateral width that is at least 50%, 60%, or 75% of the total width of the hand vacuum cleaner.

As the energy storage members 260 and the motor 180 above the handle 124 are generally the heaviest components, the surface 534 may be at the rear end 104 of the apparatus 100. As exemplified in FIG. 4, the resting surface 534 comprises a lower surface of the energy storage member pack 262 (or the lower surface of a recess into which the energy storage pack 262 is removably positioned), a lower surface of the handle 124 and a connecting flange extending therebetween (which closes off the finger gap 462. It will be appreciated that, in some embodiments, the resting surface 534 may consist of a lower surface of the energy storage member pack 262 (or the lower surface of a recess into which the energy storage pack 262 is removably positioned) and a lower surface of the handle 124 without any connecting flange.

The surface 534 may be, as exemplified, only at the rear end 104 (i.e., no horizontal resting surface 534 may be provided at the front end 102). The horizontal resting surface 534 may only be provided on the rearmost 60%, 50%, or 40% of the total length 532 of the apparatus 100.

The horizontal resting surface 534 may only be provided below the energy storage members 260 and/or the suction motor 180.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Clause Set A

1. A hand vacuum cleaner having a front end, a rear end, an upper end and a lower end, the hand vacuum cleaner comprising:
   (a) an air flow path extending from a dirty air inlet to a clean air outlet and comprising an air inlet conduit that extends rearwardly from the dirty air inlet;
   (b) an air treatment assembly comprising an air treatment chamber positioned in the air flow path, the air treatment assembly having an air treatment assembly air inlet, an air treatment assembly air outlet and an openable front end, the air treatment chamber is positioned above the inlet conduit;

(c) a suction motor housed in a cleaner body, the suction motor is positioned in the air flow path downstream of the air treatment assembly and upstream of the clean air outlet; and, (d) a pistol grip handle extending downwardly from a portion of the cleaner body that houses the suction motor, wherein the openable front end is openable in the absence of moving the air treatment member with respect to the inlet conduit.

2. The hand vacuum cleaner of clause 1 wherein the air treatment member is removable mounted to the inlet conduit.

3. The hand vacuum cleaner of clause 1 wherein an air treatment member axis extends between the front end of the hand vacuum cleaner and the rear end of the hand vacuum cleaner, the air treatment member axis is centrally located in the air treatment member, an upper end of the suction motor is positioned at the upper end of the hand vacuum cleaner and a lower end of the suction motor is located adjacent the air treatment axis.

4. The hand vacuum cleaner of clause 1 wherein a finger gap is positioned forward of the pistol grip handle and rearward of the air treatment assembly whereby a projection of a portion of the air treatment assembly extends through the finger gap.

5. The hand vacuum cleaner of clause 1 further comprising a removable energy storage member pack wherein, when the energy storage member pack is positioned in the hand vacuum cleaner, the energy storage member pack extends generally parallel to the pistol grip handle.

6. The hand vacuum cleaner of clause 5 wherein the lower end of the hand vacuum cleaner has an opening for removably receiving the energy storage member pack.

7. The hand vacuum cleaner of clause 1 further comprising an energy storage member pack, wherein a finger gap is positioned between the pistol grip handle and the energy storage member pack, the energy storage member pack is provided at a forward end of the finger gap and the pistol grip handle is provided at a rearward end of the finger gap.

8. The hand vacuum cleaner of clause 1 further comprising an energy storage member pack, wherein a finger gap is positioned between the pistol grip handle and the energy storage member pack, and an air treatment member axis that extends between the front end of the hand vacuum cleaner and the rear end of the hand vacuum cleaner extends through the energy storage member pack, the finger gap and the pistol grip handle.

9. The hand vacuum cleaner of clause 1 further comprising at least one energy storage member and a projection of the inlet conduit extends through the at least one energy storage member.

10. The hand vacuum cleaner of clause 9 wherein the projection of the inlet conduit also extends through the pistol grip handle.

11. The hand vacuum cleaner of clause 10 further comprising a pre-motor filter and the projection of the inlet conduit extends through the pre-motor filter.

12. The hand vacuum cleaner of clause 1 wherein the cleaner body includes first and second laterally opposed sidewalls, the air treatment assembly is removably mounted to the cleaner body and the air treatment member is seated between the sidewalls when the air treatment member is mounted to the cleaner body.

13. A hand vacuum cleaner having a front end, a rear end, an upper end and a lower end, the hand vacuum cleaner comprising:

(a) an air flow path extending from a dirty air inlet to a clean air outlet and comprising an air inlet conduit that extends rearwardly from the dirty air inlet;

(b) an air treatment assembly comprising an air treatment chamber positioned in the air flow path, the air treatment assembly having an air treatment assembly air inlet and an air treatment assembly air outlet, the air treatment chamber is positioned above the inlet conduit;

(c) a suction motor housed in a cleaner body, the suction motor is positioned in the air flow path downstream of the air treatment assembly and upstream of the clean air outlet; and, (d) a pistol grip handle extending downwardly from a portion of the cleaner body that houses the suction motor, wherein a finger gap is positioned forward of the pistol grip handle and rearward of the air treatment assembly whereby a projection of a portion of the air treatment assembly extends through the finger gap.

14. The hand vacuum cleaner of clause 13 further comprising at least one energy storage member and a projection of the inlet conduit extends through the at least one energy storage member.

15. The hand vacuum cleaner of clause 13 wherein a projection of the inlet conduit extends through the pistol grip handle.

16. The hand vacuum cleaner of clause 15 further comprising a pre-motor filter and the projection of the inlet conduit extends through the pre-motor filter.

17. A hand vacuum cleaner having a front end, a rear end, an upper end and a lower end, the hand vacuum cleaner comprising:

(a) an air flow path extending from a dirty air inlet to a clean air outlet and comprising an air inlet conduit that extends rearwardly from the dirty air inlet;

(b) an air treatment assembly comprising an air treatment chamber positioned in the air flow path, the air treatment assembly having an air treatment assembly air inlet and an air treatment assembly air outlet, the air treatment chamber is positioned above the inlet conduit;

(c) a suction motor housed in a cleaner body, the suction motor is positioned in the air flow path downstream of the air treatment assembly and upstream of the clean air outlet; and, (d) a pistol grip handle extending downwardly from a portion of the cleaner body that houses the suction motor, wherein a projection of the inlet conduit extends through the pistol grip handle.

18. The hand vacuum cleaner of clause 17 further comprising a pre-motor filter and the projection of the inlet conduit extends through the pre-motor filter.

19. The hand vacuum cleaner of clause 17 further comprising a removable energy storage member pack wherein, when the energy storage member pack is positioned in the hand vacuum cleaner, the projection of the inlet conduit extends through the energy storage member pack.

20. The hand vacuum cleaner of clause 19 wherein, when the energy storage member pack is positioned in the hand vacuum cleaner, the energy storage member pack extends generally parallel to the pistol grip handle.

Clause Set B

1. A hand vacuum cleaner having a front end, a rear end, an upper end and a lower end, the hand vacuum cleaner comprising:
   (a) a cleaner body comprising an inlet conduit having a dirty air inlet and housing a suction motor;
   (b) an air flow path extending from the dirty air inlet to a clean air outlet;
   (c) an air treatment assembly removably mounted to the cleaner body and positioned above the inlet conduit when mounted to cleaner body, the air treatment assembly comprising an air treatment chamber positioned in the air flow path, the air treatment assembly having an air treatment assembly air inlet, an air treatment assembly air outlet and an air treatment assembly axis that extends between the front end of the hand vacuum cleaner and the rear end of the hand vacuum cleaner;
   (d) a pre-motor filter positioned downstream of the air treatment assembly, wherein the suction motor is positioned in the air flow path downstream of the pre-motor filter and upstream of the clean air outlet;
   (e) a handle; and
   (f) a removable energy storage member pack, wherein the energy storage member pack is removable in a transverse direction that is generally transverse to the air treatment assembly axis, and wherein the pre-motor filter is removable with the air treatment assembly and, when the air treatment assembly has been removed from the cleaner body, the pre-motor filter is removable in an axial direction, and wherein the cleaner body has a forward facing wall and, when the air treatment assembly is mounted to the cleaner body, the forward facing wall defines a rear wall of a pre-motor filter housing.

2. The hand vacuum cleaner of clause 1 wherein the air treatment assembly axis intersects the pre-motor filter and the air flow path further comprises a downstream portion that extends from an upper portion of the pre-motor filter housing to the suction motor and the downstream portion is located above the energy storage member pack.
3. The hand vacuum cleaner of clause 2 wherein the energy storage member pack has a longitudinal axis that extends through a plurality of energy storage members and the longitudinal axis intersects the downstream portion.
4. The hand vacuum cleaner of clause 2 wherein the handle is a pistol grip handle, the energy storage member pack extends generally parallel to the pistol grip handle and a projection of the energy storage member pack extends through the downstream portion.
5. The hand vacuum cleaner of clause 1 wherein the air treatment member axis is centrally located in the air treatment member, an upper end of the suction motor is positioned at the upper end of the hand vacuum cleaner and a lower end of the suction motor is located adjacent the air treatment axis.
6. The hand vacuum cleaner of clause 5 wherein the pre-motor filter has a longitudinal length that extends in the transverse direction and the air flow path further comprises a downstream portion that extends from an upper portion of the pre-motor filter housing to the suction motor and the downstream portion is located above the energy storage member pack.
7. The hand vacuum cleaner of clause 6 wherein the energy storage member pack has a longitudinal axis that extends through a plurality of energy storage members and the longitudinal axis intersects the downstream portion.
8. The hand vacuum cleaner of clause 6 wherein the handle is a pistol grip handle, the energy storage member pack extends generally parallel to the pistol grip handle and a projection of the energy storage member pack extends through the downstream portion.
9. A hand vacuum cleaner having a front end, a rear end, an upper end and a lower end, the hand vacuum cleaner comprising:
   (a) a cleaner body comprising an inlet conduit having a dirty air inlet and housing a suction motor;
   (b) an air flow path extending from the dirty air inlet to a clean air outlet;
   (c) an air treatment assembly removably mounted to the cleaner body and positioned above the inlet conduit when mounted to cleaner body, the air treatment assembly comprising an air treatment chamber positioned in the air flow path, the air treatment assembly having an air treatment assembly air inlet, an air treatment assembly air outlet and an air treatment assembly axis that extends between the front end of the hand vacuum cleaner and the rear end of the hand vacuum cleaner;
   (d) a pre-motor filter positioned downstream of the air treatment assembly, wherein the suction motor is positioned in the air flow path downstream of the pre-motor filter and upstream of the clean air outlet;
   (e) a handle; and
   (f) a removable energy storage member pack, wherein the pre-motor filter is accessible when the air treatment assembly is removed and the energy storage member pack is removable in a transverse direction that is generally transverse to the air treatment assembly axis.

10. The hand vacuum cleaner of clause 9 wherein the pre-motor filter is removable with the air treatment assembly and, when the air treatment assembly has been removed from the cleaner body, the pre-motor filter is removable in an axial direction.
11. The hand vacuum cleaner of clause 9 wherein the cleaner body has a forward facing wall and, when the air treatment assembly is mounted to the cleaner body, the forward facing wall defines a rear wall of a pre-motor filter housing
12. The hand vacuum cleaner of clause 11 wherein the pre-motor filter housing comprises a downstream header that is located between a rearward facing downstream side of the pre-motor filter and the forward facing wall.
13. The hand vacuum cleaner of clause 9 wherein the suction motor has a suction motor axis of rotation that extends generally parallel to the air treatment assembly axis and is vertically spaced from the air treatment assembly axis.
14. The hand vacuum cleaner of clause 13 wherein the air treatment assembly axis intersects the pre-motor filter and the air flow path further comprises a downstream portion that extends from an upper portion of the pre-motor filter housing to the suction motor and the downstream portion is located above the energy storage member pack.
15. The hand vacuum cleaner of clause 14 wherein the energy storage member pack has a longitudinal axis that extends through a plurality of energy storage members and the longitudinal axis intersects the downstream portion.

16. The hand vacuum cleaner of clause 14 wherein the handle is a pistol grip handle, the energy storage member pack extends generally parallel to the pistol grip handle and a projection of the energy storage member pack extends through the downstream portion.

17. The hand vacuum cleaner of clause 9 wherein the air treatment member axis is centrally located in the air treatment member, an upper end of the suction motor is positioned at the upper end of the hand vacuum cleaner and a lower end of the suction motor is located adjacent the air treatment axis.

18. The hand vacuum cleaner of clause 17 wherein the pre-motor filter has a longitudinal length that extends in the transverse direction and the air flow path further comprises a downstream portion that extends from an upper portion of the pre-motor filter housing to the suction motor and the downstream portion is located above the energy storage member pack.

19. The hand vacuum cleaner of clause 18 wherein the energy storage member pack has a longitudinal axis that extends through a plurality of energy storage members and the longitudinal axis intersects the downstream portion.

20. The hand vacuum cleaner of clause 18 wherein the handle is a pistol grip handle, the energy storage member pack extends generally parallel to the pistol grip handle and a projection of the energy storage member pack extends through the downstream portion.

Clause Set C

1. A hand vacuum cleaner having a front end, a rear end, an upper end and a lower end, the hand vacuum cleaner comprising:
   (a) a cleaner body comprising an inlet conduit having a dirty air inlet and housing a suction motor;
   (b) an air flow path extending from the dirty air inlet to a clean air outlet;
   (c) an air treatment assembly comprising an air treatment chamber positioned in the air flow path, the air treatment assembly having an air treatment assembly air inlet, an air treatment assembly air outlet and an air treatment assembly axis that extends between the front end of the hand vacuum cleaner and the rear end of the hand vacuum cleaner;
   (d) a pre-motor filter housing that houses a pre-motor filter, the pre-motor filter housing is downstream of the air treatment assembly, wherein the air treatment assembly axis intersects the pre-motor filter housing;
   (e) an energy storage member pack; and,
   (f) a handle, wherein the air flow path further comprises a downstream portion that extends from the pre-motor filter housing to the suction motor and the downstream portion is located above the energy storage member pack.

2. The hand vacuum cleaner of clause 1 wherein the energy storage member pack has a longitudinal axis that extends through a plurality of energy storage members and the longitudinal axis intersects the downstream portion.

3. The hand vacuum cleaner of clause 1 wherein the handle is a pistol grip handle, the energy storage member pack extends generally parallel to the pistol grip handle and a projection of the energy storage member pack extends through the downstream portion.

4. The hand vacuum cleaner of clause 1 wherein the handle is a pistol grip handle, the pre-motor filter extends generally parallel to the pistol grip handle and a projection of the energy storage member pack extends through the downstream portion.

5. The hand vacuum cleaner of clause 4 wherein the pre-motor filter is positioned forwards of the pistol grip handle.

6. The hand vacuum cleaner of clause 1 wherein the pre-motor filter has a pre-motor filter length in a transverse direction that is transverse to the air treatment assembly axis, and the energy storage member pack as an energy storage member length in the transverse direction that is shorter than the pre-motor filter length.

7. The hand vacuum cleaner of clause 1 wherein the suction motor has a suction motor axis of rotation that extends generally parallel to the air treatment assembly axis and is vertically spaced from the air treatment assembly axis.

8. The hand vacuum cleaner of clause 7 wherein the energy storage member pack has a longitudinal axis that extends through a plurality of energy storage members and the longitudinal axis intersects the downstream portion.

9. The hand vacuum cleaner of clause 7 wherein the handle is a pistol grip handle, the energy storage member pack extends generally parallel to the pistol grip handle and a projection of the energy storage member pack extends through the downstream portion.

10. The hand vacuum cleaner of clause 1 wherein the air treatment member axis is centrally located in the air treatment member, an upper end of the suction motor is positioned at the upper end of the hand vacuum cleaner and a lower end of the suction motor is located adjacent the air treatment axis.

11. A hand vacuum cleaner having a front end, a rear end, an upper end and a lower end, the hand vacuum cleaner comprising:
   (a) a cleaner body comprising an inlet conduit having a dirty air inlet and housing a suction motor;
   (b) an air flow path extending from the dirty air inlet to a clean air outlet;
   (c) an air treatment assembly comprising an air treatment chamber positioned in the air flow path, the air treatment assembly having an air treatment assembly air inlet, an air treatment assembly air outlet and an air treatment assembly axis that extends between the front end of the hand vacuum cleaner and the rear end of the hand vacuum cleaner;
   (d) a pre-motor filter housing that houses a pre-motor filter, the pre-motor filter housing is downstream of the air treatment assembly, wherein the air treatment assembly axis intersects the pre-motor filter housing;
   (e) an energy storage member pack; and,
   (f) a handle, wherein the pre-motor filter has a pre-motor filter length in a transverse direction that is transverse to the air treatment assembly axis, and the energy storage member pack has an energy storage member length in the transverse direction that is shorter than the pre-motor filter length, and wherein the air flow path further comprises a downstream portion that extends from the pre-motor filter housing to the suction motor and the downstream portion extends past the energy storage member pack and is exterior to the energy storage member pack.

12. The hand vacuum cleaner of clause 10 wherein the energy storage member pack has a longitudinal axis that extends through a plurality of energy storage members and the longitudinal axis intersects the downstream portion.
13. The hand vacuum cleaner of clause 10 wherein the handle is a pistol grip handle, the energy storage member pack extends generally parallel to the pistol grip handle and a projection of the energy storage member pack extends through the downstream portion.
14. The hand vacuum cleaner of clause 10 wherein the handle is a pistol grip handle, the pre-motor filter extends generally parallel to the pistol grip handle and a projection of the energy storage member pack extends through the downstream portion.
15. The hand vacuum cleaner of clause 14 wherein the pre-motor filter is positioned forwards of the pistol grip handle.
16. The hand vacuum cleaner of clause 10 wherein the suction motor has a suction motor axis of rotation that extends generally parallel to the air treatment assembly axis and is vertically spaced from the air treatment assembly axis.
17. The hand vacuum cleaner of clause 16 wherein the energy storage member pack has a longitudinal axis that extends through a plurality of energy storage members and the longitudinal axis intersects the downstream portion.
18. The hand vacuum cleaner of clause 16 wherein the handle is a pistol grip handle, the energy storage member pack extends generally parallel to the pistol grip handle and a projection of the energy storage member pack extends through the downstream portion.
19. The hand vacuum cleaner of clause 10 wherein the air treatment member axis is centrally located in the air treatment member, an upper end of the suction motor is positioned at the upper end of the hand vacuum cleaner and a lower end of the suction motor is located adjacent the air treatment axis.
20. The hand vacuum cleaner of clause 10 wherein the pre-motor filter is positioned forward of the pistol grip handle.

Clause Set D

1. A hand vacuum cleaner having a front end, a rear end, an upper end and a lower end, the hand vacuum cleaner comprising:
   (a) an air flow path extending from a dirty air inlet to a clean air outlet;
   (b) an air treatment assembly comprising an air treatment chamber positioned in the air flow path, the air treatment assembly having an air treatment assembly air inlet, an air treatment assembly air outlet wherein air exits the air treatment assembly air outlet in an axial direction;
   (c) a pre-motor filter housing that is downstream of the air treatment assembly, the pre-motor filter housing houses a pre-motor filter, the pre-motor filter comprises a pleated filter material wherein the pleats extend in a transverse direction that is transverse to the axial direction;
   (d) a suction motor downstream of the pre-motor filter and upstream of the clean air outlet; and,
   (e) a handle.
2. The hand vacuum cleaner of clause 1 wherein a projection of the air outlet intersects the pleated filter material.
3. The hand vacuum cleaner of clause 1 wherein an air treatment assembly axis, which extends between the front end of the hand vacuum cleaner and the rear end of the hand vacuum cleaner, extends in the axial direction.
4. The hand vacuum cleaner of clause 3 wherein a projection of the air outlet intersects the pleated filter material.
5. The hand vacuum cleaner of clause 1 wherein an outlet of the air treatment assembly air outlet faces an upstream side of the pre-motor filter.
6. The hand vacuum cleaner of clause 5 wherein the pre-motor filter has a length in the transverse direction, the length extends between a first end of the pre-motor filter and a second end of the pre-motor filter, the pre-motor filter has a first portion at the first end, a second portion at the second end and a middle portion positioned between the first and second portions, the middle portion comprising 50% of the length of the pre-motor filter and the outlet of the air treatment assembly air outlet faces the middle portion.
7. The hand vacuum cleaner of clause 5 wherein the pre-motor filter has a length in the transverse direction, the length extends between a first end of the pre-motor filter and a second end of the pre-motor filter, the pre-motor filter has a first portion at the first end, a second portion at the second end and a middle portion positioned between the first and second portions, the middle portion comprising 30% of the length of the pre-motor filter and the outlet of the air treatment assembly air outlet faces the middle portion.
8. The hand vacuum cleaner of clause 6 wherein the pre-motor filter housing has an air outlet and a projection of the air outlet intersects the first portion of the pre-motor filter.
9. The hand vacuum cleaner of clause 1 wherein the pre-motor filter has a length in the transverse direction that is greater than a length of the air treatment chamber in the transverse direction.
10. The hand vacuum cleaner of clause 1 wherein the air treatment assembly comprises a dirt collection chamber exterior to the air treatment chamber and the pre-motor filter has a length in the transverse direction that is greater than a length of the air treatment chamber in the transverse direction.
11. The hand vacuum cleaner of clause 1 wherein the pre-motor filter housing has a length in the transverse direction, the length extends between a first end of the pre-motor filter housing and a second end of the pre-motor filter housing and the pre-motor filter housing has an air outlet at the first end of the pre-motor filter housing.
12. A hand vacuum cleaner having a front end, a rear end, an upper end and a lower end, the hand vacuum cleaner comprising:
   (a) an air flow path extending from a dirty air inlet to a clean air outlet;
   (b) an air treatment assembly comprising an air treatment chamber positioned in the air flow path, the air treatment assembly having an air treatment assembly air inlet, an air treatment assembly air outlet wherein air exits the air treatment assembly air outlet in an axial direction;
   (c) a pre-motor filter housing that is downstream of the air treatment assembly, the pre-motor filter housing houses a pre-motor filter, the pre-motor filter comprises a pleated filter material wherein the pleats extend in a transverse direction that is transverse to the axial direction and air enters the pre-motor filter housing in the axial direction;

(d) a suction motor downstream of the pre-motor filter and upstream of the clean air outlet; and, (e) a handle.

13. The hand vacuum cleaner of clause 12 wherein an air treatment assembly axis, which extends between the front end of the hand vacuum cleaner and the rear end of the hand vacuum cleaner, extends in the axial direction.

14. The hand vacuum cleaner of clause 12 wherein an outlet of the air treatment assembly air outlet faces an upstream side of the pre-motor filter.

15. The hand vacuum cleaner of clause 14 wherein the pre-motor filter has a length in the transverse direction, the length extends between a first end of the pre-motor filter and a second end of the pre-motor filter, the pre-motor filter has a first portion at the first end, a second portion at the second end and a middle portion positioned between the first and second portions, the middle portion comprising 50% of the length of the pre-motor filter and the outlet of the air treatment assembly air outlet faces the middle portion.

16. The hand vacuum cleaner of clause 14 wherein the pre-motor filter has a length in the transverse direction, the length extends between a first end of the pre-motor filter and a second end of the pre-motor filter, the pre-motor filter has a first portion at the first end, a second portion at the second end and a middle portion positioned between the first and second portions, the middle portion comprising 30% of the length of the pre-motor filter and the outlet of the air treatment assembly air outlet faces the middle portion.

17. The hand vacuum cleaner of clause 15 wherein the pre-motor filter housing has an air outlet and a projection of the air outlet intersects the first portion of the pre-motor filter.

18. The hand vacuum cleaner of clause 12 wherein the pre-motor filter has a length in the transverse direction that is greater than a length of the air treatment chamber in the transverse direction.

19. The hand vacuum cleaner of clause 12 wherein the air treatment assembly comprises a dirt collection chamber exterior to the air treatment chamber and the pre-motor filter has a length in the transverse direction that is greater than a length of the air treatment chamber in the transverse direction.

20. The hand vacuum cleaner of clause 12 wherein the pre-motor filter housing has a length in the transverse direction, the length extends between a first end of the pre-motor filter housing and a second end of the pre-motor filter housing and the pre-motor filter housing has an air outlet at the first end of the pre-motor filter housing.

Clause Set E

1. A hand vacuum cleaner having a front end, a rear end, an upper end and a lower end, the hand vacuum cleaner comprising:

(a) an air flow path extending from a dirty air inlet to a clean air outlet and comprising an air inlet conduit that extends rearwardly from the dirty air inlet;

(b) an air treatment assembly comprising an air treatment chamber positioned in the air flow path, the air treatment assembly having an air treatment assembly air inlet and an air treatment assembly air outlet, wherein air exits the air treatment assembly air outlet in an axial direction;

(c) a pre-motor filter downstream of the air treatment chamber;

(d) a suction motor housed in a cleaner body, the suction motor is positioned in the air flow path downstream of the air treatment assembly and upstream of the clean air outlet, the suction motor is provided at the upper end of the hand vacuum cleaner;

(e) at least one energy storage member; and, (f) a handle, wherein a projection of the air treatment assembly air outlet extends through the pre-motor filter, the at least one energy storage member and the suction motor.

2. The hand vacuum cleaner of clause 1 wherein the projection of the air treatment assembly air outlet extends through the handle.

3. The hand vacuum cleaner of clause 1 wherein the handle extends downwardly from a portion of a cleaner body that houses the suction motor.

4. The hand vacuum cleaner of clause 3 wherein the handle comprises a pistol grip handle.

5. The hand vacuum cleaner of clause 4 wherein the projection of the air treatment assembly air outlet extends through the pistol grip handle.

6. The hand vacuum cleaner of clause 1 wherein the at least one energy storage member comprises a plurality of energy storage members, an energy storage member axis extends through the plurality of energy storage members and the energy storage member axis is generally transverse to the axial direction.

7. The hand vacuum cleaner of clause 6 wherein a pre-motor filter axis extends through the pre-motor filter and the pre-motor filter axis is generally transverse to the axial direction.

8. The hand vacuum cleaner of clause 1 wherein a pre-motor filter axis extends through the pre-motor filter and the pre-motor filter axis is generally transverse to the axial direction.

9. The hand vacuum cleaner of clause 1 wherein the suction motor has an axis of rotation that intersects the pre-motor filter.

10. The hand vacuum cleaner of clause 1 wherein the suction motor has an axis of rotation that intersects the air treatment assembly.

11. The hand vacuum cleaner of clause 10 wherein the suction motor axis of rotation intersects the pre-motor filter.

12. The hand vacuum cleaner of clause 1 wherein the at least one energy storage member is removable in a downward direction.

13. A hand vacuum cleaner having a front end, a rear end, an upper end and a lower end, the hand vacuum cleaner comprising:

(a) an air flow path extending from a dirty air inlet to a clean air outlet and comprising an air inlet conduit that extends rearwardly from the dirty air inlet;

(b) an air treatment assembly comprising an air treatment chamber positioned in the air flow path, the air treatment assembly having an air treatment assembly air inlet and an air treatment assembly air outlet, wherein air exits the air treatment assembly air outlet in an axial direction, and wherein the air treatment chamber is positioned above the air inlet conduit;

(c) a pre-motor filter downstream of the air treatment chamber;

(d) a suction motor housed in a cleaner body, the suction motor is positioned in the air flow path downstream of the air treatment assembly and upstream of the clean air outlet;

(e) at least one energy storage member; and, (f) a handle extending downwardly from a portion of a cleaner body that houses the suction motor, wherein a projection of the air treatment assembly air outlet extends through the pre-motor filter, the at least one energy storage member and the suction motor.

14. The hand vacuum cleaner of clause 13 wherein the projection of the air treatment assembly air outlet extends through the handle.

15. The hand vacuum cleaner of clause 13 wherein the at least one energy storage member comprises a plurality of energy storage members, an energy storage member axis extends through the plurality of energy storage members and the energy storage member axis is generally transverse to the axial direction.

16. The hand vacuum cleaner of clause 16 wherein the pre-motor filter has a longest dimension in a longitudinal direction, a pre-motor filter axis extends through the pre-motor filter in the longitudinal direction and the pre-motor filter axis is generally transverse to the axial direction.

17. The hand vacuum cleaner of clause 13 wherein the pre-motor filter has a longest dimension in a longitudinal direction, a pre-motor filter axis extends through the pre-motor filter in the longitudinal direction and the pre-motor filter axis is generally transverse to the axial direction.

18. The hand vacuum cleaner of clause 13 wherein the at least one energy storage member is removable in a downward direction.

19. The hand vacuum cleaner of clause 13 wherein the pre-motor filter has a longest dimension in a longitudinal direction, the at least one energy storage member has a longest dimension in the longitudinal direction and the longest dimension of the at least one energy storage member is from 75 to 125% of the longest dimension of the pre-motor filter.

20. The hand vacuum cleaner of clause 19 wherein the handle comprises a pistol grip handle that extends in the longitudinal direction.

Clause Set F

1. A hand vacuum cleaner having a front end, a rear end, an upper end and a lower end, the hand vacuum cleaner comprising:

(a) an air flow path extending from a dirty air inlet to a clean air outlet and comprising an air inlet conduit that extends rearwardly from the dirty air inlet and has an air inlet conduit axis;

(b) an air treatment assembly comprising an air treatment chamber positioned in the air flow path, the air treatment assembly having an air treatment assembly air inlet and an air treatment assembly air outlet, wherein air exits the air treatment assembly air outlet in an axial direction, and wherein the air treatment chamber is positioned above the air inlet conduit;

(c) a pre-motor filter downstream of the air treatment chamber;

(d) a suction motor housed in a cleaner body, the suction motor is positioned in the air flow path downstream of the air treatment assembly and upstream of the clean air outlet; and, (e) a handle extending downwardly from a portion of a cleaner body that houses the suction motor, wherein a projection of the air inlet conduit extends through the pre-motor filter and the handle.

2. The hand vacuum cleaner of clause 1 further comprising at least one energy storage member and the projection of the air inlet conduit extends through the at least one energy storage member.

3. The hand vacuum cleaner of clause 2 wherein the at least one energy storage member comprises a plurality of energy storage members, an energy storage member axis extends through the plurality of energy storage members and the energy storage member axis is generally transverse to the air inlet conduit axis.

4. The hand vacuum cleaner of clause 3 wherein the pre-motor filter has a longest dimension in a longitudinal direction, a pre-motor filter axis extends through the pre-motor filter in the longitudinal direction and the pre-motor filter axis is generally transverse to the air inlet conduit axis.

5. The hand vacuum cleaner of clause 1 wherein the pre-motor filter has a longest dimension in a longitudinal direction, a pre-motor filter axis extends through the pre-motor filter in the longitudinal direction and the pre-motor filter axis is generally transverse to the air inlet conduit axis.

6. The hand vacuum cleaner of clause 1 wherein the handle comprises a pistol grip handle.

7. The hand vacuum cleaner of clause 1 wherein the at least one energy storage member is removable in a downward direction.

8. The hand vacuum cleaner of clause 1 further comprising at least one energy storage member, the pre-motor filter has a longest dimension in a longitudinal direction, the at least one energy storage member has a longest dimension in the longitudinal direction and the longest dimension of the at least one energy storage member is from 75 to 125% of the longest dimension of the pre-motor filter.

9. The hand vacuum cleaner of clause 8 wherein the air inlet conduit also extends through the at least one energy storage member.

10. The hand vacuum cleaner of clause 9 wherein the handle comprises a pistol grip handle that extends in the longitudinal direction.

11. The hand vacuum cleaner of clause 8 wherein the handle comprises a pistol grip handle that extends in the longitudinal direction.

12. The hand vacuum cleaner of clause 1 further comprising at least one energy storage member and a projection of the air treatment assembly air outlet extends through the at least one energy storage member and the suction motor.

13. The hand vacuum cleaner of clause 1 further comprising at least one energy storage member and a projection of the air treatment assembly air outlet extends through the at least one energy storage member.

14. The hand vacuum cleaner of clause 1 wherein a projection of the air treatment assembly air outlet extends through the suction motor.

15. The hand vacuum cleaner of clause 1 further comprising a plurality of one energy storage members, the plurality of energy storage members has a longest dimension in a longitudinal direction, the pre-motor filter has a longest dimension in the longitudinal direction and the pre-motor filter faces the plurality of energy storage members.

16. The hand vacuum cleaner of clause 1 wherein the pre-motor filter has a longest dimension in a longitudinal direction, the handle has a longest dimension in the longitudinal direction and the longest dimension of the pre-motor filter is from 75 to 125% of the longest dimension of the handle.

17. The hand vacuum cleaner of clause 1 wherein the pre-motor filter has a longest dimension in a longitudinal direction, the handle has a longest dimension in the longitudinal direction and the longest dimension of the pre-motor filter is longer than the longest dimension of the handle.

Clause Set G

1. A hand vacuum cleaner having a front end, a rear end, an upper end and a lower end, the hand vacuum cleaner comprising:
   (a) an air flow path extending from a dirty air inlet to a clean air outlet and comprising an air inlet conduit that extends rearwardly from the dirty air inlet and has an air inlet conduit axis;
   (b) an air treatment assembly comprising an air treatment chamber positioned in the air flow path, the air treatment assembly having an air treatment assembly air inlet, an air treatment assembly air outlet and a central axis extending between the front end of the hand vacuum cleaner and the rear end of the hand vacuum cleaner and centrally positioned between an upper end of the air treatment assembly and a lower end of the air treatment assembly, wherein air exits the air treatment assembly air outlet in an axial direction;
   (c) a pre-motor filter downstream of the air treatment chamber;
   (d) a suction motor housed in a cleaner body, the suction motor is positioned in the air flow path downstream of the air treatment assembly and upstream of the clean air outlet;
   (e) a plurality of energy storage members; and,
   (f) a handle extending downwardly from the rear end of the hand vacuum cleaner, wherein the central axis is located in a horizontal plane, the horizontal plane extends through the pre-motor filter and the plurality of energy storage members and the inlet conduit is located below the horizontal plane.
2. The hand vacuum cleaner of clause 1 wherein the handle extends downwardly from a portion of a cleaner body that houses the suction motor.
3. The hand vacuum cleaner of clause 2 wherein the handle comprises a pistol grip handle.
4. The hand vacuum cleaner of clause 1 wherein the pre-motor filter has a length in a transverse direction that is transverse to the central axis, the length extends between a first end of the pre-motor filter and a second end of the pre-motor filter, the pre-motor filter has a first portion at the first end, a second portion at the second end and a middle portion positioned between the first and second portions, the middle portion comprising 30% of the length of the pre-motor filter and the central axis extends through the middle portion.
5. The hand vacuum cleaner of clause 1 wherein the plurality of energy storage members has a length in a transverse direction that is transverse to the central axis, the length extends between a first end of the plurality of energy storage members and a second end of the plurality of energy storage members, the plurality of energy storage members has a first portion at the first end, a second portion at the second end and a middle portion positioned between the first and second portions, the middle portion comprising 30% of the length of the plurality of energy storage members and the central axis extends through the middle portion.
6. The hand vacuum cleaner of clause 1 wherein the horizontal plane extends through an upper end of the handle.
7. The hand vacuum cleaner of clause 1 wherein the horizontal plane extends through a portion of a cleaner body that houses the suction motor.
8. The hand vacuum cleaner of clause 7 wherein the suction motor is positioned above the horizontal plane.
9. The hand vacuum cleaner of clause 1 wherein the air treatment assembly further comprises a dirt collection chamber that is external to the air treatment chamber, the air treatment chamber has a dirt outlet in communication with the dirt collection chamber and the dirt outlet is positioned above the horizontal plane.
10. The hand vacuum cleaner of clause 1 wherein at least 80% of the motor is positioned above the horizontal plane and at least 75% of the plurality of energy storage members are positioned below the horizontal plane.
11. The hand vacuum cleaner of clause 1 wherein the plurality of energy storage members has a longest dimension in a longitudinal direction, the pre-motor filter has a longest dimension in the longitudinal direction and the pre-motor filter faces the plurality of energy storage members.
12. The hand vacuum cleaner of clause 11 wherein the longitudinal direction is generally transverse to the central axis.
13. The hand vacuum cleaner of clause 1 wherein the pre-motor filter has a longest dimension in a longitudinal direction, the handle has a longest dimension in the longitudinal direction and the longest dimension of the pre-motor filter is from 75 to 125% of the longest dimension of the handle.
14. The hand vacuum cleaner of clause 13 wherein the longitudinal direction is generally transverse to the central axis.
15. The hand vacuum cleaner of clause 1 wherein the pre-motor filter has a longest dimension in a longitudinal direction, the handle has a longest dimension in the longitudinal direction and the longest dimension of the pre-motor filter is longer than the longest dimension of the handle.
16. The hand vacuum cleaner of clause 15 wherein the longitudinal direction is generally transverse to the central axis.
17. The hand vacuum cleaner of clause 1 wherein the inlet conduit axis extends through the plurality of energy storage members.
18. The hand vacuum cleaner of clause 1 wherein the inlet conduit axis extends through the pre-motor filter.
19. The hand vacuum cleaner of clause 1 wherein the inlet conduit axis extends through the pre-motor filter and the plurality of energy storage members.
20. The hand vacuum cleaner of clause 19 wherein the handle comprises a pistol grip handle.

Clause Set H

1. A hand vacuum cleaner having a front end, a rear end, an upper end and a lower end, the hand vacuum cleaner comprising:

(a) a cleaner body comprising an inlet conduit having a dirty air inlet and housing a suction motor;

(b) an air flow path extending from the dirty air inlet to a clean air outlet;

(c) an air treatment assembly removably mounted to the cleaner body, the air treatment assembly comprising an air treatment chamber positioned in the air flow path, the air treatment assembly having an air treatment assembly air inlet, an air treatment assembly air outlet and a central axis extending between the front end of the hand vacuum cleaner and the rear end of the hand vacuum cleaner and centrally positioned between an upper end of the air treatment assembly and a lower end of the air treatment assembly, wherein air exits the air treatment assembly air outlet in an axial direction;

(d) a pre-motor filter downstream of the air treatment chamber; and, (e) a handle, wherein the cleaner body includes first and second laterally opposed sidewalls, and the air treatment member is seated between the sidewalls when the air treatment member is mounted to the cleaner body.

2. The hand vacuum cleaner of clause 1 wherein the cleaner body has a forward facing wall and, when the air treatment assembly is mounted to the cleaner body, the forward facing wall defines a rear wall of a pre-motor filter housing.

3. The hand vacuum cleaner of clause 2 wherein the pre-motor filter housing comprises a downstream header that is located between a rearward facing downstream side of the pre-motor filter and the forward facing wall.

4. The hand vacuum cleaner of clause 2 wherein the sidewalls extend forwardly from the forward facing wall.

5. The hand vacuum cleaner of clause 1 wherein the inlet conduit is provided at a lower end of the sidewalls.

6. The hand vacuum cleaner of clause 1 wherein the inlet conduit has an outlet port that is in air flow communication with the air treatment assembly when the air treatment assembly is mounted to the cleaner body and at least 50% of the outlet port is located between the sidewalls.

7. The hand vacuum cleaner of clause 1 wherein the inlet conduit has an outlet port that is in air flow communication with the air treatment assembly when the air treatment assembly is mounted to the cleaner body and the outlet port is located between the sidewalls.

8. The hand vacuum cleaner of clause 1 wherein the inlet conduit and the sidewalls define a generally U-shaped recess in which the air treatment member is removably received.

9. The hand vacuum cleaner of clause 8 wherein a rearward end of the air treatment assembly has a laterally opposed recessed portions in which the sidewalls are removably received.

10. The hand vacuum cleaner of clause 1 wherein the pre-motor filter is removable with the air treatment assembly.

Clause Set I

1. A hand vacuum cleaner having a front end, a rear end, an upper end and a lower end, the hand vacuum cleaner comprising:

(a) an air flow path extending from a dirty air inlet to a clean air outlet and having a suction motor provided therein;

(b) an air treatment assembly provided in the air flow path, the air treatment assembly comprising an air treatment chamber, a dirt collection chamber external to the air treatment chamber, an air treatment assembly air inlet, an air treatment assembly air outlet, a dirt outlet connecting the air treatment chamber in communication with the dirt collection chamber, an openable front end and a central axis extending between a front end of the air treatment assembly and a rear end of the air treatment assembly; and, (c) a handle, wherein, the openable front end comprises an air treatment chamber closure member and a dirt collection chamber closure member, the openable front end has an inner side having the dirt collection chamber closure member thereon, wherein, when the openable front end is in an opened position, a front end of air treatment chamber and a front end of the dirt collection chamber are each opened, and when the openable front end is in a closed position, the dirt collection chamber closure member seals the front end of the dirt collection chamber and the air treatment chamber closure member seals the front end of the air treatment chamber, wherein the front end of the air treatment chamber is located rearwardly from the front end of the dirt collection chamber.

2. The hand vacuum cleaner of clause 1 wherein, when the openable front end is in the closed position, the air treatment chamber closure member extends axially inwardly from the dirt collection chamber closure member.

3. The hand vacuum cleaner of clause 1 wherein the air treatment chamber closure member comprises an axially extending cylindrical member provided on the inner side of the openable front end.

4. The hand vacuum cleaner of clause 1 wherein the air treatment chamber is located within the dirt collection chamber and the air treatment chamber closure member is located radially inwardly from an outer perimeter of the openable front end.

5. The hand vacuum cleaner of clause 1 wherein the air treatment chamber has an axial length that is shorter than an axial length of the dirt collection chamber.

6. The hand vacuum cleaner of clause 1 wherein the air treatment assembly air inlet is provided in the openable front end.

7. The hand vacuum cleaner of clause 1 wherein the dirt outlet is provided at a rear end of the air treatment chamber.

8. The hand vacuum cleaner of clause 1 wherein the dirt outlet is provided in an axially extending sidewall of the air treatment chamber.

9. The hand vacuum cleaner of clause 1 wherein the air treatment chamber is located asymmetrically within the dirt collection chamber and the air treatment chamber closure member is located radially inwardly from an outer perimeter of the openable front end.

10. A surface cleaning apparatus comprising:

(a) an air flow path extending from a dirty air inlet to a clean air outlet and having a suction motor provided therein; and, (b) an air treatment assembly provided in the air flow path, the air treatment assembly comprising an air treatment chamber, a dirt collection chamber external to the air treatment chamber, an air treatment assembly air inlet, an air treatment assembly air outlet, a dirt outlet connecting the air treatment chamber in communication with the dirt collection chamber, a central axis extending between a first and second spaced apart opposed ends of the air treatment assembly, wherein the first end is openable, wherein, the first end comprises an air treatment chamber closure member and a dirt collection chamber closure member, the first end has an inner side having the dirt collection chamber closure member thereon, wherein, when the first end is in an opened position, a first end of air treatment chamber and a first end of the dirt collection chamber are each opened, and when the first end is in a closed position, the dirt collection chamber closure member seals the first end of the dirt collection chamber and the air treatment chamber closure member seals the first end of the air treatment chamber, wherein the first end of the air treatment chamber is located rearwardly from the first end of the dirt collection chamber.

11. The hand vacuum cleaner of clause 10 wherein, when the first end is in the closed position, the air treatment chamber closure member extends axially inwardly from the dirt collection chamber closure member.

12. The hand vacuum cleaner of clause 10 wherein the air treatment chamber closure member comprises an axially extending cylindrical member provided on the inner side of the first end.

13. The hand vacuum cleaner of clause 10 wherein the air treatment chamber is located within the dirt collection chamber and the air treatment chamber closure member is located radially inwardly from an outer perimeter of the openable front end.

14. The hand vacuum cleaner of clause 10 wherein the air treatment chamber has an axial length that is shorter than an axial length of the dirt collection chamber.

15. The hand vacuum cleaner of clause 10 wherein the air treatment assembly air inlet is provided in the first end.

16. The hand vacuum cleaner of clause 10 wherein the dirt outlet is provided at a second end of the air treatment chamber that is axially spaced from the first end of the air treatment chamber.

17. The hand vacuum cleaner of clause 10 wherein the dirt outlet is provided in an axially extending sidewall of the air treatment chamber.

18. The hand vacuum cleaner of clause 10 wherein the air treatment chamber is located asymmetrically within the dirt collection chamber and the air treatment chamber closure member is located radially inwardly from an outer perimeter of the first end.

The invention claimed is:

1. A hand vacuum cleaner having a front end, a rear end, an upper end and a lower end, the hand vacuum cleaner comprising:

(a) an air flow path extending from a dirty air inlet to a clean air outlet;

(b) a cyclone unit comprising a cyclone unit front wall, a cyclone provided in the air flow path and a dirt collection chamber external to the cyclone, the cyclone comprising a cyclone chamber having a cyclone air inlet, a cyclone air outlet, a dirt outlet in communication with the dirt collection chamber, a central longitudinally extending axis, a cyclone chamber front end comprising a cyclone chamber front wall, a cyclone chamber rear end that is axially spaced from and opposed to the cyclone chamber front end and a sidewall located between the cyclone chamber front end and the cyclone chamber rear end, the cyclone air inlet and the cyclone air outlet are located at the cyclone chamber rear end and the dirt outlet comprises a gap between the cyclone chamber front wall and the sidewall wherein, when the upper end of the hand vacuum cleaner is positioned above the lower end of the hand vacuum cleaner, the central longitudinally extending axis is oriented generally horizontally, the cyclone air inlet is located at a lower end of the cyclone and the dirt outlet is located at an upper end of the cyclone; and, (c) a suction motor positioned in the air flow path, the suction motor is located in a cleaner body.

2. The hand vacuum cleaner of claim 1 wherein the cyclone unit front wall is openable.

3. The hand vacuum cleaner of claim 2 wherein, when the cyclone unit front wall is opened, the cyclone chamber and the dirt collection chamber are each opened.

4. The hand vacuum cleaner of claim 2 wherein the dirt outlet comprises a circumferentially extending slot provided between the cyclone chamber front wall and the sidewall, the slot having a forward side defined by the cyclone chamber front wall and a rearward side defined by the sidewall and, when the cyclone chamber front wall is opened, the forward side of the slot is moved relative to the rearward side of the slot whereby the slot is opened.

5. The hand vacuum cleaner of claim 2 further comprising a handle, the handle having a first end mounted on a portion of the cleaner body housing the suction motor and a radially outward portion, wherein a front end of the cyclone unit has a first side that is rotationally mounted to the cyclone unit and a vertically opposed side that is releasably securable to the cyclone unit, and when the front end of the cyclone unit is in a closed position, the radially outward portion of the handle and the vertically opposed side of the front end of the cyclone unit are located on a common end of the hand vacuum cleaner.

6. The hand vacuum cleaner of claim 2 further comprising an additional dirt outlet wherein, when the upper end of the hand vacuum cleaner is positioned above the lower end of the hand vacuum cleaner, the additional dirt outlet is located at the lower end of the cyclone.

7. The hand vacuum cleaner of claim 1 further comprising a pre-motor filter, wherein the pre-motor filter has a height in a direction transverse to the central longitudinally extending axis that is larger than a height of the cyclone in the direction transverse to the central longitudinally extending axis.

8. The hand vacuum cleaner of claim 7 wherein an axis that is parallel to the central longitudinally extending axis extends through the dirt collection chamber and intersects the pre-motor filter.

9. The hand vacuum cleaner of claim 1 wherein the central longitudinally extending axis is located in a vertical plane that extends between the upper and lower ends of the hand vacuum cleaner, the plane extends through the dirt outlet and an outlet port of the cyclone air inlet is located on one side of the vertical plane.

10. The hand vacuum cleaner of claim 1 further comprising an additional dirt outlet wherein, when the upper end of the hand vacuum cleaner is positioned above the lower end of the hand vacuum cleaner, the additional dirt outlet is located at the lower end of the cyclone.

11. The hand vacuum cleaner of claim 1 wherein the dirty air inlet comprises an inlet conduit that is located at the lower end of the hand vacuum cleaner.

12. The hand vacuum cleaner of claim 11 wherein the inlet conduit is part of the cleaner body and the cyclone unit is removably mounted to the cleaner body.

13. The hand vacuum cleaner of claim 11 wherein the cyclone unit is vertically removable from the inlet conduit.

14. The hand vacuum cleaner of claim 11 wherein the cyclone unit is removably mounted to the cleaner body and, when the cyclone unit is mounted to the cleaner body, the cyclone unit is located on an upper end of the inlet conduit.

15. The hand vacuum cleaner of claim 14 further comprising a handle, the inlet conduit has an inlet conduit axis that extends between a front end and a rear end of the inlet conduit and the inlet conduit axis interests the handle.

16. The hand vacuum cleaner of claim 15 wherein the handle is a pistol grip handle.

17. The hand vacuum cleaner of claim 11 wherein the suction motor is located at the upper end of the hand vacuum cleaner.

18. The hand vacuum cleaner of claim 17 wherein the handle is a pistol grip handle that extends downwardly from a lower side of the cleaner body.

19. The hand vacuum cleaner of claim 17 wherein the handle is a pistol grip handle that extends downwardly from a portion of the cleaner body that houses the suction motor.

20. The hand vacuum cleaner of claim 11 wherein the front end of the cyclone unit is openable, the front end of the cyclone unit has an upper side that is rotationally mounted to the cyclone unit and a lower side that is releasably securable in a closed position, and the lower side is adjacent the inlet conduit.

* * * * *